US011414302B1

(12) United States Patent
De Ledebur et al.

(10) Patent No.: US 11,414,302 B1
(45) Date of Patent: Aug. 16, 2022

(54) FOLDABLE ELEVATOR STRUCTURES FOR CABIN AND SHAFT

(71) Applicants: Juan-Carlos G. De Ledebur, Key Biscayne, FL (US); Stefan A. Gruber, Miami, FL (US); Patrick-Andrew G. De Ledebur, Miami, FL (US)

(72) Inventors: Juan-Carlos G. De Ledebur, Key Biscayne, FL (US); Stefan A. Gruber, Miami, FL (US); Patrick-Andrew G. De Ledebur, Miami, FL (US)

( * ) Notice: Subject to any disclaimer, the term of this patent is extended or adjusted under 35 U.S.C. 154(b) by 0 days.

(21) Appl. No.: 17/226,711

(22) Filed: Apr. 9, 2021

(51) Int. Cl.
*B66B 11/02* (2006.01)
*B66B 19/00* (2006.01)
*B66B 11/00* (2006.01)

(52) U.S. Cl.
CPC ..... *B66B 11/0206* (2013.01); *B66B 11/0005* (2013.01); *B66B 19/00* (2013.01)

(58) Field of Classification Search
CPC ..... B66B 9/16; B66B 11/02; B66B 11/0206; E04H 15/44; E04H 15/48; E04B 1/344; E04B 1/3442; E04B 1/34357
See application file for complete search history.

(56) References Cited

U.S. PATENT DOCUMENTS 1,900,274 A * 3/1933 Brockie ..... E04H 15/48 135/147
4,361,208 A * 11/1982 Jackson ..... B66B 11/0226 187/401
4,700,809 A * 10/1987 Lazar ..... B66B 11/0253 187/401
4,708,222 A 11/1987 Bills et al.
4,805,373 A 2/1989 Gaccetta et al.
5,373,916 A 12/1994 Kiviniemi et al.
5,655,628 A 8/1997 Lin
6,035,877 A * 3/2000 Losi, Jr ..... E04H 15/322 135/131
6,349,434 B1 * 2/2002 Zhuang ..... A47D 13/063 5/98.1
7,152,614 B2 * 12/2006 Kalnay ..... E04B 1/34305 135/128
7,510,056 B2 3/2009 Bonatre
9,340,992 B2 * 5/2016 Huang ..... E04H 15/32
10,836,608 B2 11/2020 Peacock et al.
(Continued)

FOREIGN PATENT DOCUMENTS

CN 109987487 A * 7/2019
CN 112520543 A * 3/2021
(Continued)

*Primary Examiner* — Minh Truong
(74) *Attorney, Agent, or Firm* — Patent CEO, LLC; Phillip Vales

(57) ABSTRACT

A foldable elevator cabin and a foldable elevator shaft are disclosed. The foldable elevator cabin has a plurality of members attached at a centralized point for centralized folding using arms attached between each member. A ceiling and a base are attached to the top and bottom of the various members. Secondly, a foldable elevator structure having a plurality of members is shown having each member sequentially attached between a preceding member and a succeeding member until all members have been attached. In this fashion, the foldable structure is foldable between each set of two adjacent members.

35 Claims, 46 Drawing Sheets

(56) References Cited

U.S. PATENT DOCUMENTS

| | | | | |
|---|---|---|---|---|
| 2018/0209167 | A1* | 7/2018 | Yang | E04H 15/48 |
| 2020/0165838 | A1* | 5/2020 | Thomas | E04H 1/1277 |

FOREIGN PATENT DOCUMENTS

| | | | | |
|---|---|---|---|---|
| EP | 3031764 | A1 * | 6/2016 | B66B 11/0226 |
| EP | 3560877 | A1 * | 10/2019 | B66B 11/0246 |
| WO | WO-2018033984 | A1 * | 2/2018 | B66B 11/02 |

* cited by examiner

FIG 35A
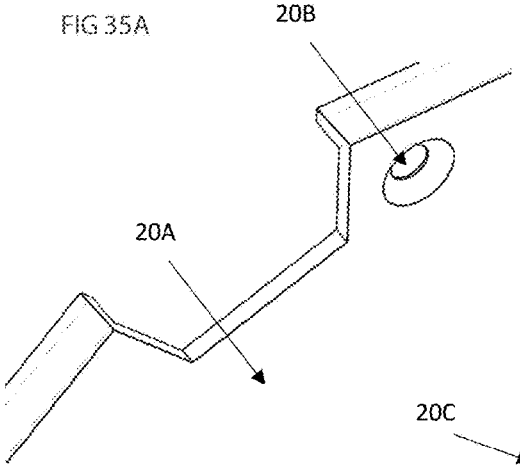
FIG 35B
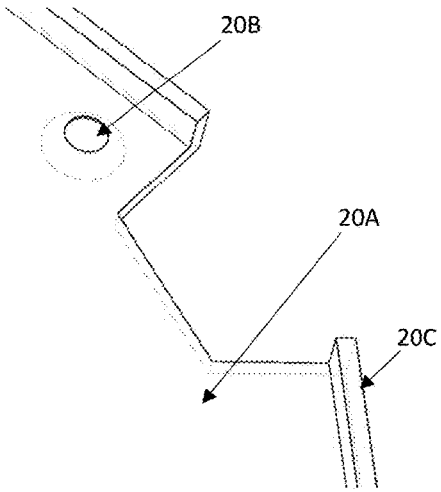
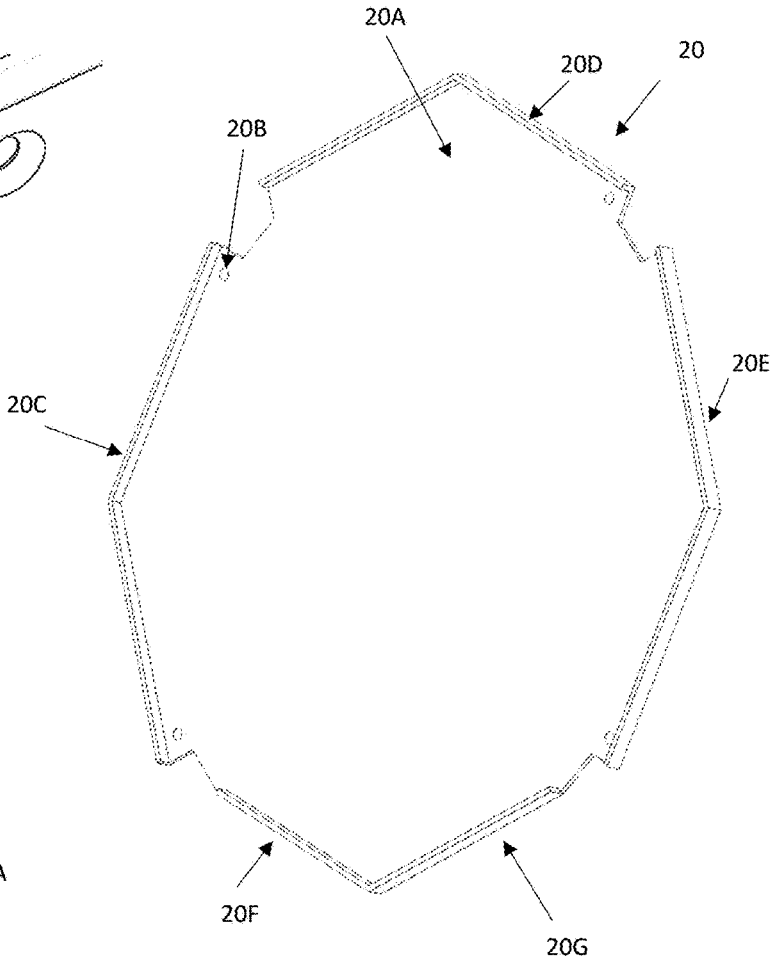
FIG 35C

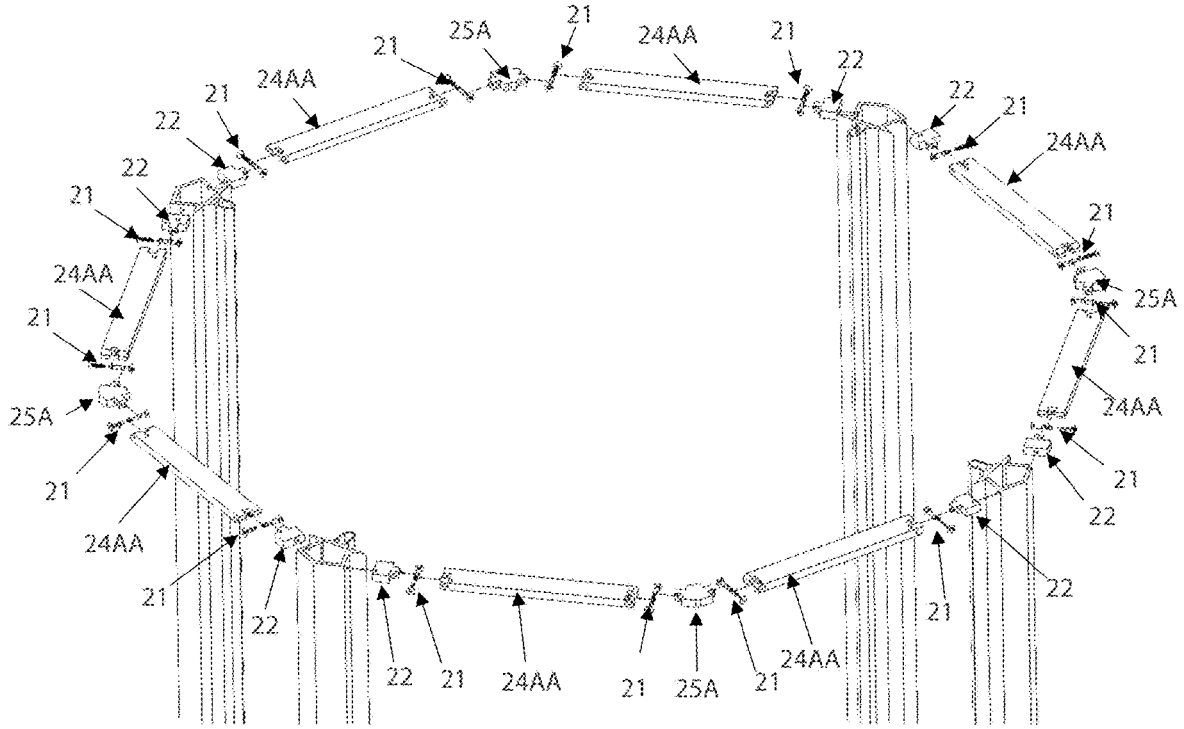
21
25A
21
24AA
21
22
22
21
24AA
21
25A
21
24AA
21
22
21
24AA
22
21
24AA
21
25A
21
24AA
21
22
22
21
24AA
21
25A
21
24AA
21
22
22
21
24AA
21
22
21
24AA
21
22
21
24AA
21
22
21
24AA
21
25A
21
24AA
21
22
21
24AA
21
22
21
24AA
21
22
21
24AA
21
25A
21
24AA
21
22
21
24AA
21
22
21
24AA
21
22
21
24AA
21
25A
21
24AA
21
22
21
24AA
21
22
21
24AA
21
22

OPEN POSITION

HALF OPEN POSITION

CLOSED POSITION

FOLDABLE ELEVATOR STRUCTURES FOR CABIN AND SHAFT

FIELD OF THE INVENTION

The present invention relates to elevators; more particularly, the present invention relates to devices that form a cabin or shaft from a foldable structure for pneumatic, magnetic, counter-balancing weight and other types of elevators.

BACKGROUND OF THE INVENTION

Elevators typically use countervailing weights in order to facilitate a passenger cabin moving up and down an elevator shaft in large office buildings, hospitals, factories and similar structures. These types of elevators require a great deal of space, maintenance, equipment and machinery. More recently, a new type of elevator has been developed known as a vacuum elevator system. This elevator uses air pressure to cause the motion of the cabin within a thoroughfare or tubular cylinder that uses the air within it as a working fluid upon the confines of the cabin. Brakes, motors, valves, electronic controls and other equipment work in concert to ensure a safe and pleasant riding experience for each occupant therein.

However, during setup even the vacuum elevator system requires personnel to expend a great deal of time, effort and know how on site in the construction of the basic structures of an elevator system. Other types of elevator systems such as the ubiquitous counter-weight system requires even more time to setup the basic structures required before machinery, electronics, cabling and other types of components can be installed. All of this slows down the time until a user can get utility from his or her elevator. Additionally, it increases cost as personnel are deployed for construction and any and all tools, parts, machinery, power supplies and so forth must be deployed concurrently with the initial procedures.

Accordingly, there needs to be some solutions to overcome the aforementioned problems.

SUMMARY OF THE INVENTION

The present invention overcomes the deficiencies of the known art and the problems that remain unsolved by providing Foldable Elevator Structures as described herein and in the accompanying drawings.

A foldable elevator cabin structure comprising:

a first vertical cabin elevator member movably attached to a second vertical cabin elevator member and a third vertical cabin elevator member movably attached to the first and second vertical cabin elevator members through the use of a first pivot and a second pivot; such that:

a first movable assembly of arms is movably connected together such that a first end of each arm of the first movable assembly of arms is movably connected together through the first pivot; wherein a second end of a first arm of the first movable assembly of arms is movably attached to a top portion of the first vertical cabin elevator member;

a second end of a second arm of the first movable assembly of arms is movably attached to a top portion of the second vertical cabin elevator member;

a second end of a third arm of the first movable assembly of arms is movably attached to a top portion of the third vertical cabin elevator member;

a second movable assembly of arms is movably connected together such that a first end of each arm of the second movable assembly of arms is movably connected together through the second pivot; wherein a second end of a fourth arm of the second movable assembly of arms is movably attached to a bottom portion of the first vertical cabin elevator member;

a second end of a fifth arm of the second movable assembly of arms is movably attached to a bottom portion of the second vertical cabin elevator member;

a second end of a sixth arm of the second movable assembly of arms is movably attached to a bottom portion of the third vertical cabin elevator member;

wherein the first vertical cabin elevator member is thereby foldable with respect to the second and the third vertical cabin elevator members and the second and third vertical cabin elevator members are foldable with respect to each other;

an elevator ceiling attached to the first, second and third vertical cabin elevator members through: a first support attached to a first top portion of the first vertical cabin elevator member and to the ceiling top, a second support attached to a second top portion of the second vertical cabin elevator member and to the ceiling top, and a third support attached to a third top portion of the third vertical cabin elevator member and to the ceiling top;

wherein the ceiling has a first, second and third cutouts therein matching a general shape of upper parts of longitudinal sides of the first vertical cabin elevator member, the second vertical cabin elevator member and the third vertical cabin elevator member respectively, so as to position the cutouts for close physical attachment to the respective upper parts of longitudinal sides of the vertical cabin elevator member; and wherein the first and second cutouts are identical, and the corresponding upper parts of the longitudinal sides of the first and second vertical cabin elevator members are identical; but the third cutout is different than the first and second cutouts and the third cutout's corresponding upper part of the third vertical elevator cabin member longitudinal side is different than the first and second longitudinal side upper parts;

a base attached to the first, second and third vertical cabin elevator members wherein the base has three base cutouts therein matching a general shape of lower parts of longitudinal sides of the first vertical cabin elevator member, the second vertical cabin elevator member and the third vertical cabin elevator member respectively, so as to position the cutouts for close physical attachment to the respective lower parts of longitudinal sides of the vertical cabin elevator member;

wherein the base is attached to the first, second and third vertical cabin elevator members through: a fourth support attached to a first bottom portion of the first vertical cabin elevator member and also attached to the bottom of the base; a fifth support attached to a second bottom portion of the second vertical cabin elevator member and also attached to the bottom of the base; and a sixth support attached to a third bottom portion of the third vertical cabin elevator member and also attached to the bottom of the base;

wherein the first and second vertical cabin elevator members are identical members having a plurality of surfaces connected with edges, and the third vertical cabin elevator member has a different longitudinal shape being connected together with a different plurality of surfaces connected with edges.

In another aspect, further comprising:

a seventh arm being an addition to the first movable assembly of arms being movably attached at a first end thereof to the first pivot and its second end movably attached to a top portion of a fourth vertical cabin elevator member;

an eighth arm being an addition to the second movably assembly of arms being movably attached at a first end thereof to the second pivot and its second end movably attached to a bottom portion of the fourth vertical cabin elevator member; and thereby permitting the folding of the fourth vertical cabin elevator member with respect to the first, second and third vertical cabin elevator members.

In another aspect, further comprising:

wherein the fourth vertical cabin elevator member is identical in its longitudinal profile to that of the first and second vertical cabin elevator members.

In another aspect, further comprising:

wherein the third vertical cabin elevator member has an elevator equipment or cabling passageway down its longitudinal length.

In another aspect, further comprising:

wherein the third vertical cabin elevator member has an elevator equipment or cabling passageway down its longitudinal length and has an opening along one of its longitudinal surfaces for elevator equipment or cabling.

In another aspect, further comprising:

wherein the third vertical cabin elevator member has an opening along one of its longitudinal surfaces for elevator equipment or cabling.

In another aspect, further comprising:

wherein the first and the second pivots are cross or plus shaped pivots.

In another aspect, further comprising wherein each one of the arms of the first movable assembly of arms is attached to solely one joint of four top joints which the four top joints are each attached to solely one vertical cabin elevator member top portion at an inwardly directed surface of the one vertical cabin elevator member matching a flat back surface of the corresponding joint; and wherein each one of the arms of the second movable assembly of arms is attached to solely one joint of four bottom joints which the four bottom joints are each attached to solely one vertical cabin elevator member bottom portion at an inwardly directed surface of the one vertical cabin elevator member matching a flat back surface of the corresponding joint.

In another aspect, further comprising:

wherein the third vertical cabin elevator member having a different longitudinal shape further comprises:

a flat portion proceeding until integration at an edge with a small portion which has another common edge with a portion that itself ends at a weld to a back of another portion almost at the midpoint thereof; the front side of the another portion integrally forms an edge with a parallel portion that parallels the flat portion and ends at an edge with an intervening portion that itself integrates with a starting edge of the flat portion;

from the weld at the back of another portion there is an integral small portion that integrates along another weld with a left angled portion which itself further integrates along an edge with a flat small portion; this flat small portion integrates with another small portion that then integrates along an edge with a further portion that then integrates along another edge of the another portion.

A foldable cabin elevator structure comprising:

a first group of four arms attached together through a first pivot wherein each arm of the first group of four arms is attached using one of four joints to solely one of four vertical elevator cabin members at a top part thereof;

a first set of four top supports attached each to solely one of the vertical elevator cabin members at the top part thereof and also attached to a top portion of an elevator cabin ceiling;

a second group of four arms attached together through a second pivot wherein each arm of the second group of four arms is attached using one of four other joints to solely one of the four vertical elevator cabin members at a bottom part thereof;

a second set of four bottom supports attached each to solely one of the vertical elevator cabin members at the bottom part thereof and also attached to a bottom portion of an elevator cabin base;

wherein the first group of arms and first pivot are disposed above the elevator cabin ceiling and wherein the second group of arms and second pivot are disposed underneath the elevator cabin base;

wherein the four vertical cabin elevator members are constructed using various longitudinal surfaces such that three of the vertical elevator cabin members are constructed with identical longitudinal surfaces; and the fourth vertical elevator cabin member is constructed using a unique set of longitudinal surfaces different than those of the three vertical elevator cabin members constructed with identical longitudinal surfaces;

a set of three cutouts in the elevator cabin ceiling such that the three vertical elevator cabin members having identical longitudinal surfaces are positioned each one in a single separate one of these three cutouts for close engagement with the elevator cabin ceiling; and a fourth cutout in the elevator cabin ceiling such that the fourth vertical elevator cabin member having the unique set of longitudinal surfaces is positioned in the fourth cutout for close engagement therewith.

In another aspect, further comprising:

an opening in the fourth vertical elevator cabin member on one if its longitudinal surfaces for passage therethrough of elevator equipment and or cabling.

In another aspect, further comprising:

wherein the elevator cabin ceiling comprises a plate attached to a perimeter attachment structure.

In another aspect, further comprising:

wherein the first pivot has four wings such that each wing has an attachment hole for attachment to solely one of the arms of the first group of four arms first ends dual raised protrusions, and such that there are small protrusions between each wing for positioning of the respective arms connection to the first pivot.

In another aspect, further comprising:

wherein the second pivot has four wings such that each wing has an attachment hole for attachment to solely one of the arms of the second group of four arms first ends dual raised protrusions, and such that there are small protrusions between each wing for positioning of the respective arms connection to the second pivot.

In another aspect, further comprising:

the first and second pivots are cross shaped pivots;

wherein the first cross shaped pivot has four wings such that each wing has an attachment hole for attachment to solely an arm of the first group of four arms first ends dual raised protrusions, and such that there are small protrusions between each wing for positioning of the respective arms connection to the first cross shaped pivot;

wherein the second cross shaped pivot has four wings such that each wing has an attachment hole for attachment to solely an arm of the second group of four arms first ends dual raised protrusions, and such that there are small protrusions between each wing for positioning of the respective arms connection to the second cross shaped pivot.

In another aspect, further comprising:

an opening in the fourth vertical elevator cabin member on one of its longitudinal surfaces for passage therethrough of elevator equipment and/or cabling.

In another aspect, further comprising:

an opening in the elevator cabin base for passage of elevator cabin equipment or cabling.

In another aspect, further comprising:

wherein the elevator cabin base has a cutout for passing elevator equipment or cabling therethrough.

In another aspect, further comprising:

a passageway for elevator equipment or cabling.

In another aspect, further comprising:

wherein the three vertical cabin elevator members having identical longitudinal surfaces each having an attachment surface connected through edges with other respective surfaces, wherein the attachment surface attaches a flat back surface of a single joint of the four joints so that it faces inwards towards to the first pivot; and the fourth vertical cabin elevator member has another attachment surface connected through edges with other respective surfaces of the fourth vertical cabin elevator member, wherein the another attachment surface attaches another flat back surface of a single joint of the four joints so that it faces inwards towards to the first pivot.

In another aspect, further comprising:

wherein a flat back surface of a single joint of the other four joints attaches to the respective attachment surface at another position on the attachment surface than the single joint of the four joints so that it faces inwards towards the second pivot; and another flat back surface of a single joint of the four other joints attaches to the another attachment surface at a location different than the single joint of the other four joints so that it faces inwards towards to the second pivot.

In another aspect, further comprising:

wherein the elevator cabin ceiling has an attachment structure attached to a ceiling plate such that the attachment structure has holes therein for attachment to one of the vertical cabin elevator members.

In another aspect, further comprising:

the attachment structure having the holes therein for attachment to all of the vertical cabin elevator members.

In another aspect, further comprising:

a first attachment hole in a first longitudinal surface of a selected one of the vertical cabin elevator members for matching a respective hole of the holes in the attachment structure such that the first longitudinal surface is bounded by two edges to two other surfaces and for attachment thereto.

In another aspect, further comprising:

a second attachment hole in a second longitudinal surface of the selected one of the vertical cabin elevator members for matching another hole in the attachment structure such that the second longitudinal surface is bounded by two edges to two other surfaces and for attachment thereto.

In another aspect, further comprising:

an opening in the first longitudinal surface at another point thereon for passage of elevator equipment or cabling.

In another aspect, further comprising:

an attachment structure integrally associated with the elevator cabin ceiling;

wherein the three vertical elevator cabin members having identical longitudinal surfaces each has two holes, a single hole at two distinct longitudinal surfaces of each of the three vertical elevator cabin members having identical longitudinal surfaces, so that these match corresponding holes in the attachment structure for attachment thereto; and the fourth vertical member having the unique set of different longitudinal surfaces has another two holes, a single hole for each of two different longitudinal surfaces thereof for attachment to the attachment structure using corresponding holes in the attachment structure for attachment thereto.

In another aspect, further comprising:

the first pivot is a cross shaped pivot so that the first group of four arms is attached together there through so that each one of the arms of the first group of arms is attached using one of four joints to solely one of four vertical elevator cabin members at a top part thereof.

In another aspect, further comprising:

the second pivot is a cross shaped pivot so that the second group of four arms is attached together there through so that each one of the arms of the second group of arms is attached using one of four other joints to solely one of four vertical elevator cabin members at a bottom part thereof.

A foldable elevator cabin structure comprising:

a first group of four arms attached together through a first cross shaped pivot wherein each one of the first group of four arms is attached to a single separate one of four vertical elevator cabin members at a top part thereof;

a first set of four top supports attached each to the single separate one of the vertical elevator cabin members at the top part thereof and also attached to a top portion of an elevator cabin ceiling;

a second group of four arms attached together through a second cross shaped pivot wherein each one of the second group of four arms is attached to the single separate one of the four vertical elevator cabin members at a bottom part thereof;

a second set of four bottom supports attached each to the single separate one of the vertical elevator cabin members at the bottom part thereof and also attached to a bottom portion of an elevator cabin base;

wherein the first group of arms and first cross shaped pivot are disposed above the elevator cabin ceiling and wherein the second group arms and second cross shaped pivot are disposed underneath the elevator cabin base;

wherein the four vertical cabin elevator members are constructed using various longitudinal surfaces such that three of the vertical elevator cabin members are constructed with identical longitudinal surfaces; and the fourth vertical elevator cabin member is constructed using a unique set of longitudinal surfaces different than those of the three vertical elevator cabin members constructed with identical longitudinal surfaces;

a set of three cutouts in the elevator cabin ceiling such that the three vertical elevator cabin members having identical longitudinal surfaces are positioned each one in a single separate one of these three cutouts for close engagement with the elevator cabin ceiling; and a fourth cutout in the elevator ceiling such that the fourth vertical elevator cabin member having a unique set of longitudinal surfaces is positioned in the fourth cutout for close engagement therewith;

an opening in the fourth vertical elevator cabin member on one if its longitudinal surfaces for passage therethrough of elevator equipment and/or cabling;

wherein the elevator cabin ceiling comprises a plate attached to a perimeter attachment structure;

wherein the first cross shaped pivot has four wings such that each wing has an attachment hole for attachment to a separate arm of the first group of four arms first ends dual raised protrusions, and such that there are small square shaped protrusions between each wing for positioning of the respective arms connection to the first cross shaped pivot; and wherein the second cross shaped pivot has four wings such that each wing has an attachment hole for attachment to a separate arm of the second group of four arms first ends dual raised protrusions, and such that there are small square shaped protrusions between each wing for positioning of the respective arms connection to the second cross shaped pivot.

In another aspect, wherein the attachment of each arm of the first group of four arms to the single separate one of four vertical elevator cabin members at a top part thereof further comprises: a set of four joints attached at a back surface thereof each to only a separate one of the vertical cabin elevator members through an integral protrusion of each joint being attached to a single separate arm of the first group of four arms at two raised protrusions at a second end thereof; whilst each single separate arm of the first group of arms has its first end attached to a single separate wing of the first cross shaped pivot.

In another aspect, wherein the attachment of each arm of the second group of four arms to the single separate one of four vertical elevator cabin members at a bottom part thereof further comprises: a set of four joints attached at a back surface thereof each to only a separate one of the vertical cabin elevator members through an integral protrusion of each joint being attached to a single separate arm of the second group of four arms at two raised protrusions at a second end thereof; whilst each single separate one of the second group of arms has its first end attached to a single separate wing of the second cross shaped pivot.

In another aspect, wherein the attachment of each arm of the second group of four arms to the single separate one of four vertical elevator cabin members at a bottom part thereof further comprises: a set of four joints attached at a back surface thereof each to only a separate one of the vertical cabin elevator members through an integral protrusion of each joint being attached to a single separate arm of the second group of four arms at two raised protrusions at a second end thereof; whilst each single separate one of the second group of arms has its first end attached to a single separate wing of the second cross shaped pivot.

In another aspect, wherein the attachment of each arm of the first group of four arms to the single separate one of four vertical elevator cabin members at a top part thereof further comprises: a set of four joints attached at a back surface thereof each to only a separate one of the vertical cabin elevator members through an integral protrusion of each joint being attached to a single separate arm of the first group of four arms at two raised protrusions at a second end thereof; whilst each single separate one of the first group of arms has its first end attached to a single separate wing of the first cross shaped pivot.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

8B presents a closeup isometric bottom view of a portion of the foldable elevator cabin structure in a first embodiment disclosed herein.

Figure 9A:
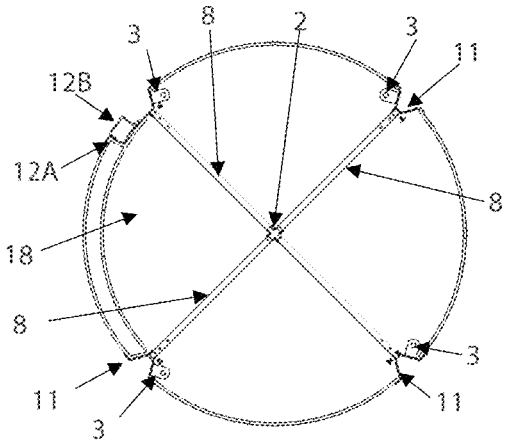
Figure 9B:
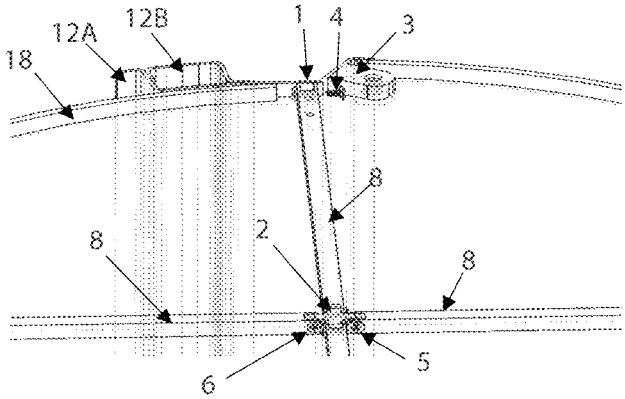

FIG. 9A presents a bottom view of a foldable elevator cabin structure in an second embodiment disclosed herein. FIG. 9B presents a closeup isometric bottom view of a portion of the foldable elevator cabin structure in a second embodiment disclosed herein.

Figure 10A:
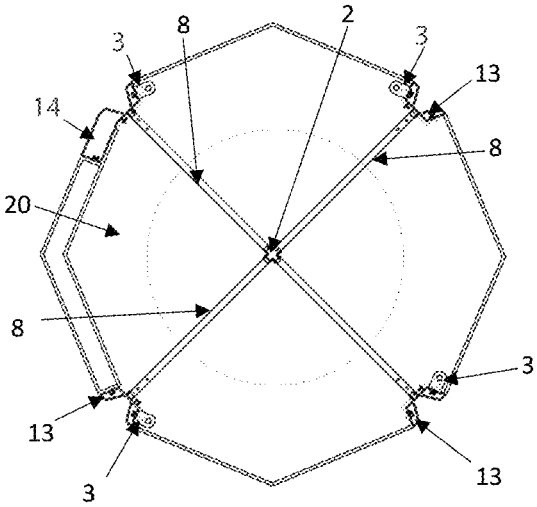
Figure 10B:
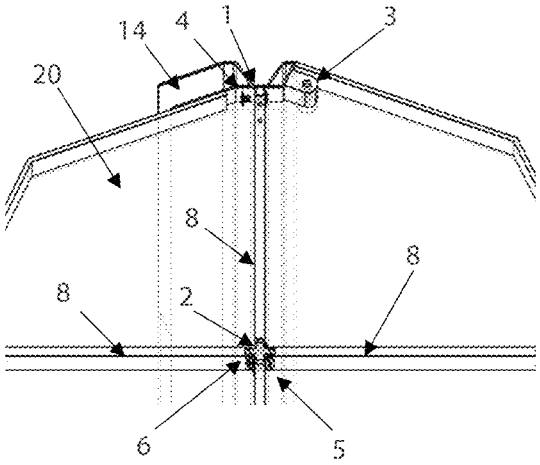

FIG. 10A presents a bottom view of a foldable elevator cabin structure in an third embodiment disclosed herein. FIG. 10B presents a closeup isometric bottom view of a portion of the foldable elevator cabin structure in a third embodiment disclosed herein.

Figure 11A:
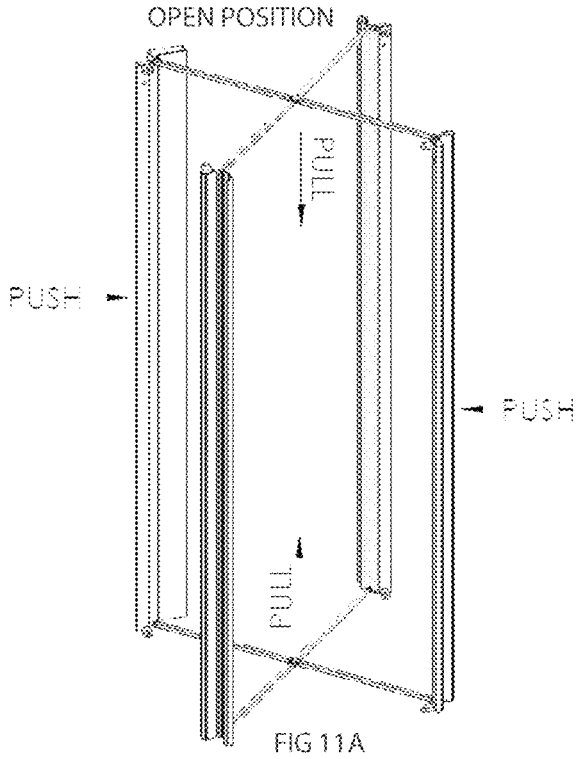
Figure 11B:
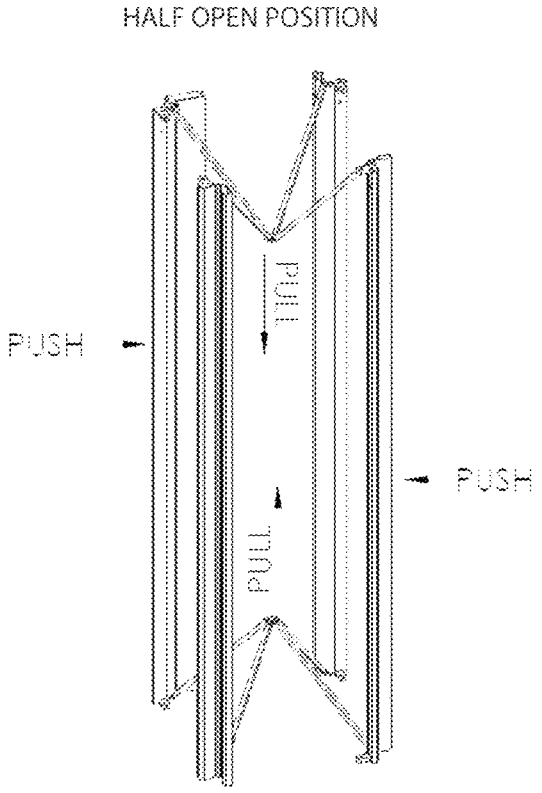
Figure 11C:
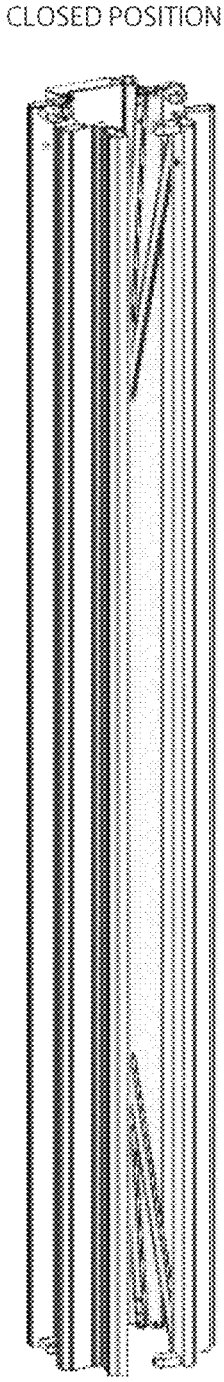

FIG. 11A presents an isometric view of an OPEN POSITION of a portion of a foldable elevator cabin structure. FIG. 11B presents an isometric view of a HALF OPEN POSITION of a portion of a foldable elevator cabin structure. FIG. 11C presents an isometric view of a CLOSED POSITION of a portion of a foldable elevator cabin structure.

Figure 12A:
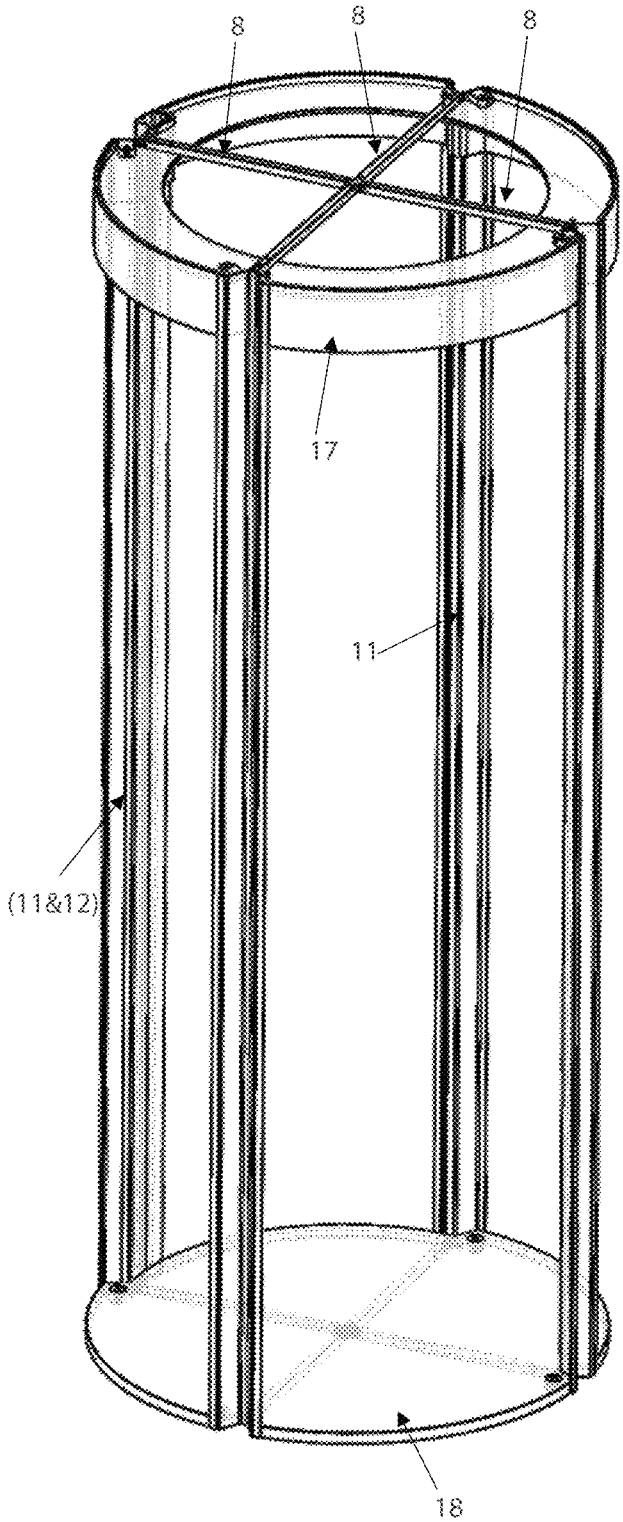
Figure 12B:
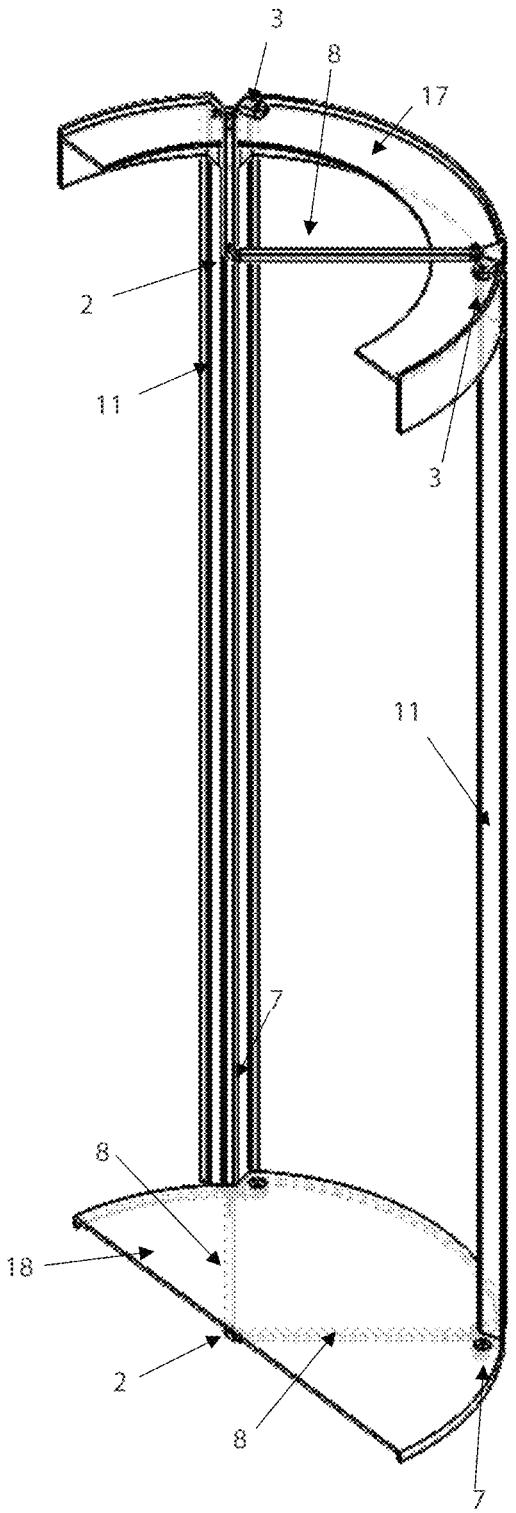

FIG. 12 A presents an assembled view of the second embodiment. FIG. 12B presents a section assembled view of the second embodiment disclosed herein.

Figure 13A:
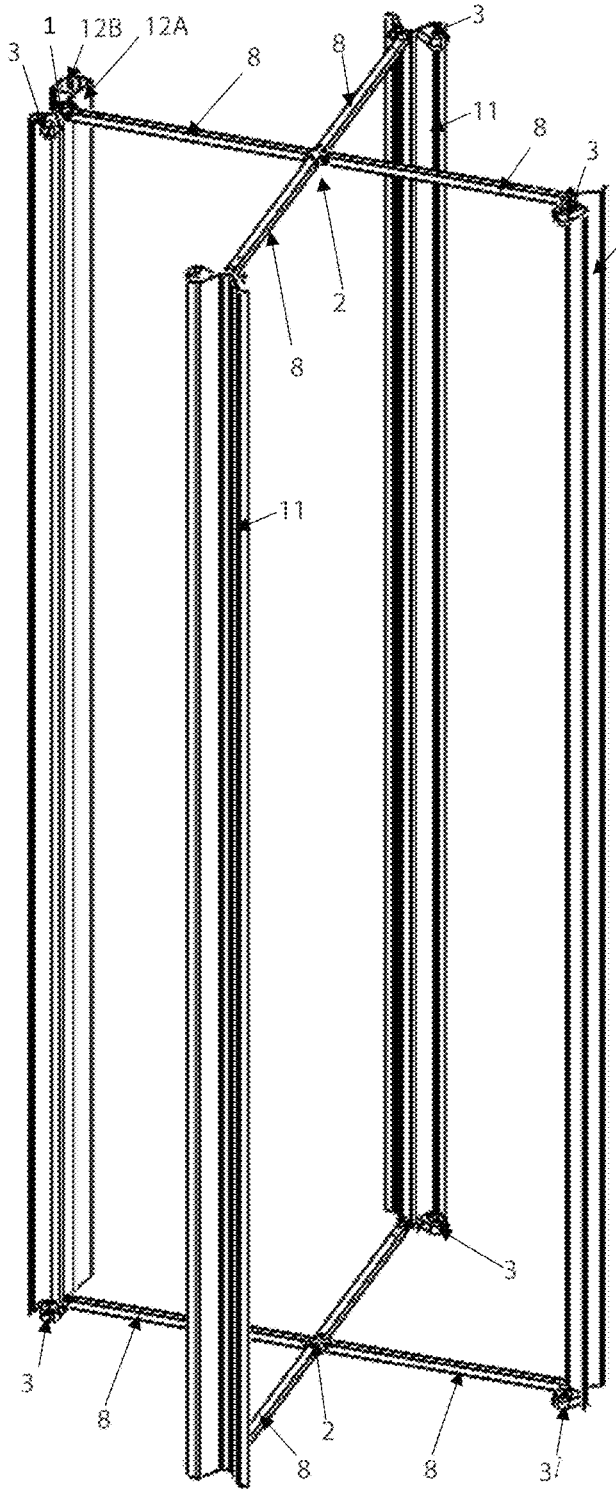
Figure 13B:
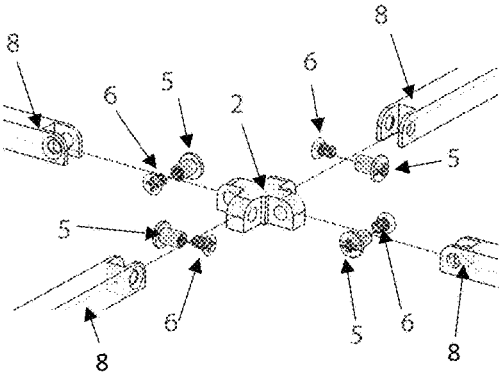
Figure 13C:
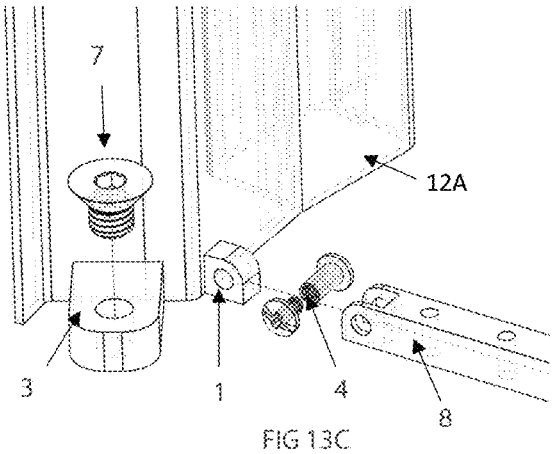

FIG. 13A presents an isometric view of a frame for the foldable cabin structure taught in an embodiment herein. FIG. 13B presents a closeup view of a central portion of a folding assembly for the foldable cabin structure taught in an embodiment herein. FIG. 13C presents a closeup view of the connection between a bottom portion of a column and an arm for the foldable cabin structure taught in an embodiment herein.

Figure 14A:
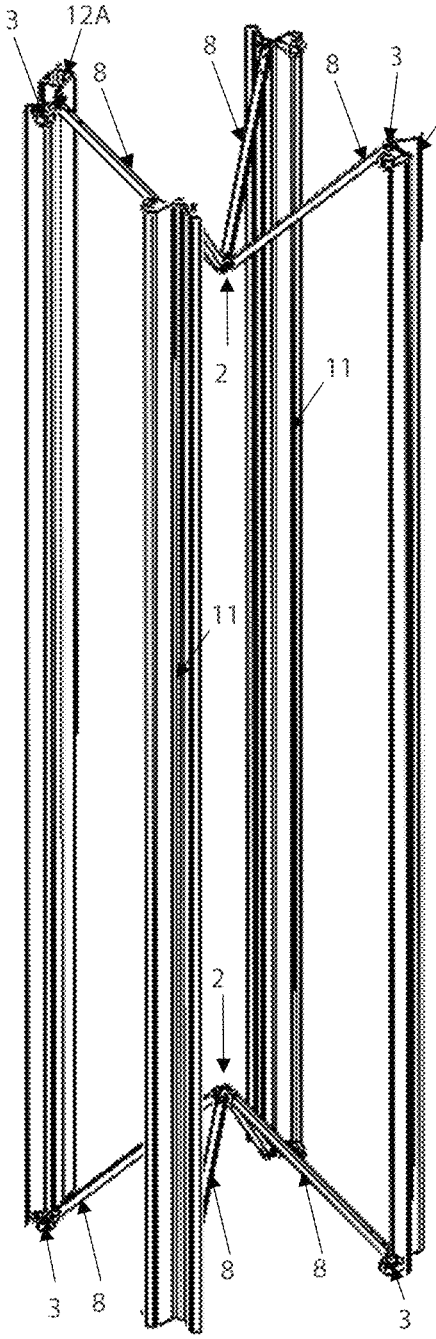
Figure 14B:
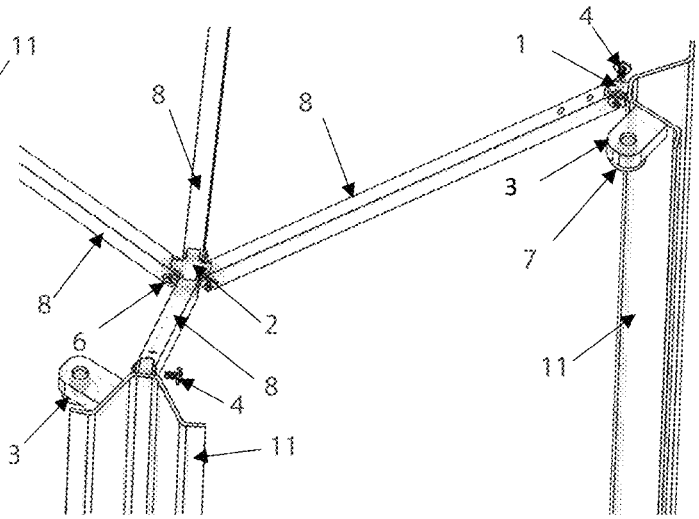
Figure 14C:
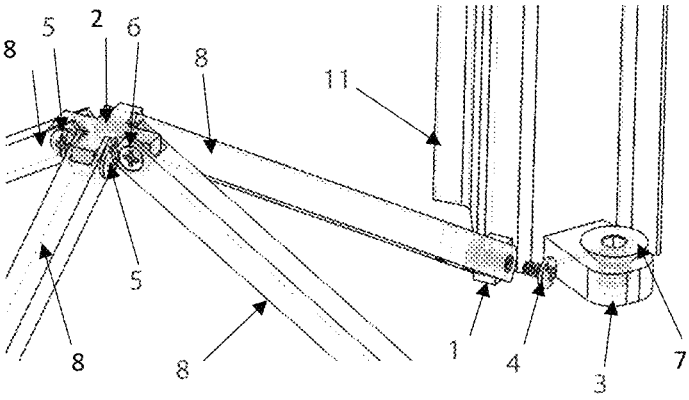

FIG. 14A presents a HALF OPEN POSITION of a frame structure in an embodiment disclosed herein. FIG. 14B presents a closeup view of the top central folding assembly as attached to two members in an embodiment disclosed herein. FIG. 14C presents a closeup view of the bottom central folding assembly as attached to a member in an embodiment disclosed herein.

Figure 15A:
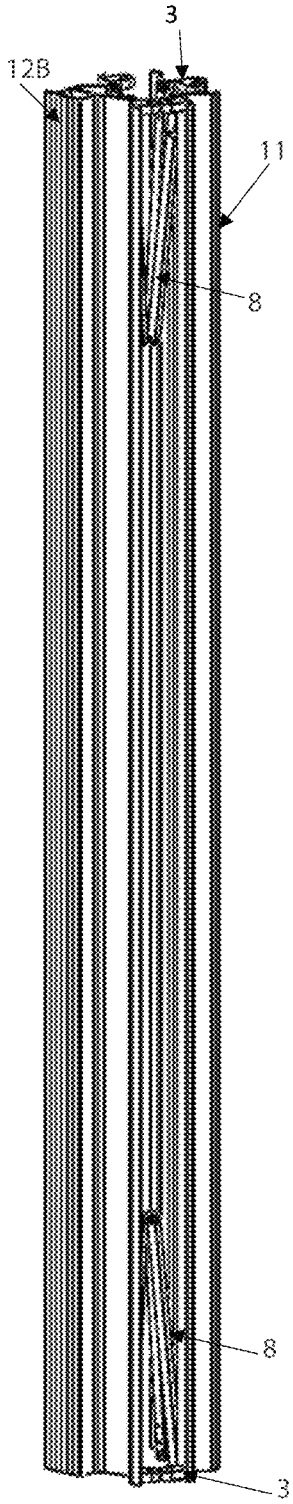
Figure 15B:
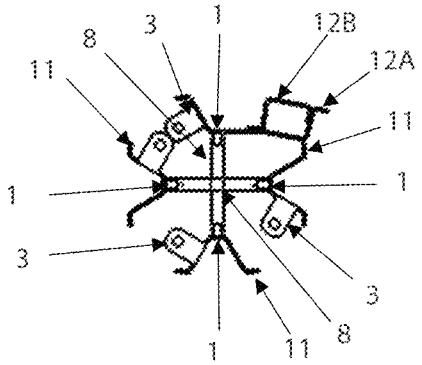
Figure 15C:
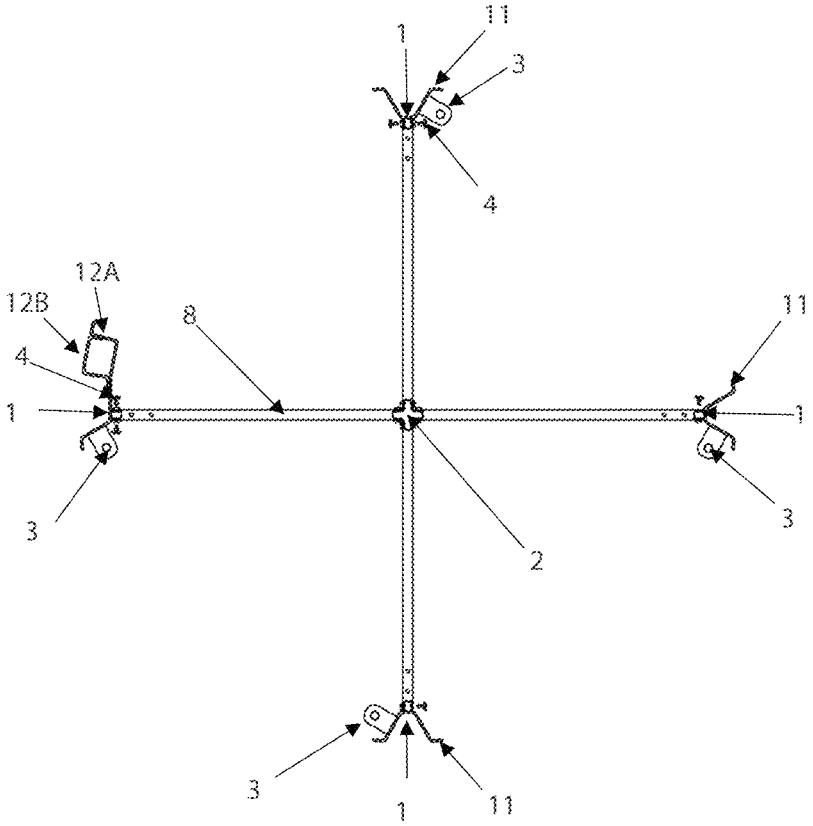

FIG. 15A presents a CLOSED POSITION of the foldable cabin structure in an embodiment disclosed herein. FIG. 15B presents a top view of a folding frame structure in a CLOSED POSITION in an embodiment disclosed herein. FIG. 15C presents an OPEN POSITION of the foldable cabin structure in an embodiment disclosed herein.

Figure 16:
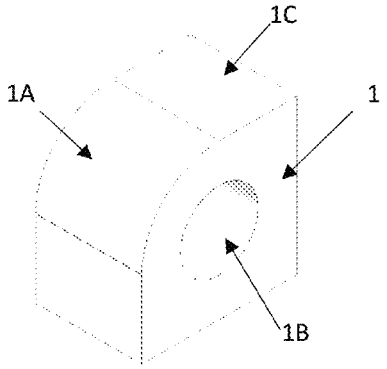
Figure 17:
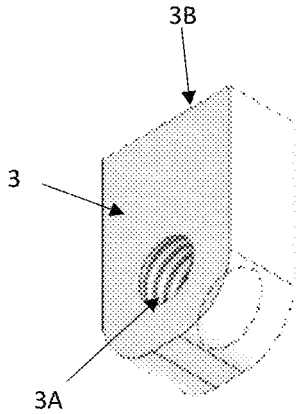
Figure 18:
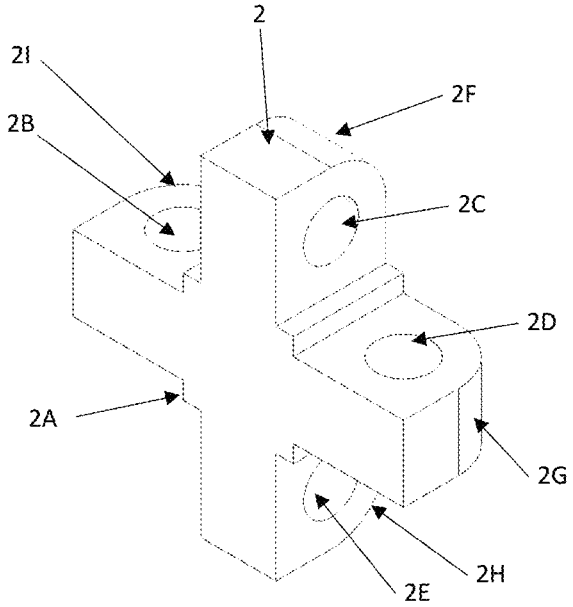
Figure 19:
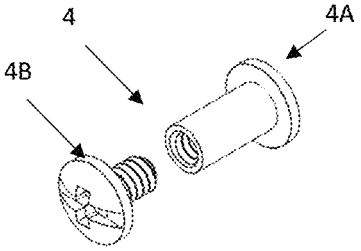
Figure 20:
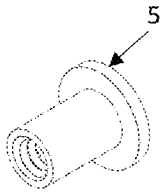
Figure 21:
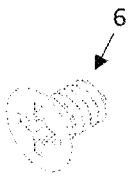
Figure 22:
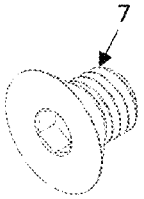

FIG. 16 presents a joint 1 in an embodiment disclosed herein. FIG. 17 presents a support 3 in an embodiment disclosed herein. FIG. 18 presents a pivot 2 in an embodiment disclosed herein. FIG. 19 presents a barrel and screw 4A-4B collectively 4 in an embodiment disclosed herein. FIG. 20 presents a barrel 5 in an embodiment disclosed herein. FIG. 21 presents a flat head screw 6 in an embodiment disclosed herein. FIG. 22 presents a flat head hex screw 7 in an embodiment disclosed herein.

Figure 23A:
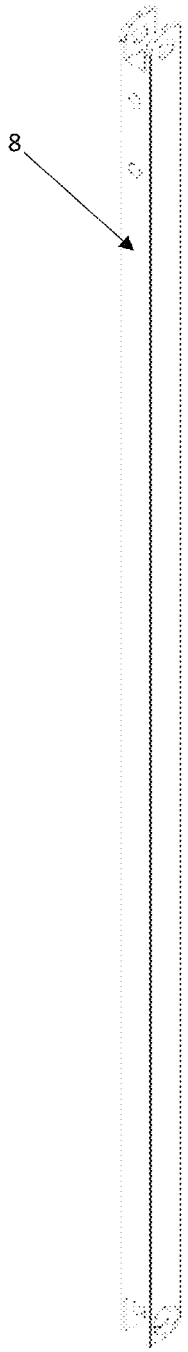
Figure 23B:
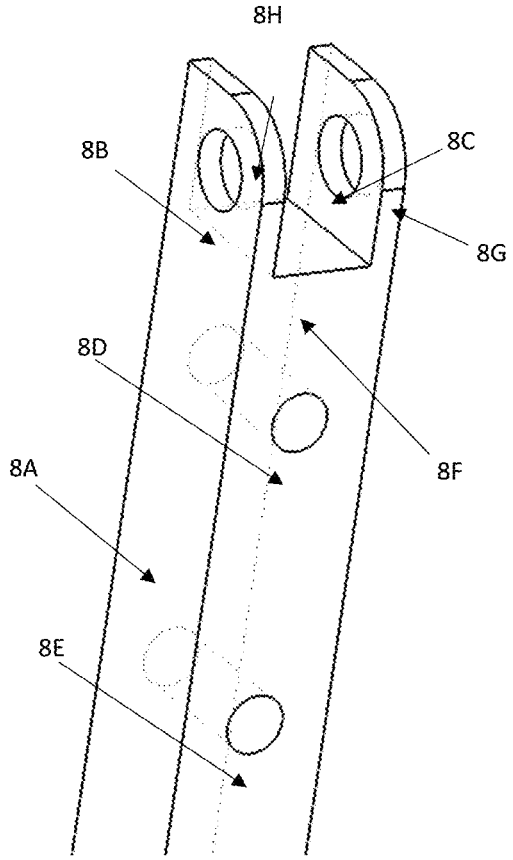
Figure 23C:
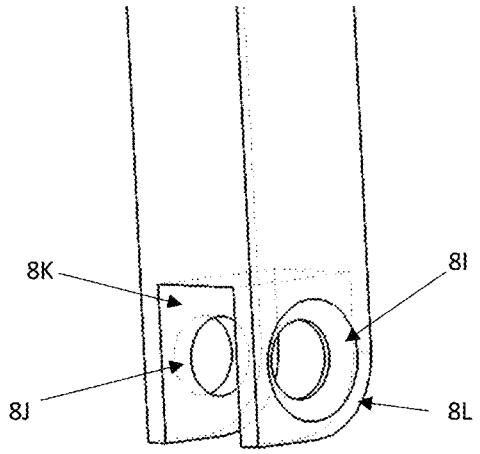

FIG. 23A presents an arm 8 in an embodiment disclosed herein. FIG. 23B presents a closeup view of the top portion of an arm 8 through a rotation. FIG. 23C presents the bottom portion of arm 8 in an embodiment disclosed herein.

Figure 24A:
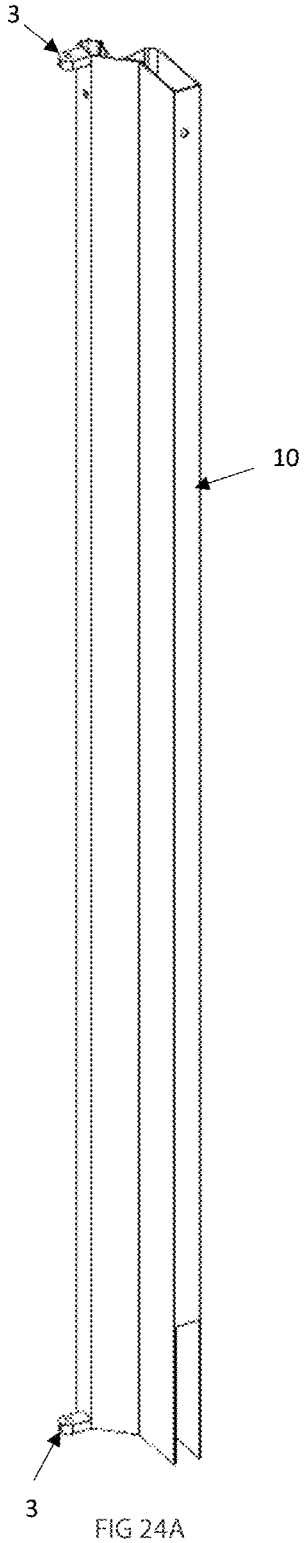
Figure 24B:
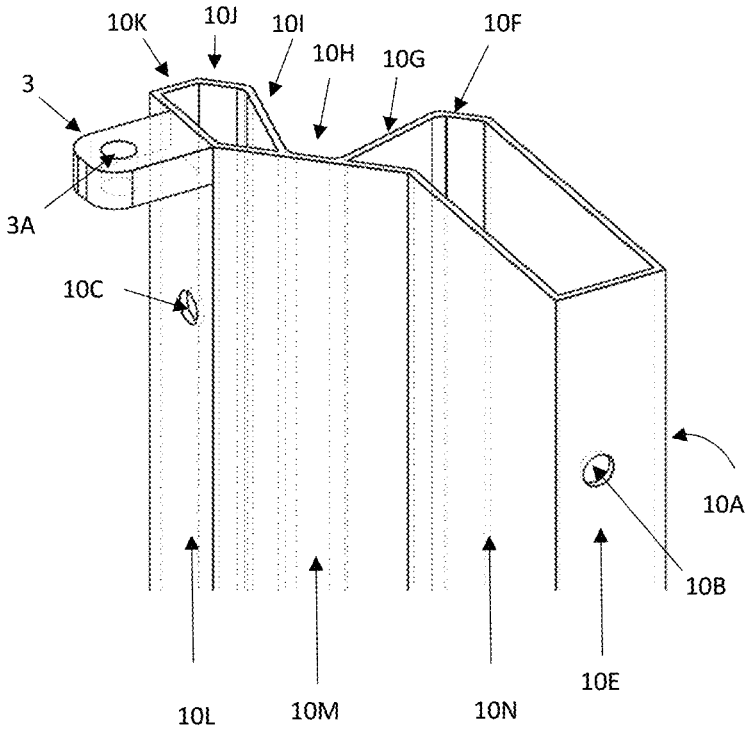
Figure 24C:
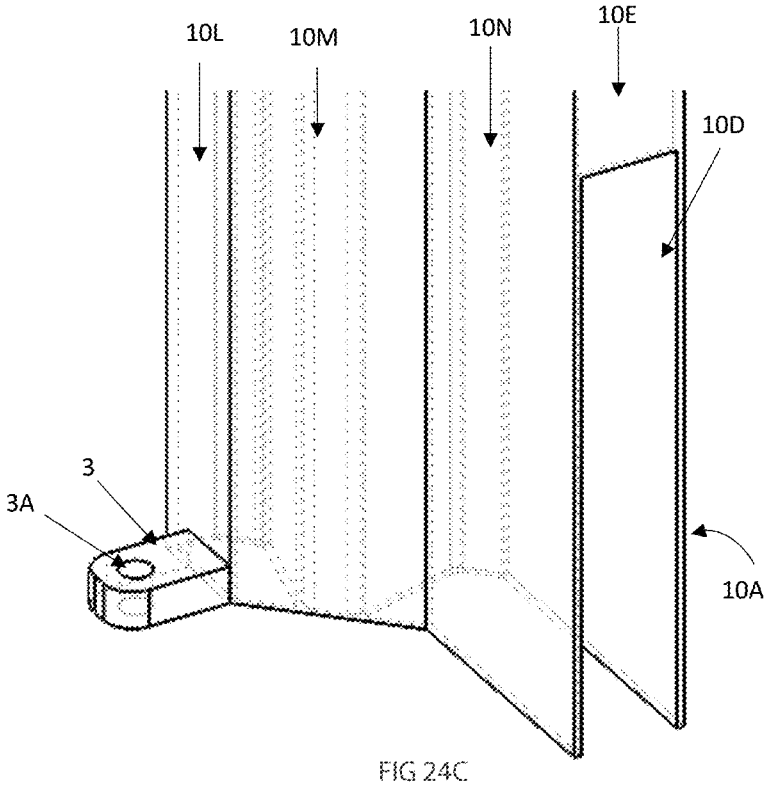

FIG. 24A presents the column 10 having a cabling passageway integrally associated therewith in an embodiment disclosed herein. FIG. 24B presents a closeup view of the top portion of the column 10 in an embodiment disclosed herein. FIG. 24C presents a closeup bottom view of the column 10 in an embodiment disclosed herein.

Figure 25A:
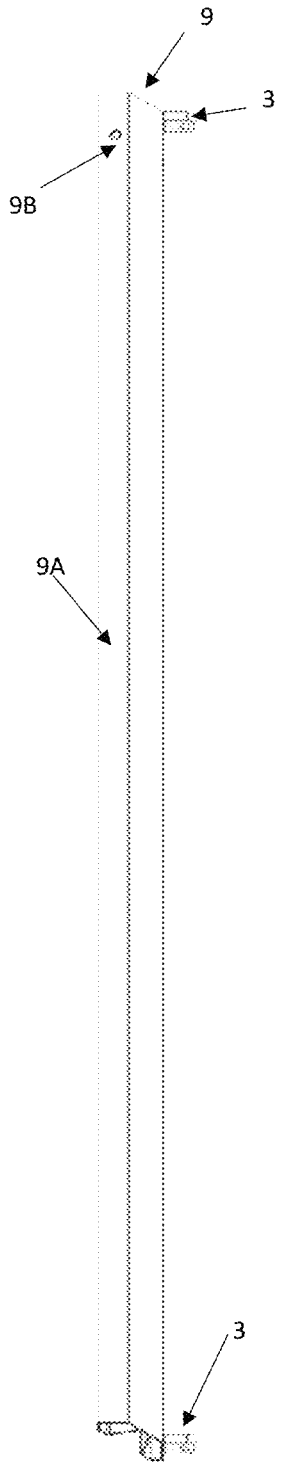
Figure 25B:
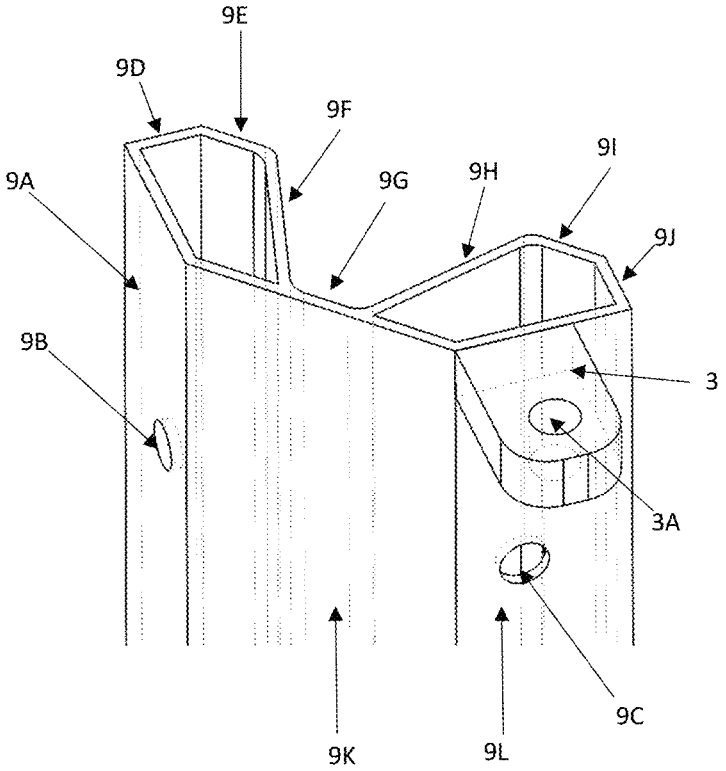
Figure 25C:
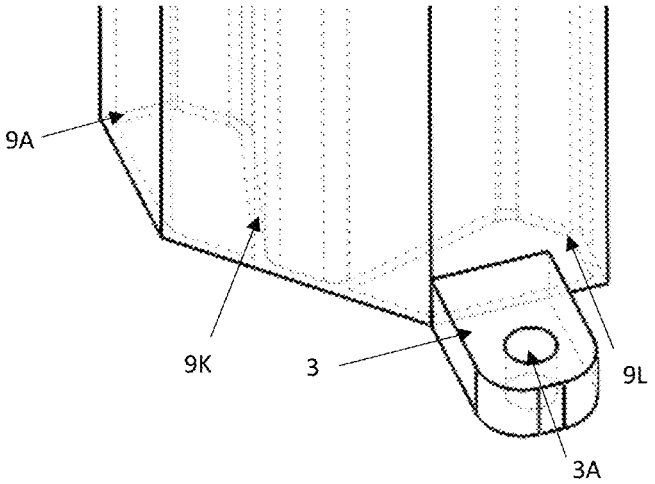

FIG. 25A presents a member 9 in an embodiment disclosed herein. FIG. 25B presents a closeup view of the top portion of the member 9 in an embodiment disclosed herein. FIG. 25C presents a closeup bottom view of the member 9 in an embodiment disclosed herein.

Figure 26A:
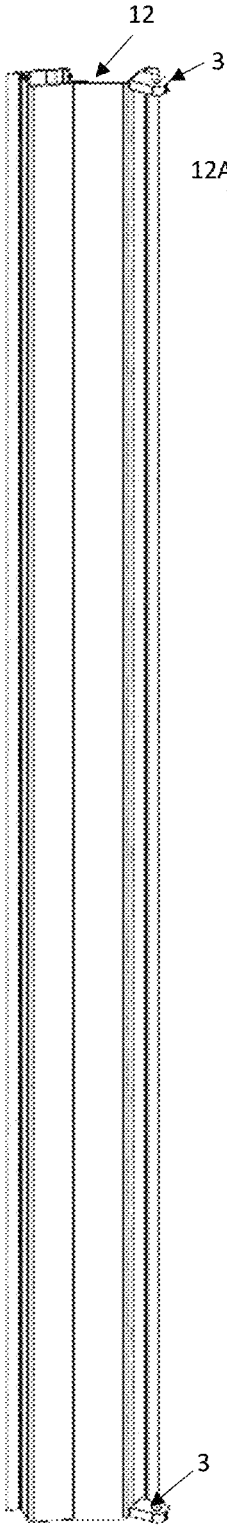
Figure 26B:
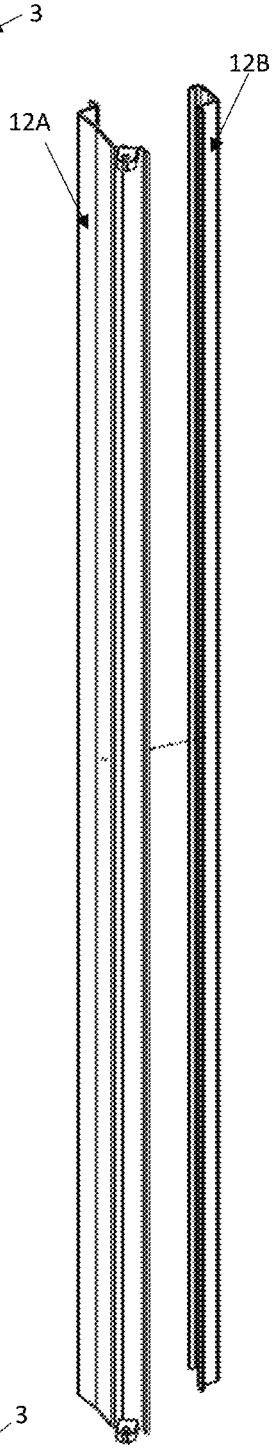
Figure 26C:
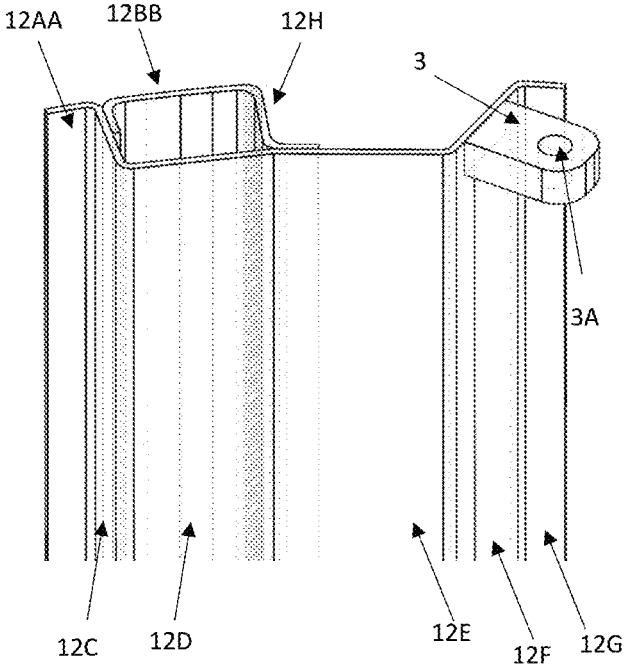
Figure 26D:
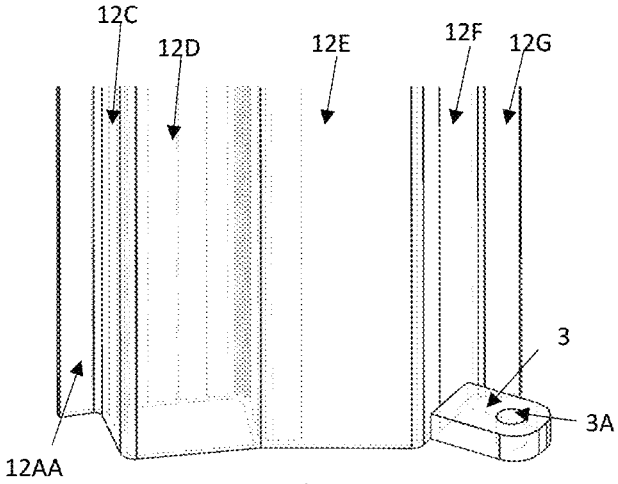

FIG. 26A presents the column 12 having a cabling passageway integrally associated therewith in an embodiment disclosed herein. FIG. 26B presents two longitudinal portions of column 12 in an embodiment disclosed herein. FIG. 26C presents a closeup top view of the column 12 in an embodiment disclosed herein. FIG. 26D presents a closeup bottom view of the column 12 in an embodiment disclosed herein.

Figure 27A:
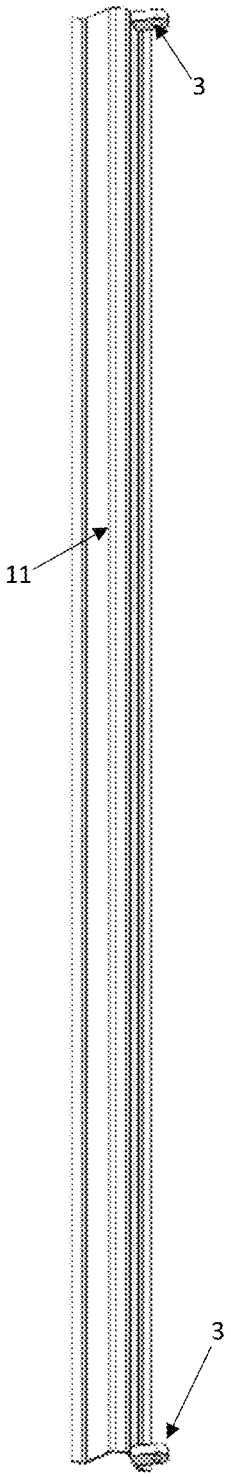
Figure 27B:
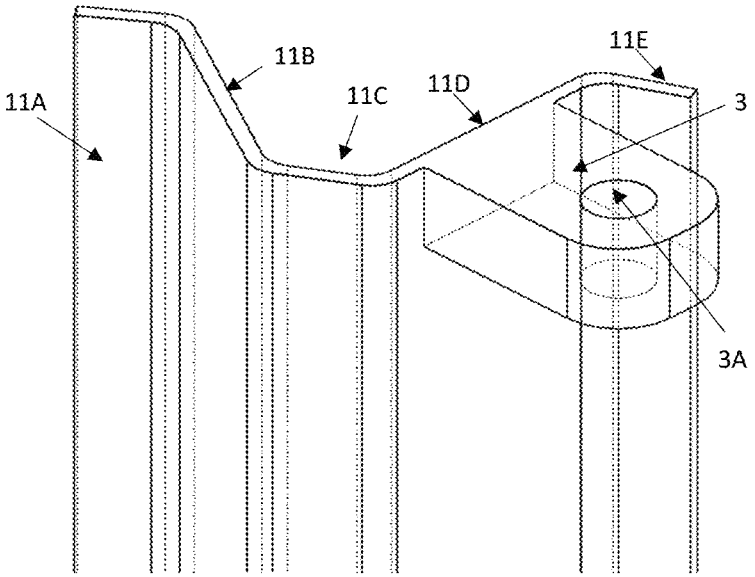
Figure 27C:
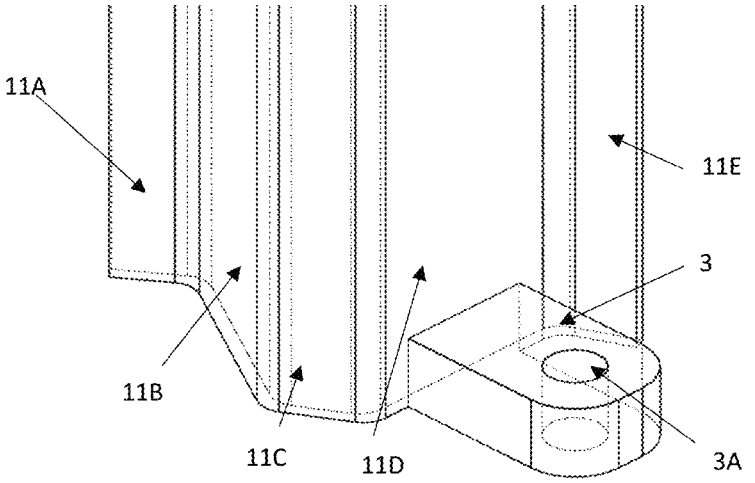

FIG. 27A presents a member 11 in an embodiment disclosed herein. FIG. 27B presents a closeup view of the top portion of the member 11 in an embodiment disclosed herein. FIG. 27C presents a closeup bottom view of the member 11 in an embodiment disclosed herein.

Figure 28A:
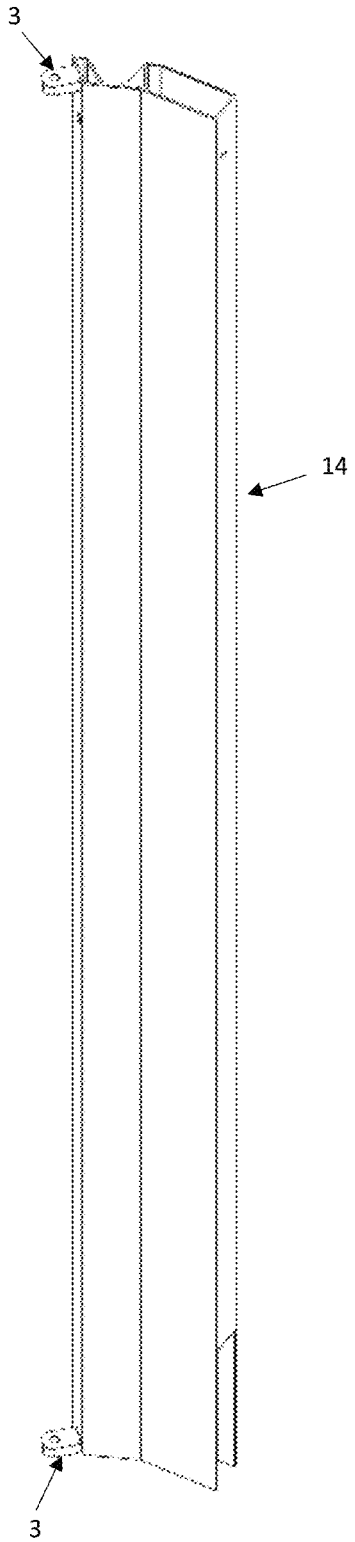

FIG. 28A presents the column 14 having a cabling passageway integrally associated therewith in an embodiment disclosed herein.

Figure 28B:
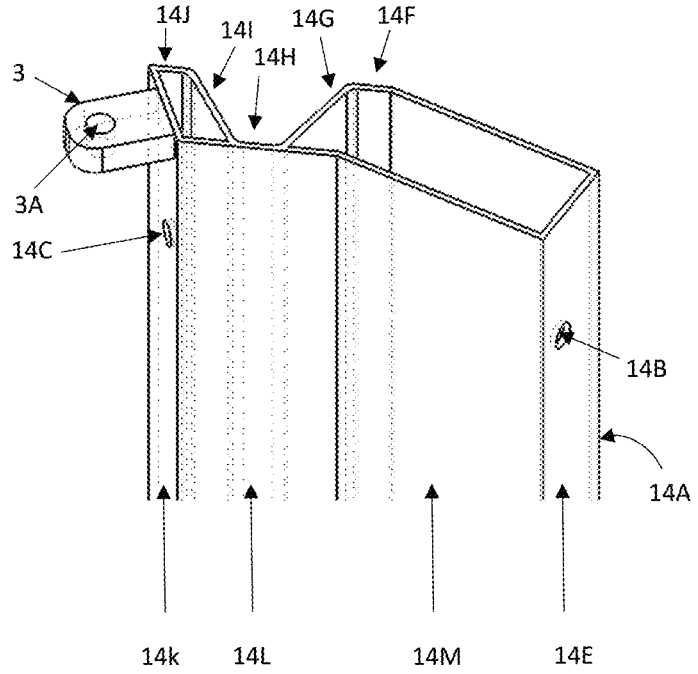

FIG. 28B presents a closeup view of the top portion of the column 14 in an embodiment disclosed herein.

Figure 28C:
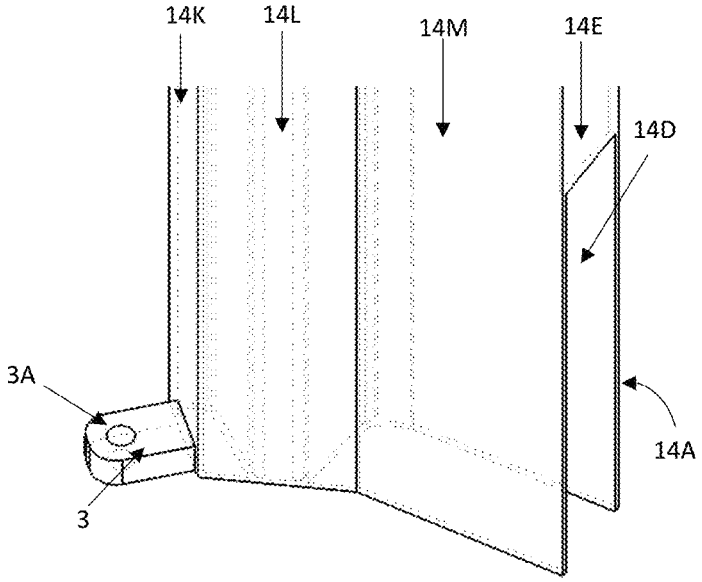

FIG. 28C presents a closeup bottom view of the column 14 in an embodiment disclosed herein.

Figure 29A:
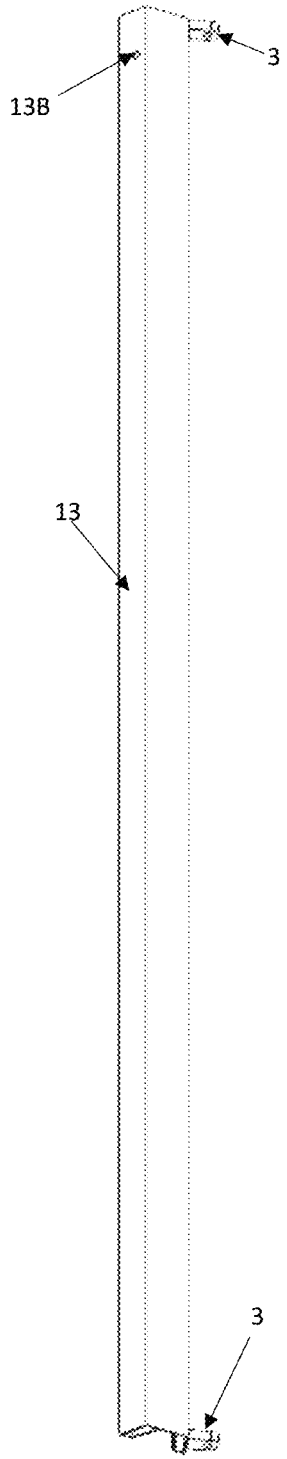
Figure 29B:
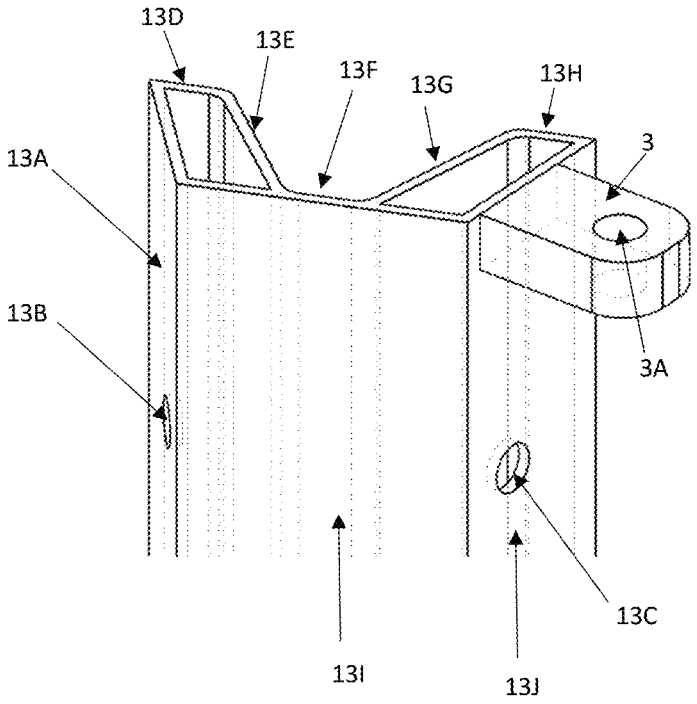
Figure 29C:
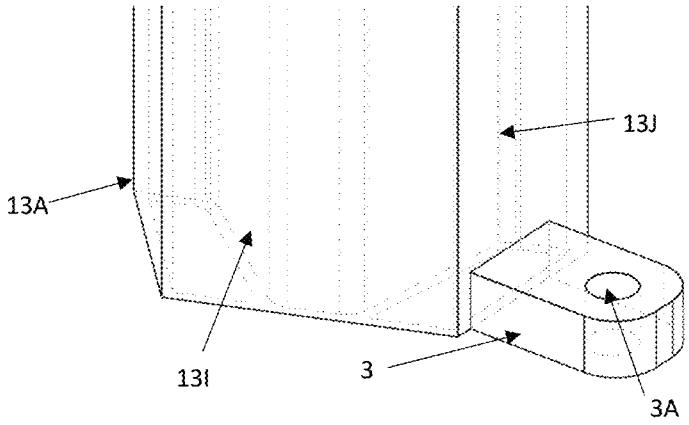

FIG. 29A presents a member 13 in an embodiment disclosed herein. FIG. 29B presents a closeup view of the top portion of the member 13 in an embodiment disclosed herein. FIG. 29C presents a closeup bottom view of the member 13 in an embodiment disclosed herein.

Figure 30A:
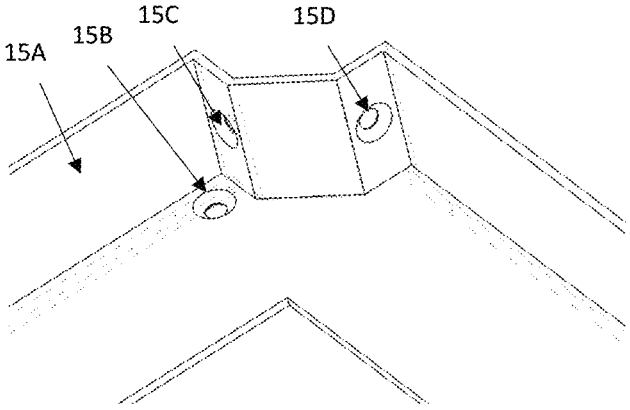
Figure 30B:
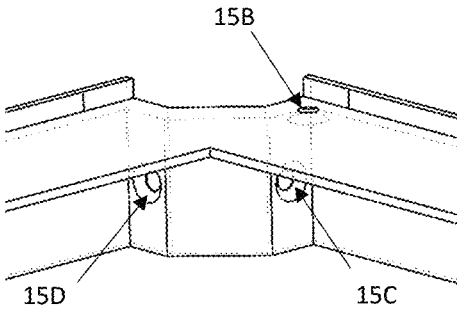
Figure 30C:
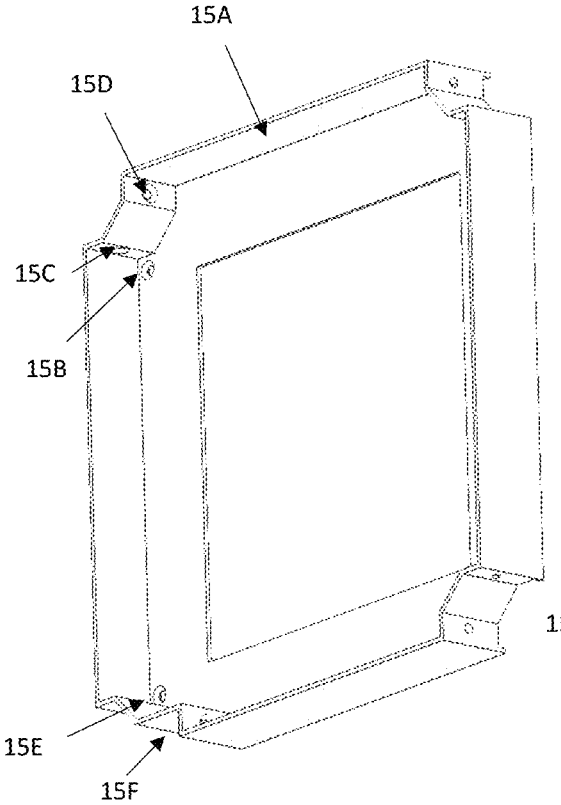
Figure 30D:
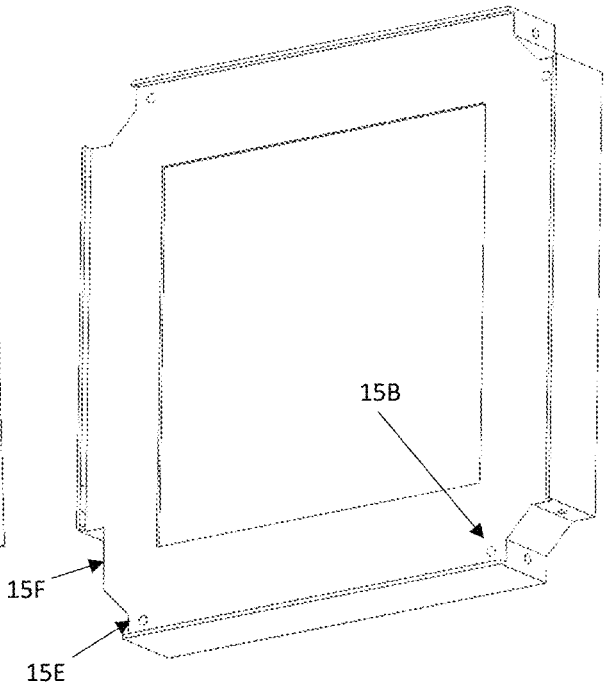

FIG. 30A presents a bottom closeup of a ceiling in an embodiment disclosed herein. FIG. 30B presents a top closeup of a ceiling in an embodiment disclosed herein. FIG. 30C presents a bottom of a ceiling in an embodiment disclosed herein. FIG. 30D presents a top of a ceiling in an embodiment disclosed herein.

Figure 31A:
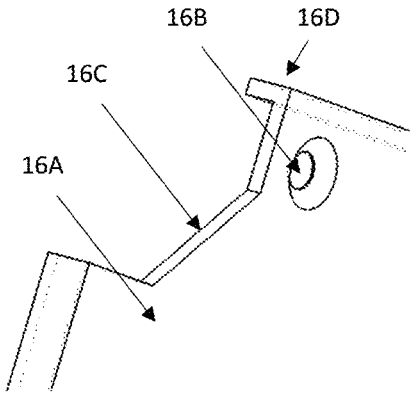
Figure 31C:
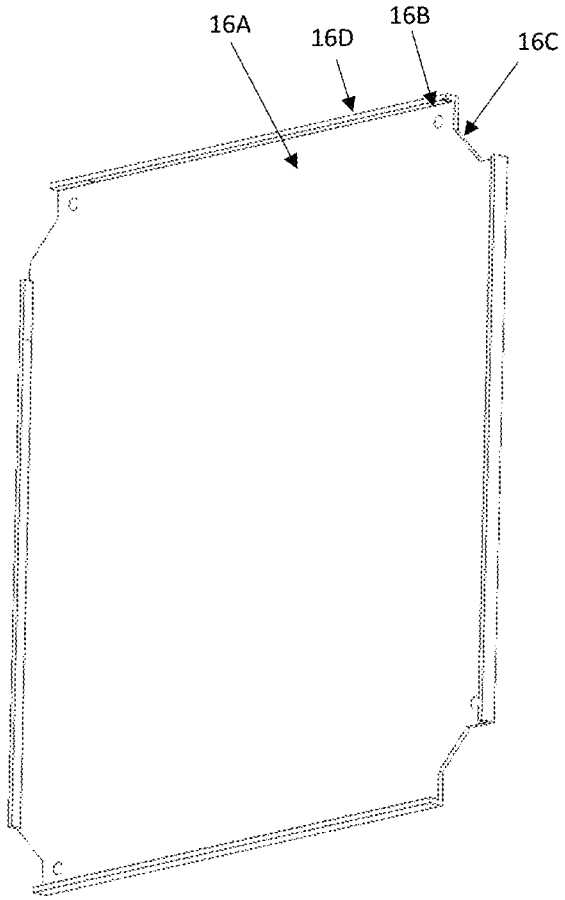
Figure 31B:
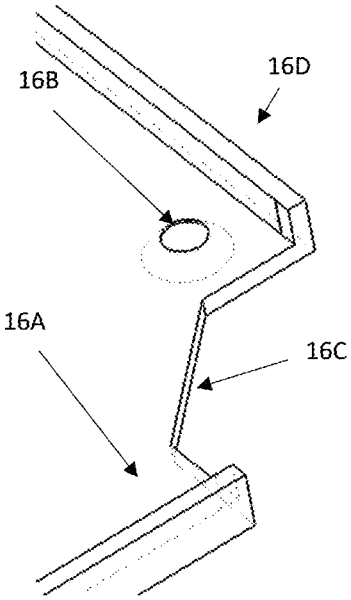

FIG. 31A presents a closeup view of a top portion of a base in an embodiment disclosed herein. FIG. 31B presents a closeup view of a bottom portion of a base in an embodiment disclosed herein. FIG. 31C presents an isometric view of a bottom portion of a base in an embodiment disclosed herein.

Figure 32A:
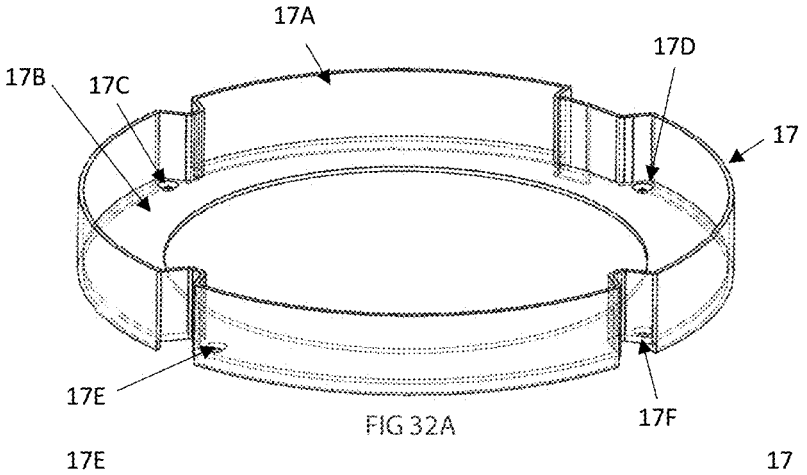
Figure 32B:
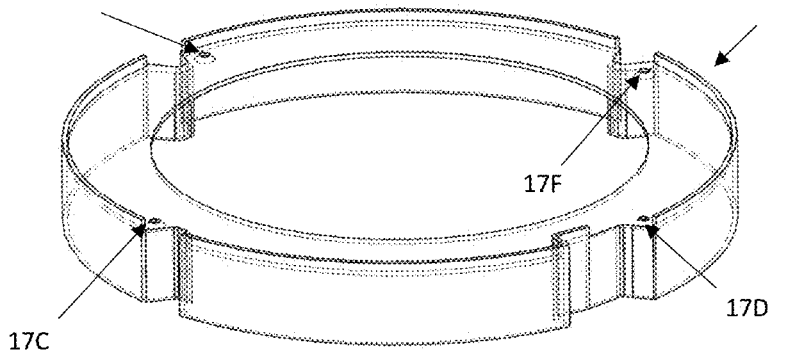
Figure 32C:
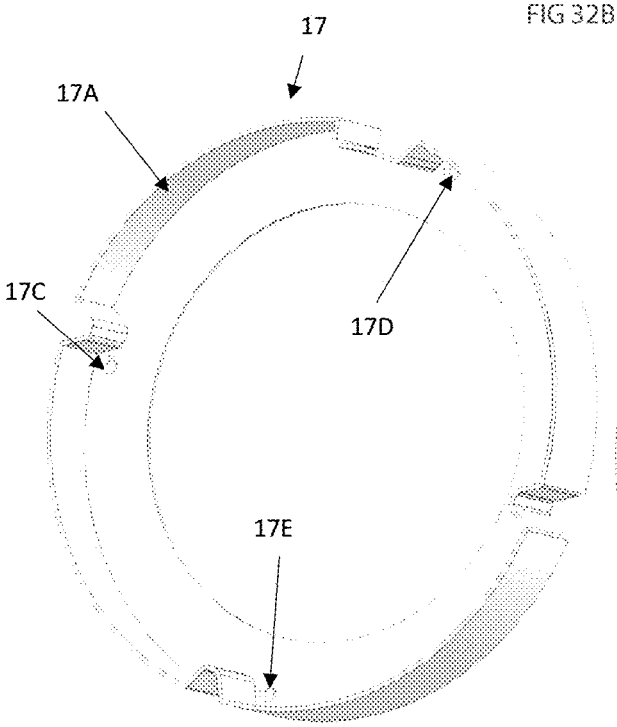
Figure 32D:
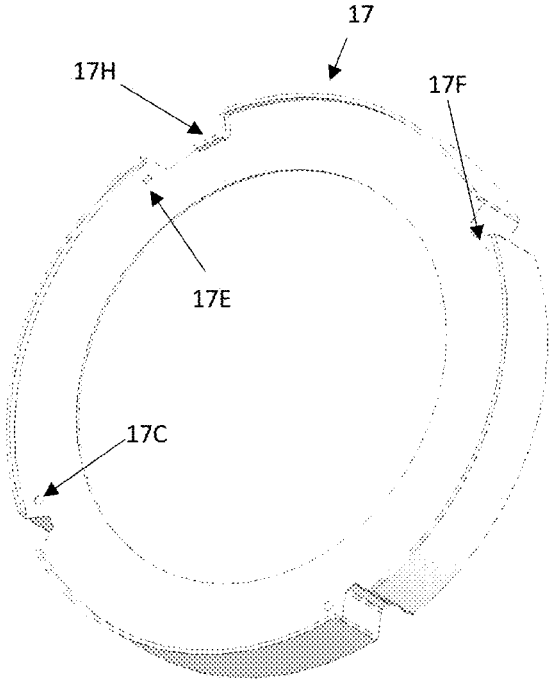

FIG. 32A presents a bottom closeup view of a ceiling in an embodiment disclosed herein. FIG. 32B presents a top closeup view of a ceiling in an embodiment disclosed herein. FIG. 32C presents a bottom isometric view of a ceiling in an embodiment disclosed herein. FIG. 32D presents a top isometric view of a ceiling in an embodiment disclosed herein.

Figure 33A:
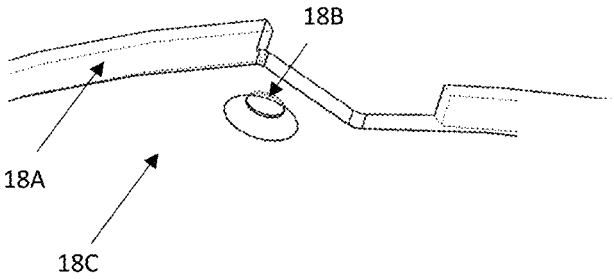
Figure 33C:
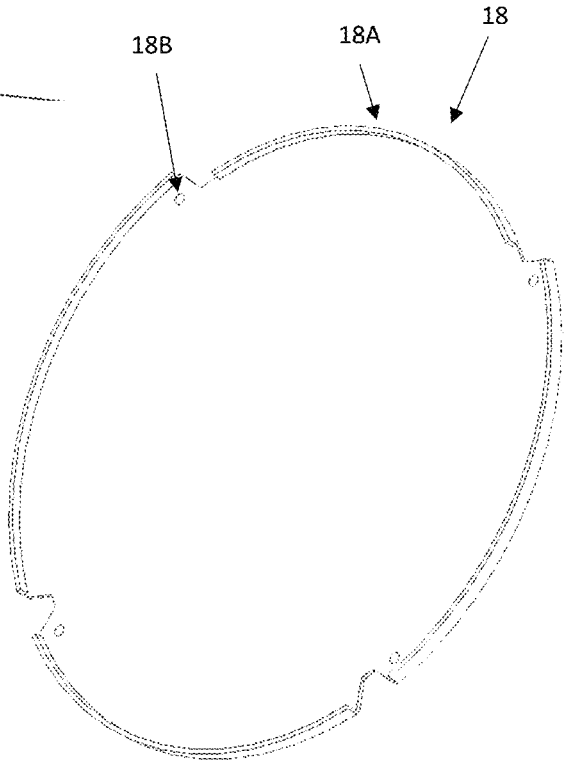
Figure 33B:
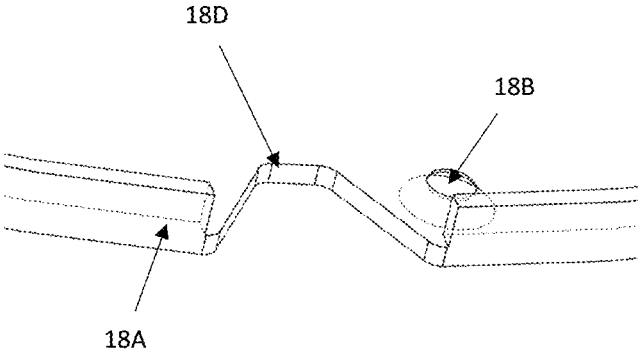

FIG. 33A presents a closeup view of a top portion of a base in an embodiment disclosed herein. FIG. 33B presents a closeup view of a bottom portion of a base in an embodiment disclosed herein. FIG. 33C presents an isometric view of a bottom portion of a base in an embodiment disclosed herein.

Figure 34A:
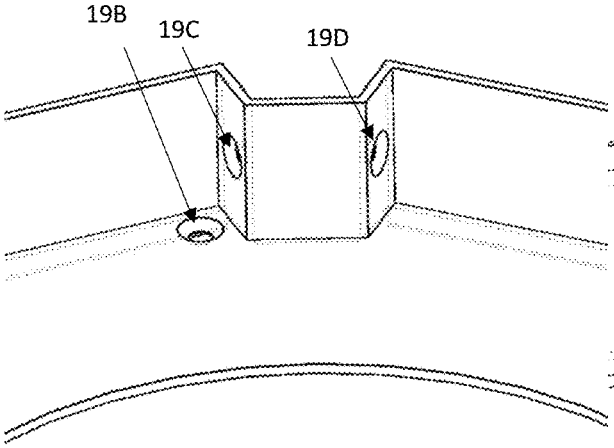
Figure 34B:
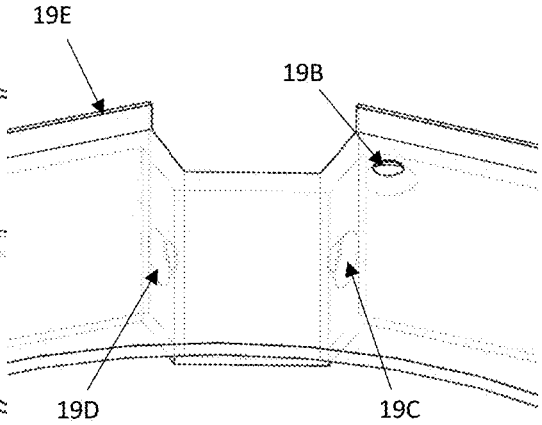
Figure 34C:
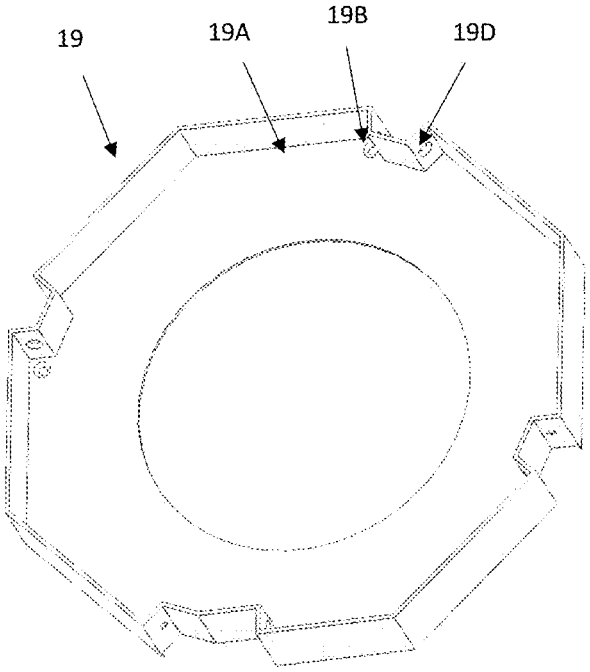
Figure 34D:
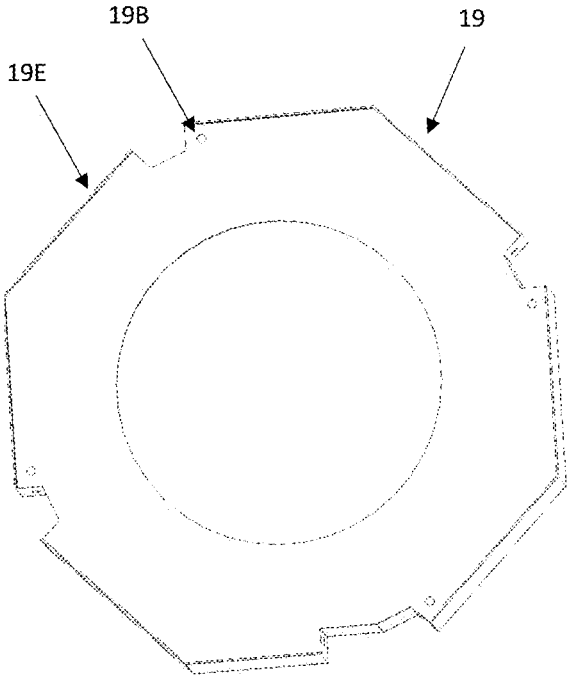

FIG. 34A presents a bottom closeup view of a ceiling in an embodiment disclosed herein. FIG. 34B presents a top closeup view of a ceiling in an embodiment disclosed herein. FIG. 34C presents a bottom isometric view of a ceiling in an embodiment disclosed herein. FIG. 34D presents a top isometric view of a ceiling in an embodiment disclosed herein.

FIG. 35A presents a closeup view of a top portion of a base in an embodiment disclosed herein. FIG. 35B presents a closeup view of a bottom portion of a base in an embodiment disclosed herein. FIG. 35C presents an isometric view of a bottom portion of a base in an embodiment disclosed herein.

Figure 36A:
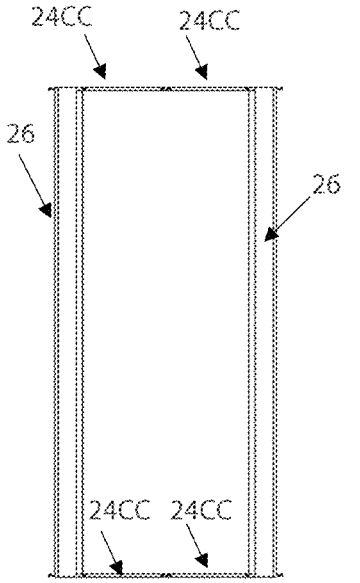
Figure 36B:
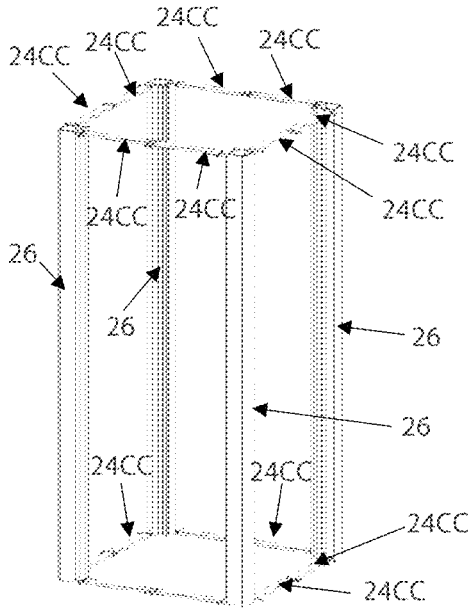

FIG. 36A presents a front view of a foldable shaft structure in a fourth embodiment taught herein. FIG. 36B presents an isometric view of a foldable shaft structure in a fourth embodiment taught herein.

Figure 37A:
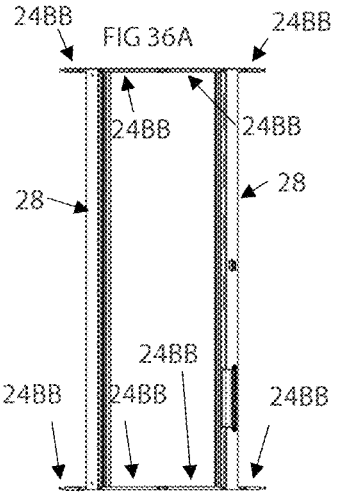
Figure 37B:
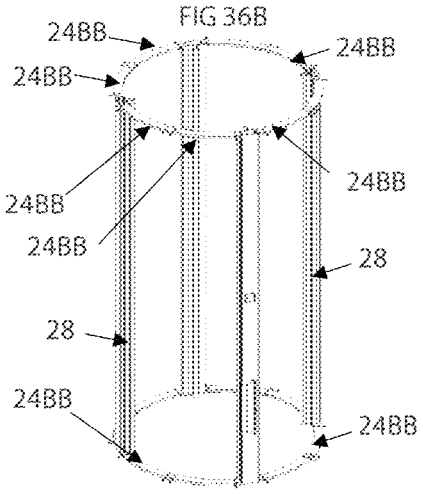

FIG. 37A presents a front view of a foldable shaft structure in a fifth embodiment taught herein. FIG. 37B presents an isometric view of a foldable shaft structure in a fifth embodiment taught herein.

Figure 38A:
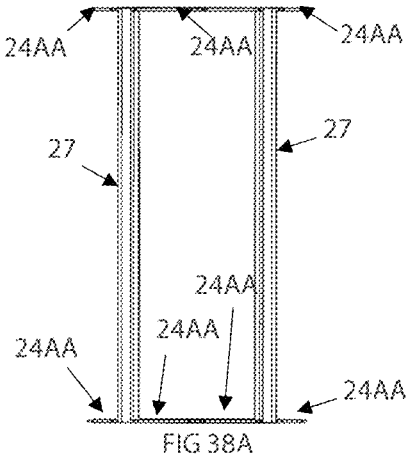
Figure 38B:
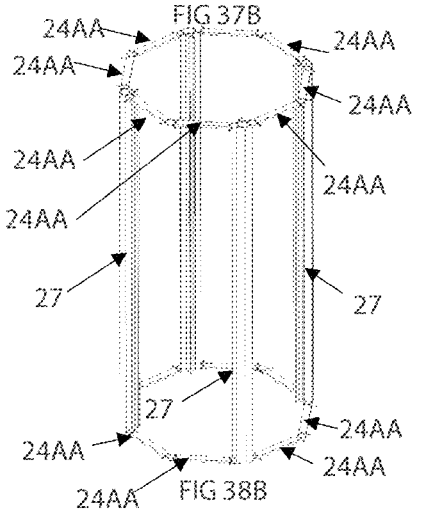

FIG. 38A presents a front view of a foldable shaft structure in a sixth embodiment taught herein. FIG. 38B presents an isometric view of a foldable shaft structure in a sixth embodiment taught herein.

Figure 39A:
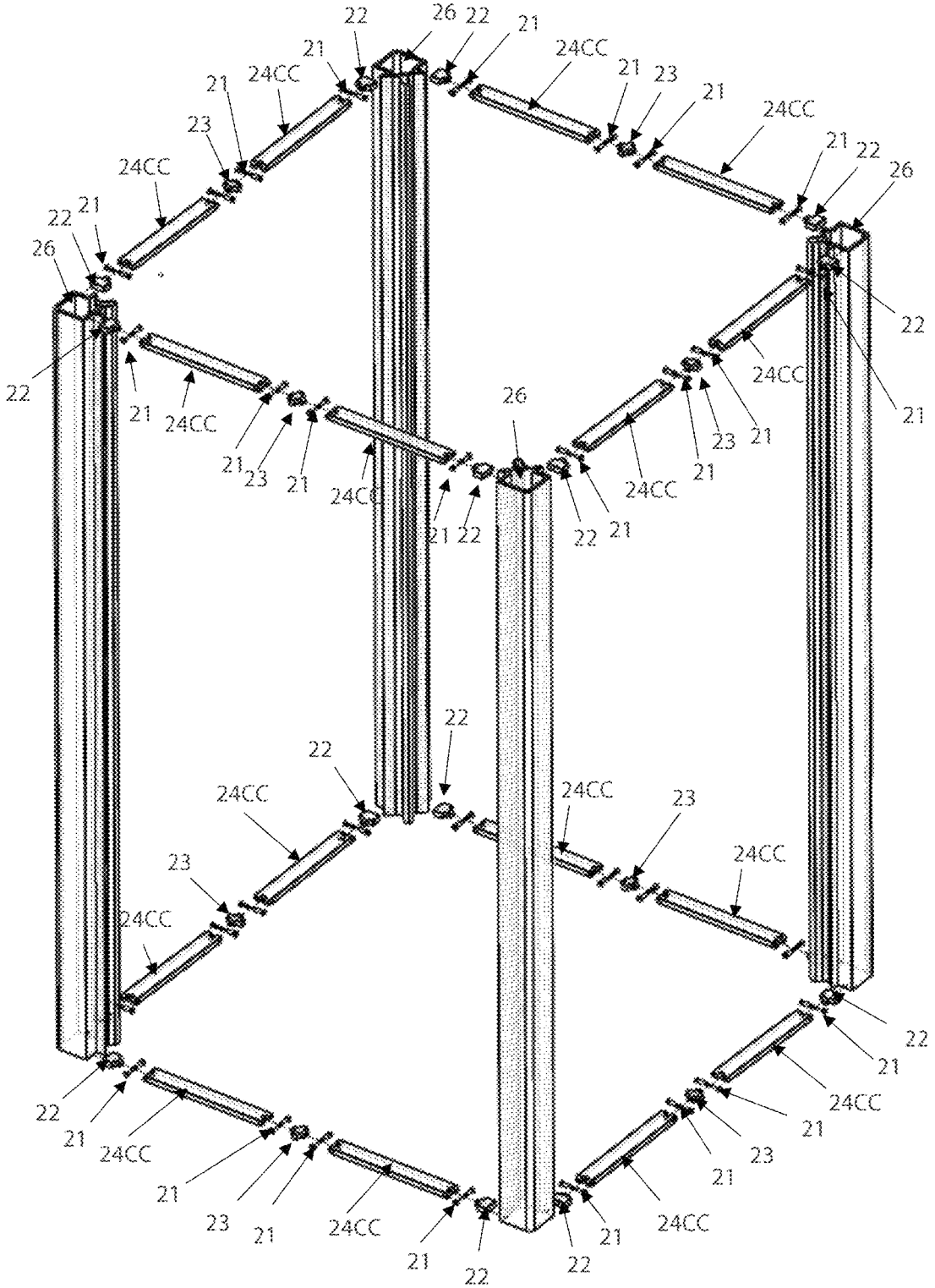
Figure 39B:
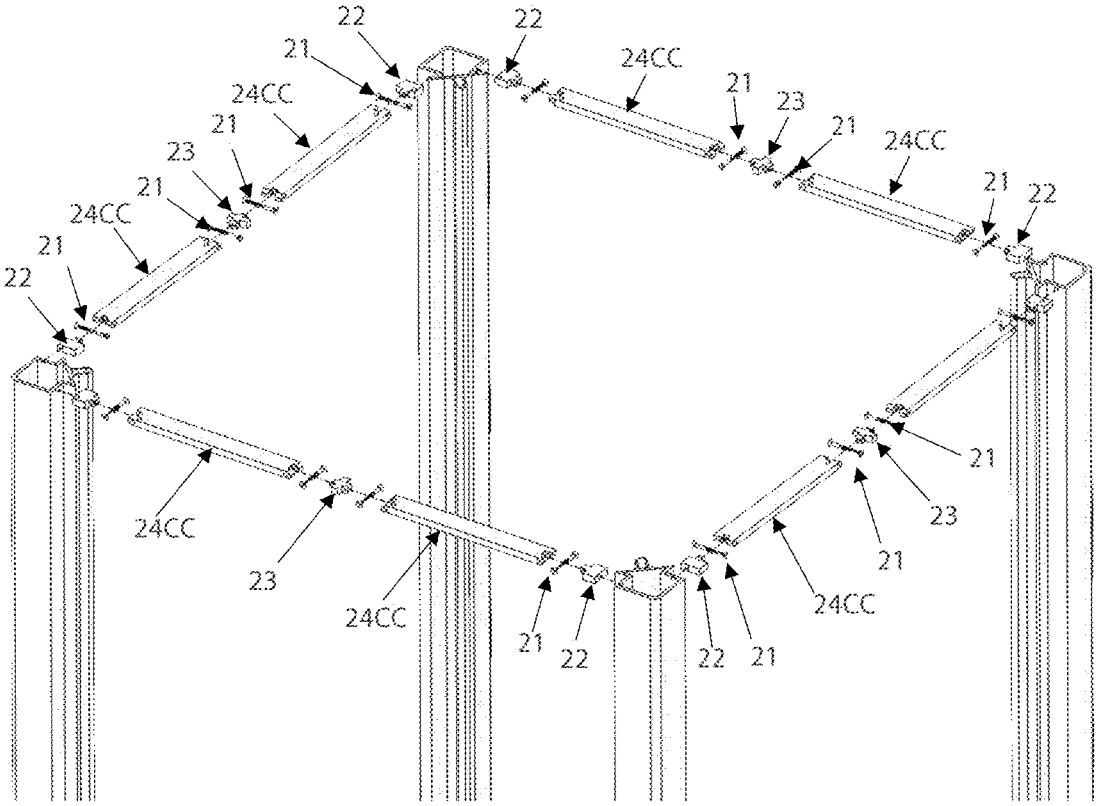
Figure 39C:
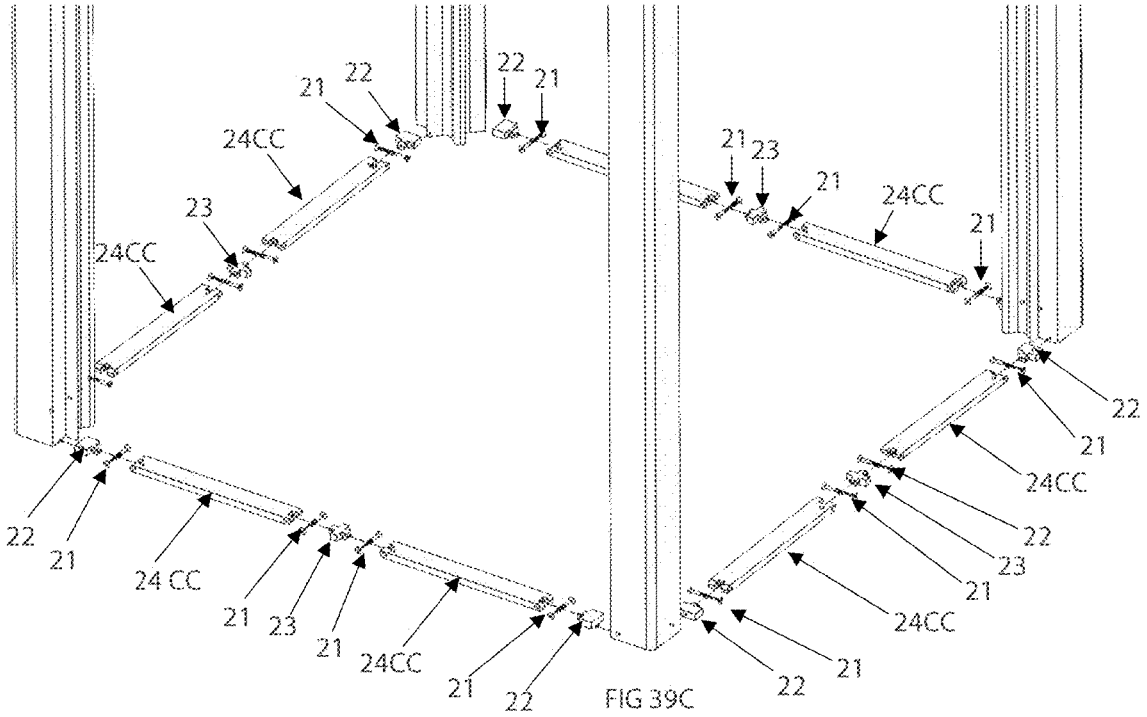

FIG. 39A presents an isometric assembly view of a foldable shaft structure in a fourth embodiment taught herein. FIG. 39B presents a top isometric assembly view of a foldable shaft structure in a fourth embodiment taught herein. FIG. 39C presents a bottom isometric assembly view of a foldable shaft structure in a fourth embodiment taught herein.

Figure 40A:
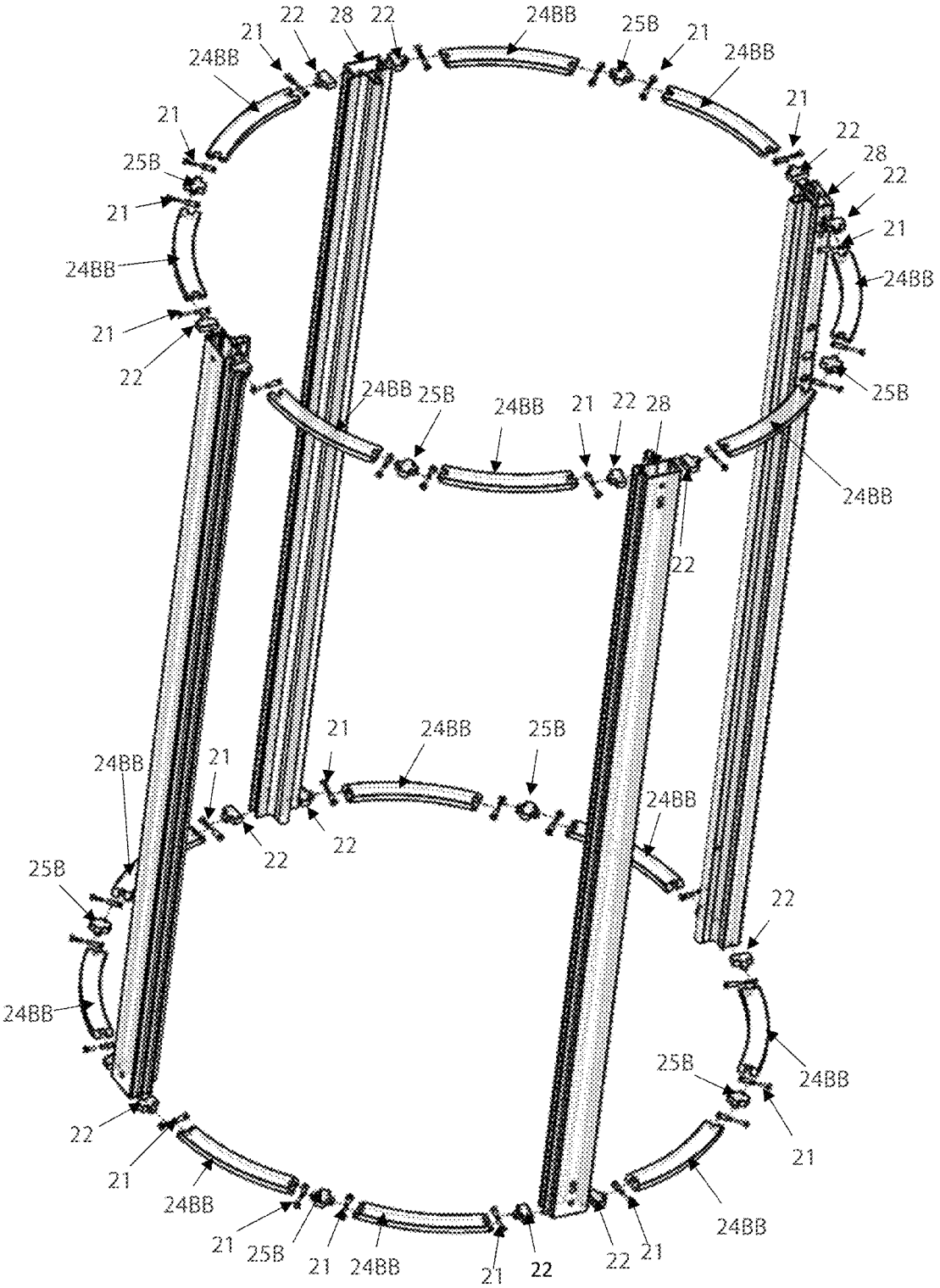
Figure 40B:
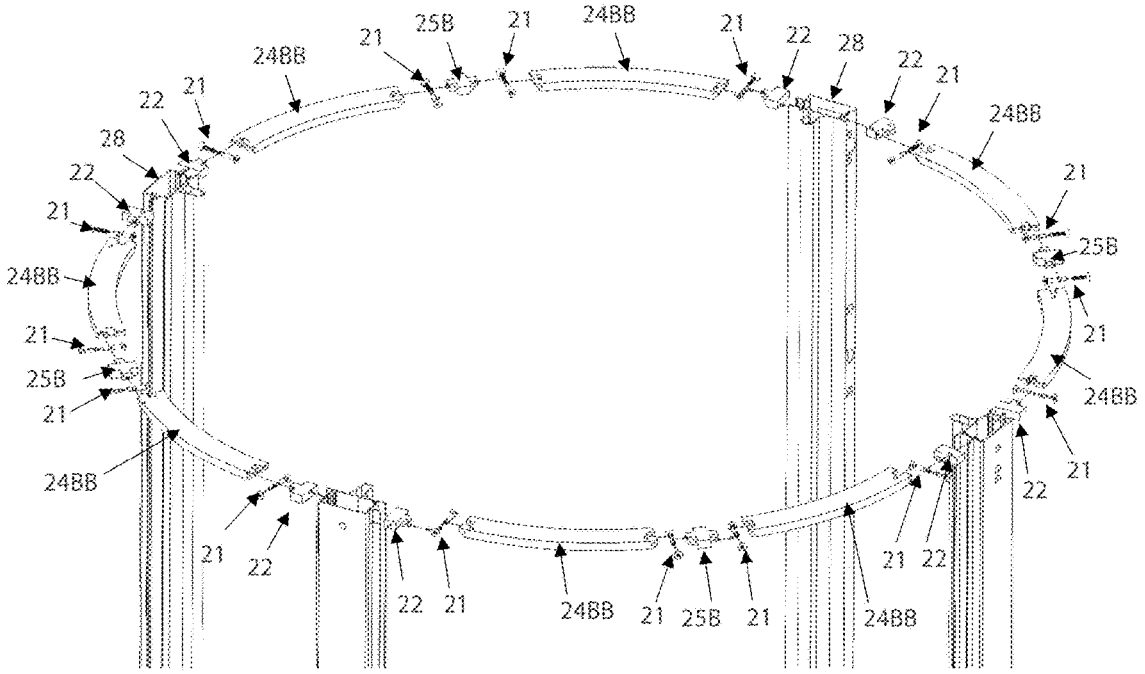
Figure 40C:
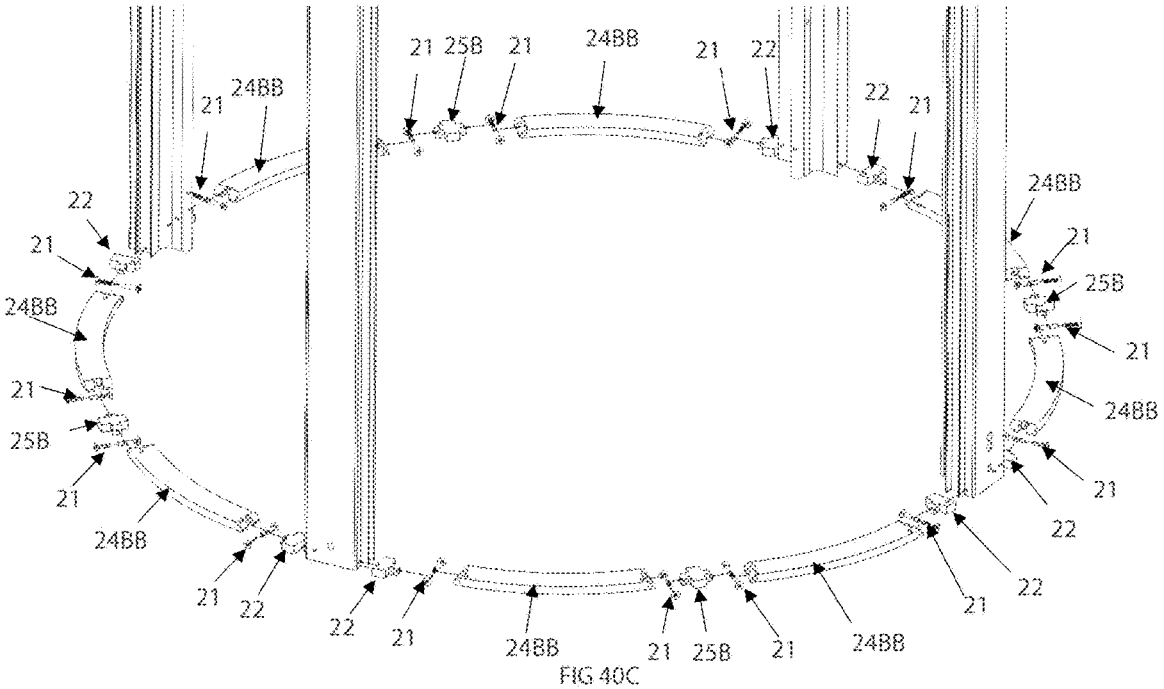

FIG. 40A presents an isometric assembly view of a foldable shaft structure in a fifth embodiment taught herein. FIG. 40B presents a top isometric assembly view of a foldable shaft structure in a fifth embodiment taught herein. FIG. 40C presents a bottom isometric assembly view of a foldable shaft structure in a fifth embodiment taught herein.

Figure 41A:
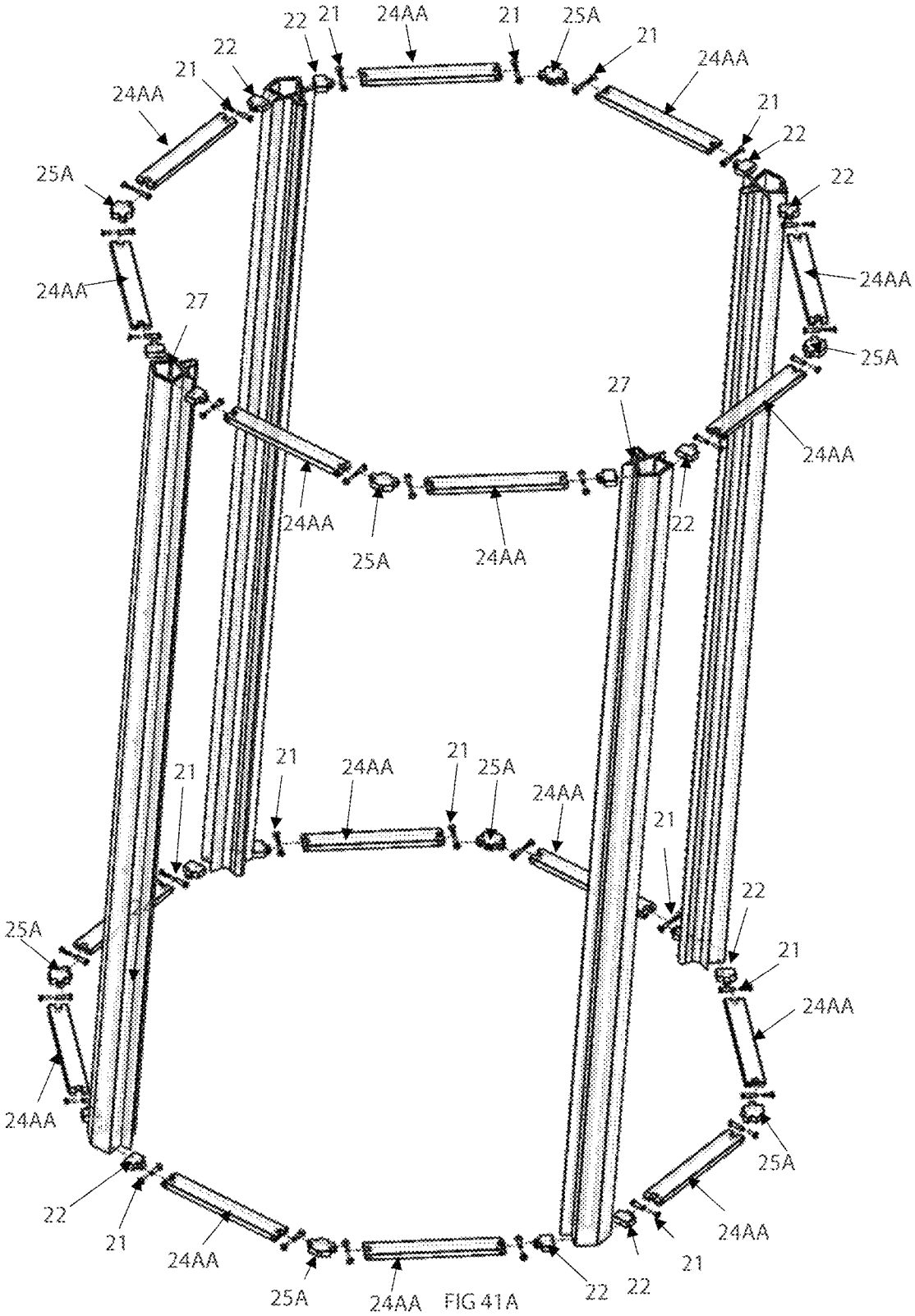

FIG. 41A presents an isometric assembly view of a foldable shaft structure in a sixth embodiment taught herein. FIG. 41B presents a top isometric assembly view of a foldable shaft structure in a sixth embodiment taught herein. FIG. 41C presents a bottom isometric assembly view of a foldable shaft structure in a sixth embodiment taught herein.

Figure 42A:
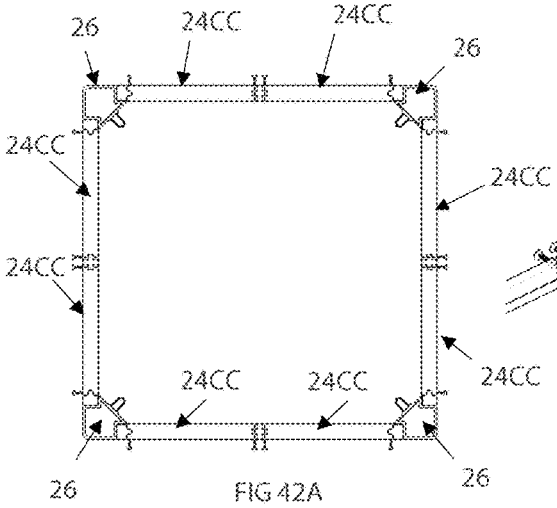
Figure 42B:
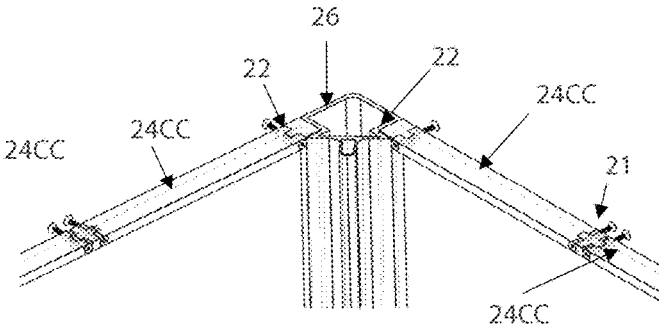

FIG. 42A presents a top view of a foldable shaft structure in a fourth embodiment disclosed herein. FIG. 42B presents a top isometric closeup view of a portion of a foldable shaft structure in a fourth embodiment disclosed herein.

Figure 43A:
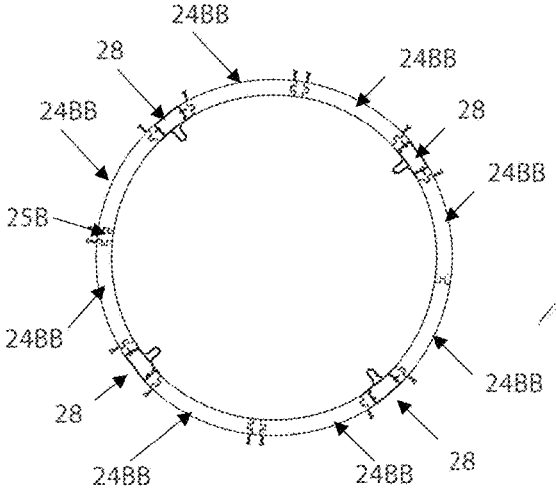
Figure 43B:
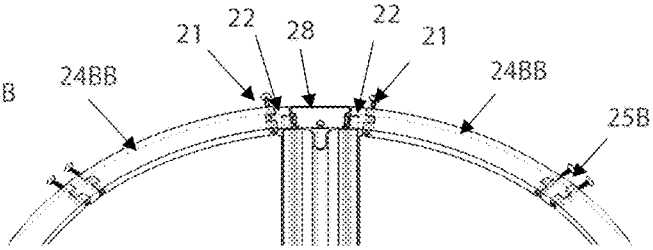

FIG. 43A presents a top view of a foldable shaft structure in a fifth embodiment disclosed herein. FIG. 43B presents a top isometric closeup view of a portion of a foldable shaft structure in a fifth embodiment disclosed herein.

Figure 44A:
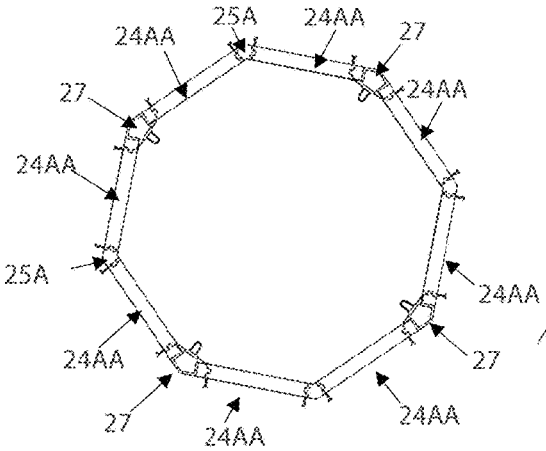
Figure 44B:
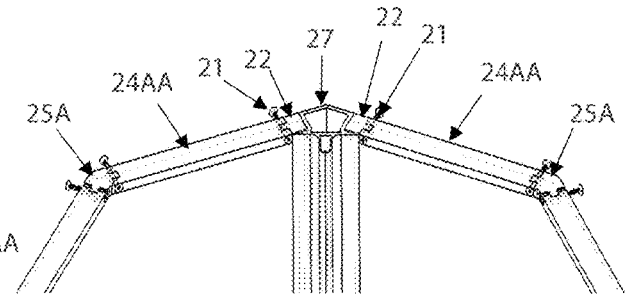

FIG. 44A presents a top view of a foldable shaft structure in a sixth embodiment disclosed herein. FIG. 44B presents a top isometric closeup view of a portion of a foldable shaft structure in a sixth embodiment disclosed herein.

Figure 45:
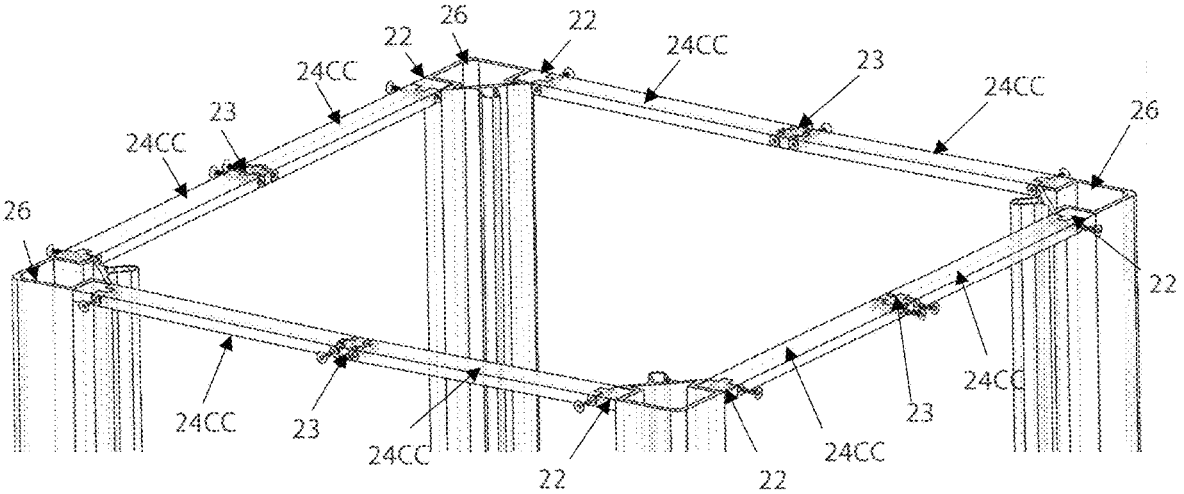

FIG. 45 presents a top isometric closeup view of a top portion of a foldable shaft structure in a fourth embodiment disclosed herein.

Figure 46:
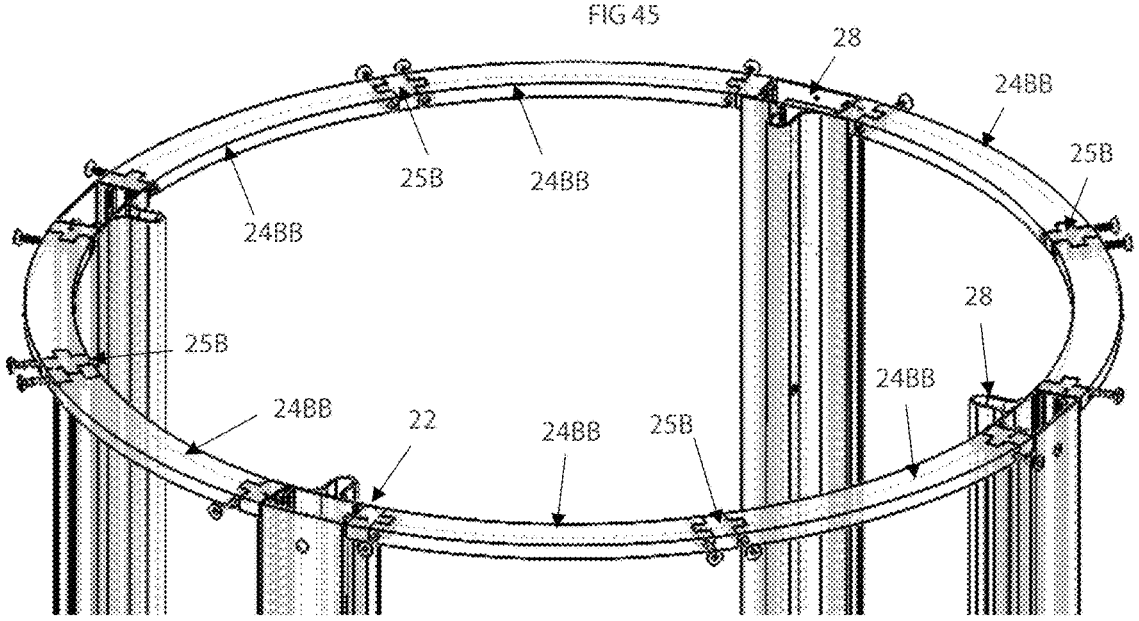

FIG. 46 presents a top isometric closeup view of a top portion of a foldable shaft structure in a fifth embodiment disclosed herein.

Figure 47:
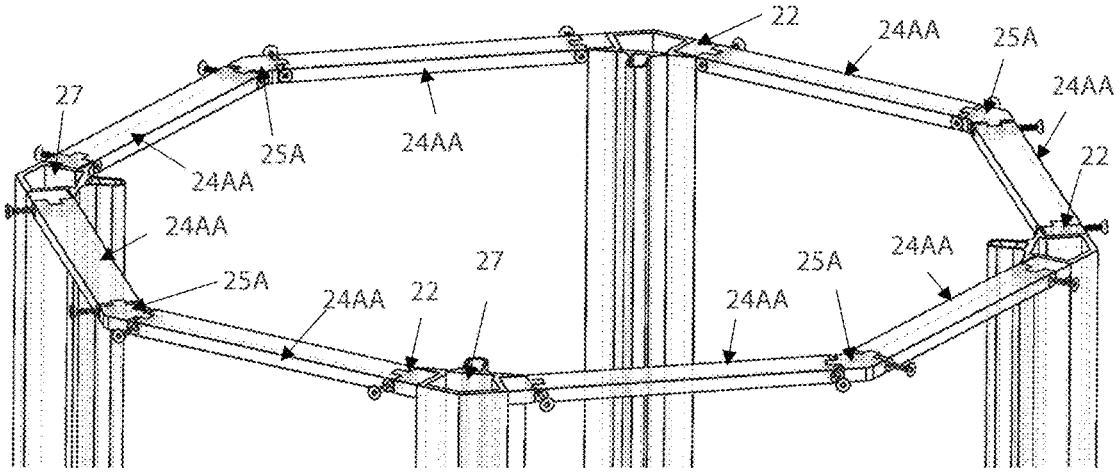

FIG. 47 presents a top isometric closeup view of a top portion of a foldable shaft structure in a sixth embodiment disclosed herein.

Figure 48A:
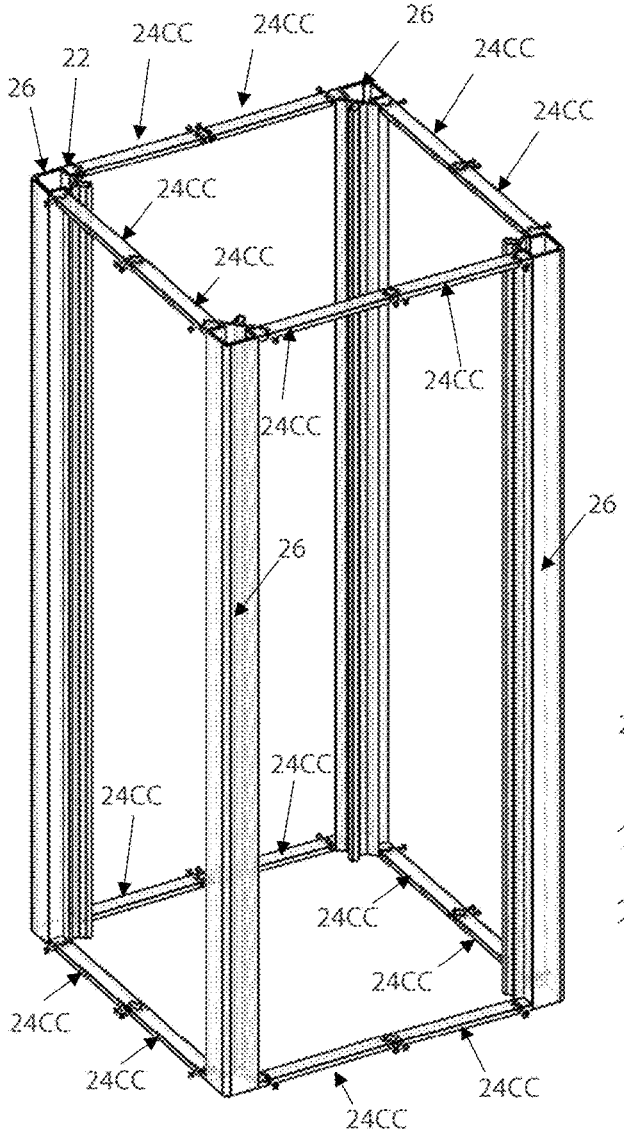

FIG. 48A presents an isometric view of the foldable shaft structure in a fourth embodiment disclosed herein.

Figure 48B:
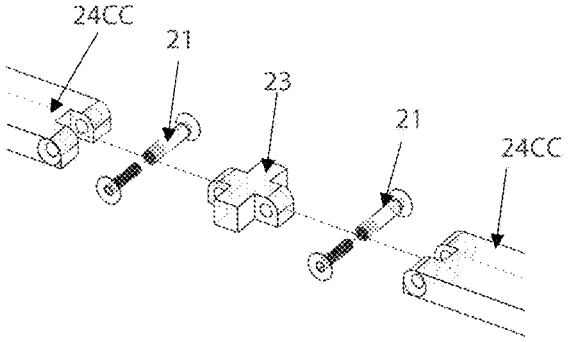

FIG. 48B presents a closeup view of a joint between two arms of the foldable shaft structure in a fourth embodiment disclosed herein.

Figure 48C:
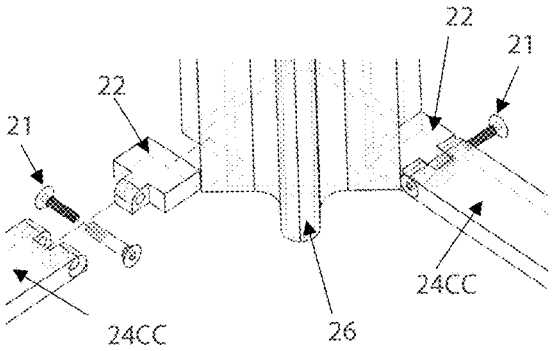

FIG. 48C presents a closeup view of a connection between an end of an arm and a bottom portion of a member of the foldable shaft structure in a fourth embodiment disclosed herein.

Figure 49A:
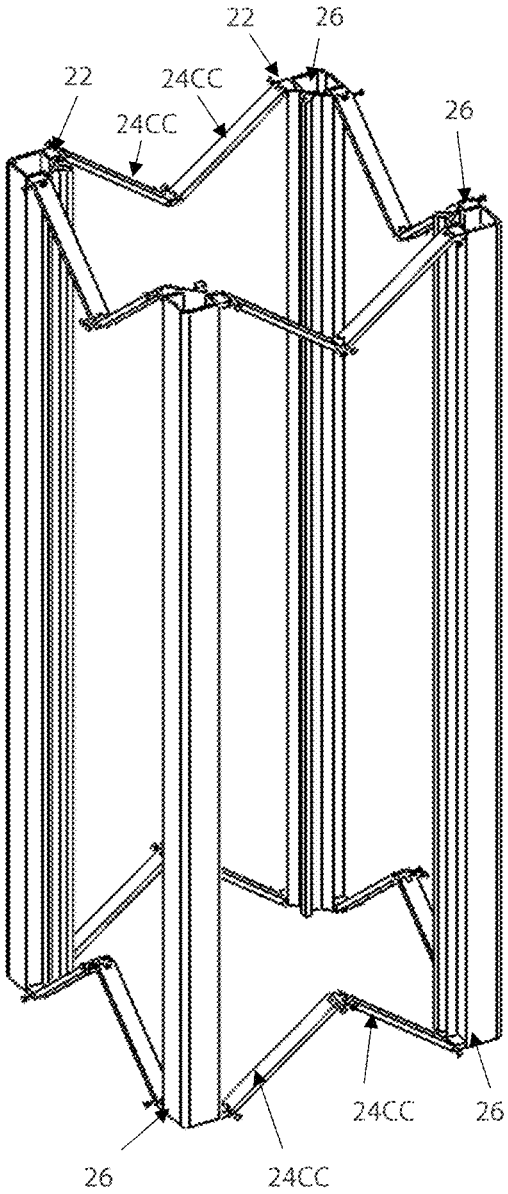

FIG. 49A presents an isometric view of a partially closed or open foldable shaft structure in a fourth embodiment disclosed herein.

Figure 49B:
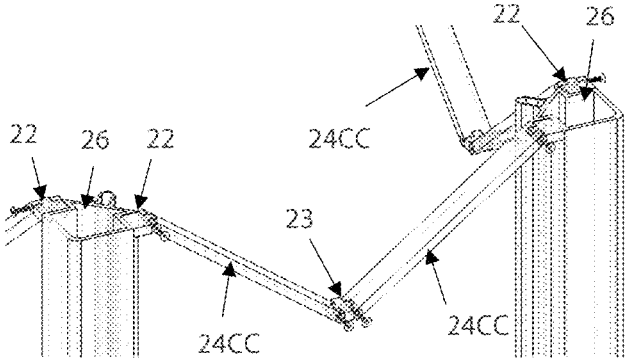

FIG. 49B presents an isometric closeup top portion view of a partially closed or partially open foldable shaft structure in a fourth embodiment disclosed herein.

Figure 49C:
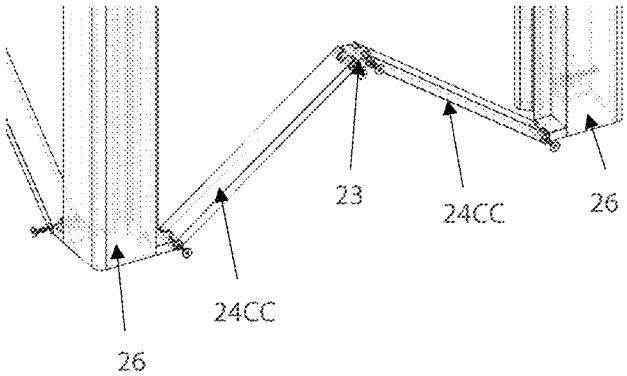

FIG. 49C presents an isometric closeup bottom portion view of a partially closed or partially open foldable shaft structure in a fourth embodiment disclosed herein.

Figure 50A:
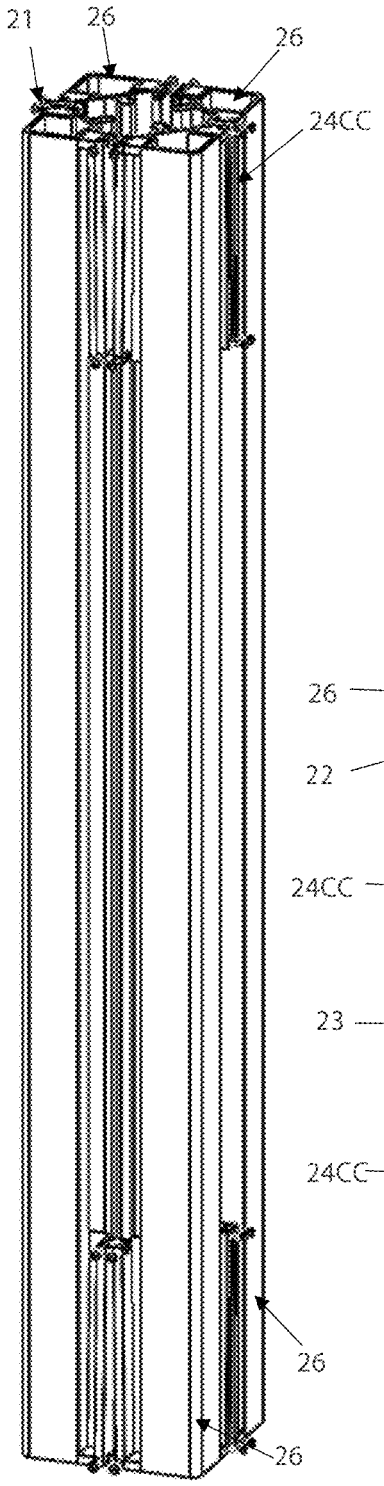

FIG. 50A presents a CLOSED position of the foldable shaft structure in a fourth embodiment disclosed herein.

Figure 50B:
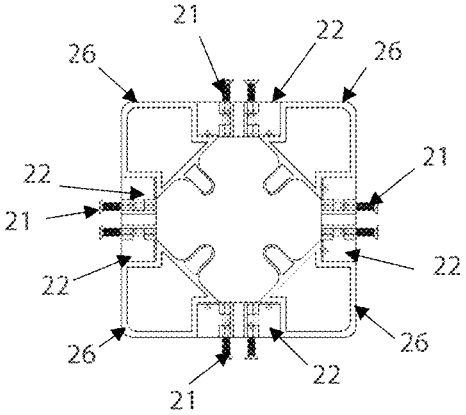

FIG. 50B presents a top CLOSED view of the top portion of the foldable shaft structure in a fourth embodiment disclosed herein.

Figure 50C:
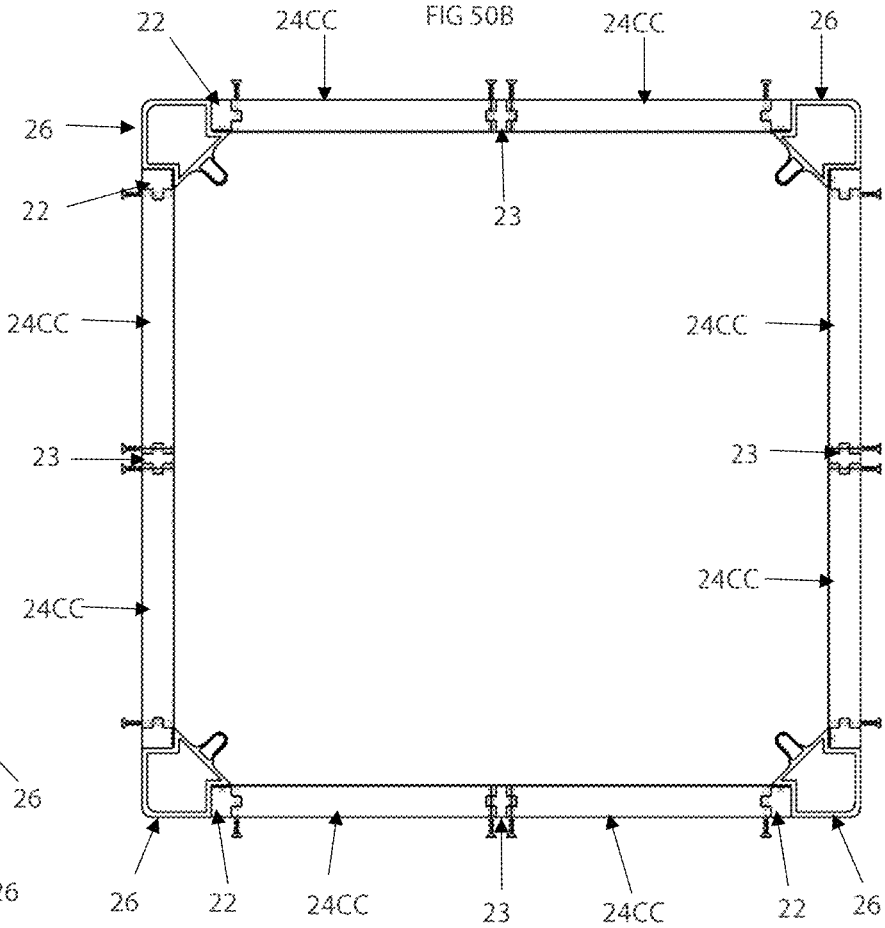

FIG. 50C presents a top OPEN view of the top portion of the foldable shaft structure in a fourth embodiment disclosed herein.

Figure 51A:
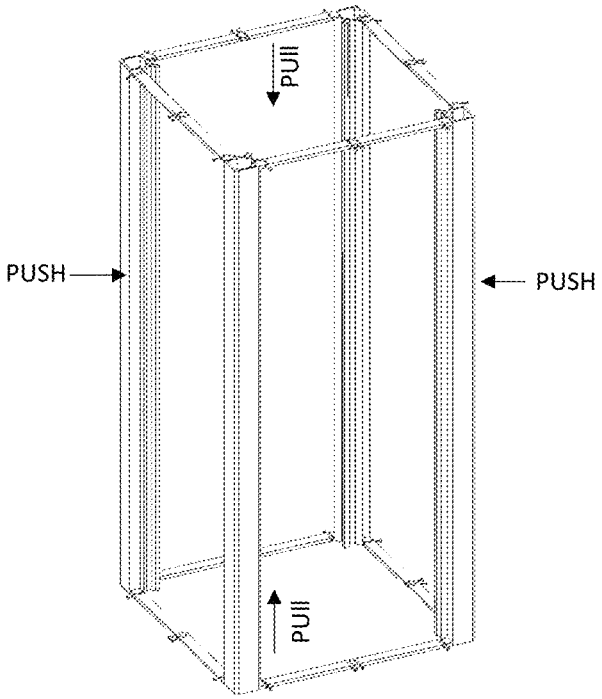

FIG. 51A presents an isometric view of an OPEN POSITION of a foldable shaft structure in a fourth embodiment herein disclosed.

Figure 51B:
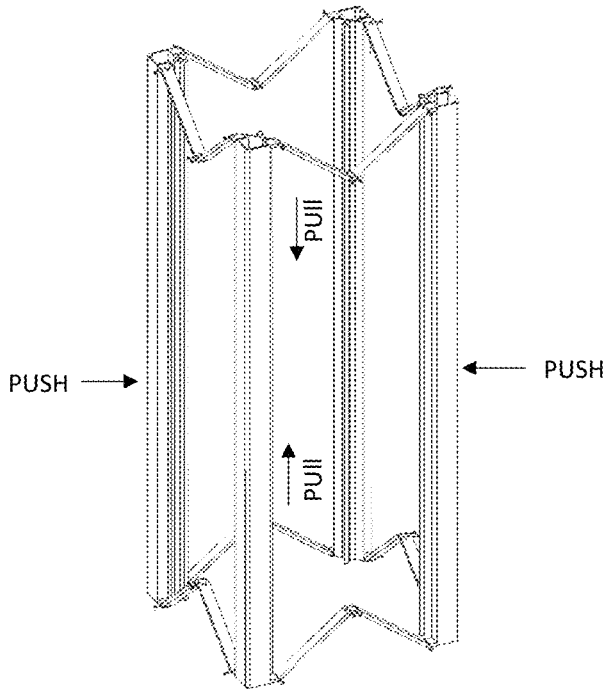

FIG. 51B presents an isometric view of a HALF OPEN POSITION of a foldable shaft structure in a fourth embodiment herein disclosed.

Figure 51C:
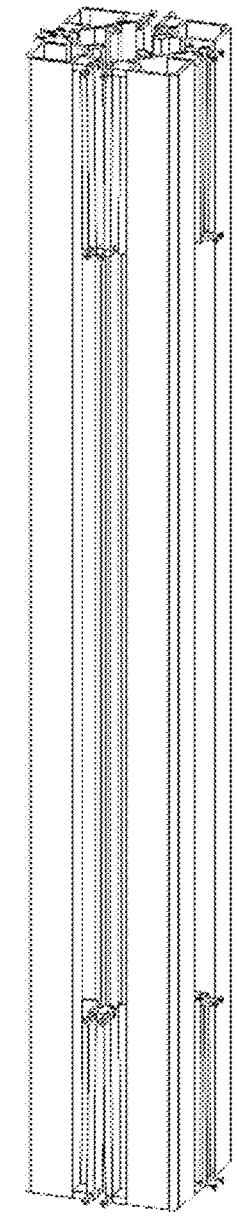

FIG. 51C presents an isometric view of a CLOSED POSITION of a foldable shaft structure in a fourth embodiment herein disclosed.

Figure 52:
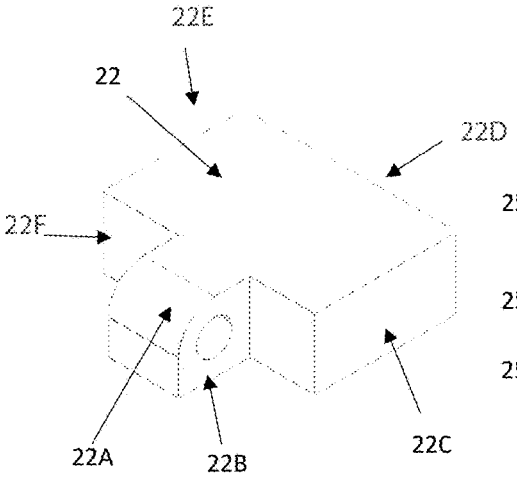

FIG. 52 presents an isometric view of a support 22 in an embodiment disclosed herein.

Figure 53A:
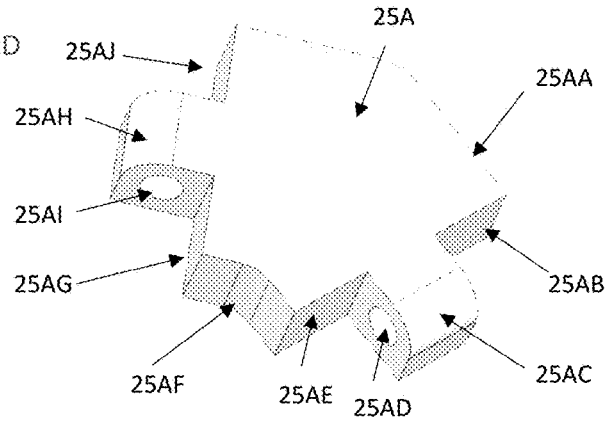
Figure 53B:
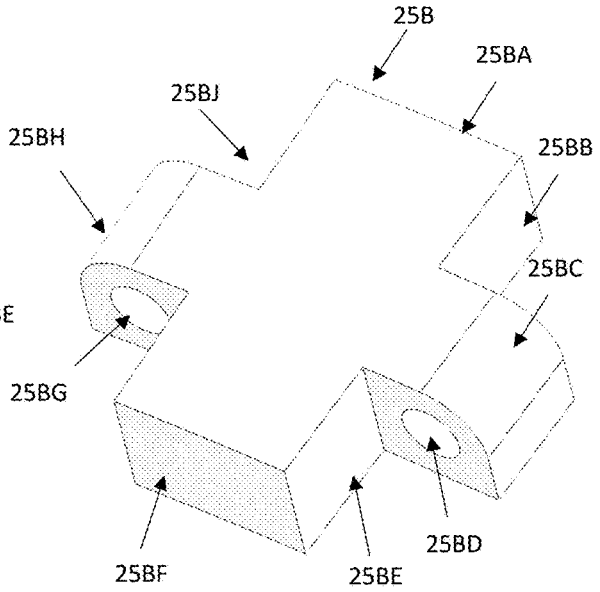

FIG. 53A presents an isometric view of a pivot 25A of the foldable shaft structure in a sixth embodiment disclosed herein. FIG. 53B presents an isometric view of a pivot 25B of the foldable shaft structure in a fifth embodiment disclosed herein.

Figure 54:
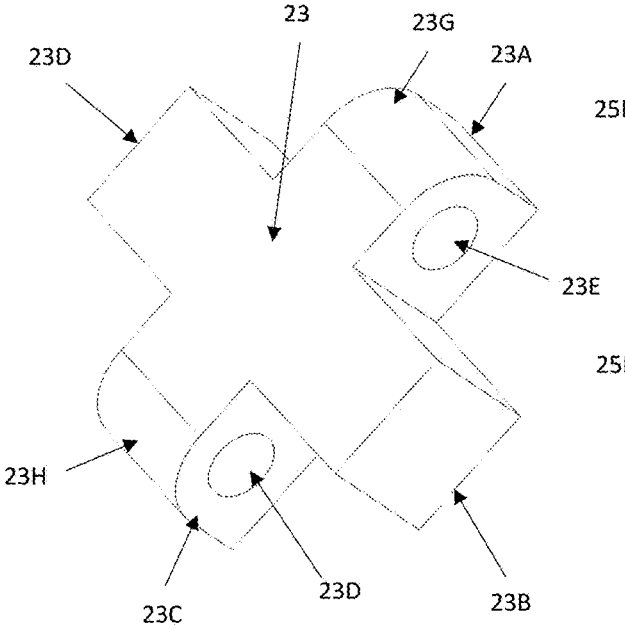

FIG. 54 presents an isometric view of a pivot 23 of the foldable shaft structure in a fourth embodiment disclosed herein.

Figure 55:
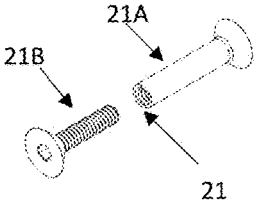

FIG. 55 presents an isometric view of a barrel and screw 21 fastener of the foldable shaft structure in an embodiment disclosed herein.

Figure 56A:
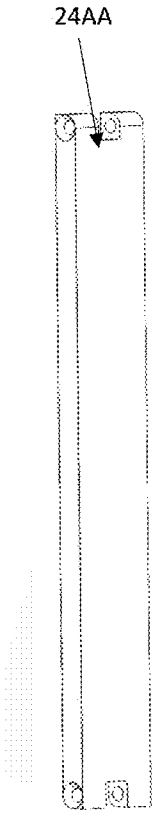

FIG. 56A presents an isometric view of the arm 24AA in a sixth embodiment disclosed herein.

Figure 56B:
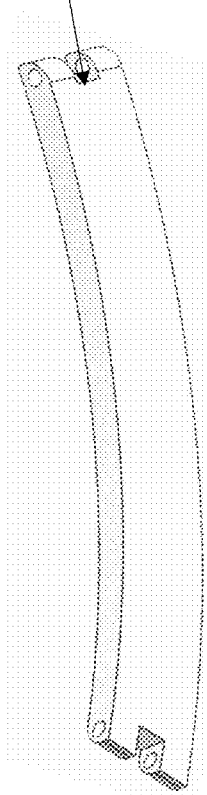

FIG. 56B presents an isometric view of the arm 24BB in a fifth embodiment disclosed herein.

Figure 56C:
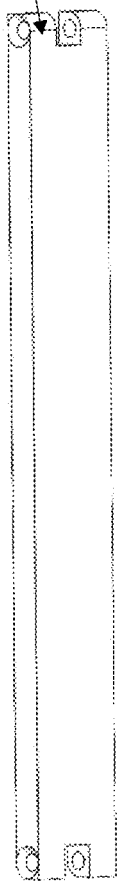

FIG. 56C presents an isometric view of the arm 24CC in a fourth embodiment disclosed herein.

Figure 56D:
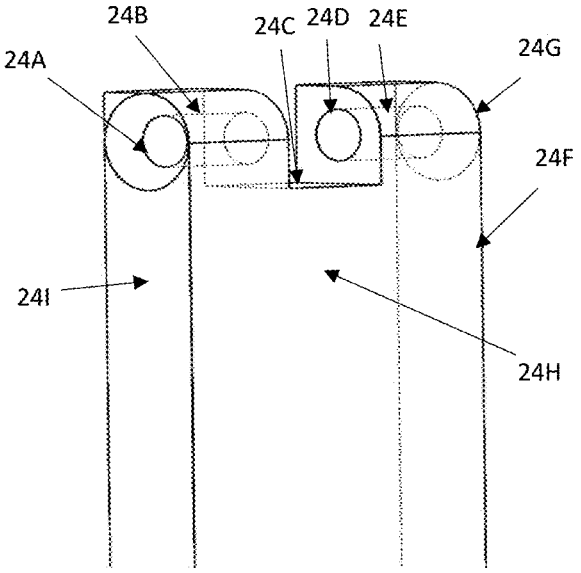

FIG. 56D presents a top portion of either of FIG. 56A, FIG. 56C in a sixth and fourth embodiment disclosed herein.

Figure 56E:
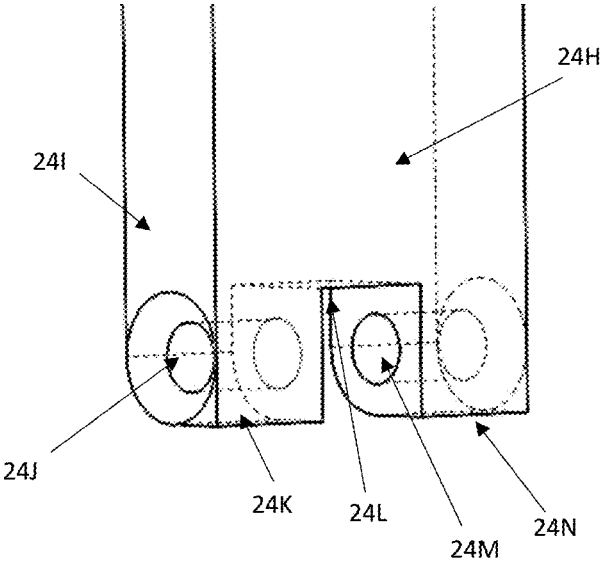

FIG. 56E presents a bottom portion of either of FIG. 56A, FIG. 56C in a sixth and fourth embodiment disclosed herein.

Figure 56F:
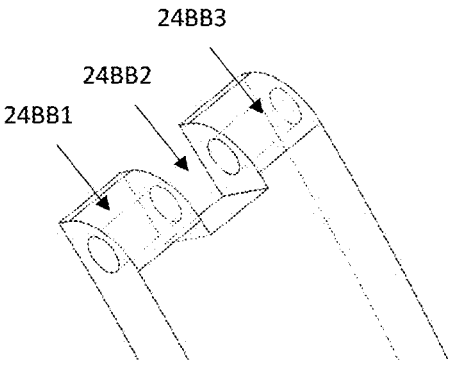

FIG. 56F presents a top portion of FIG. 56B in a fifth embodiment disclosed herein.

Figure 56G:
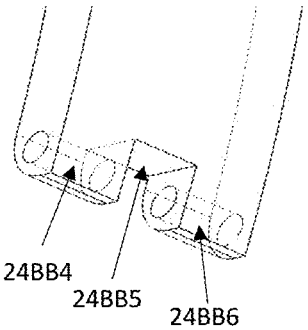

FIG. 56G presents a bottom portion of FIG. 56B in a fifth embodiment disclosed herein.

Figure 57A:
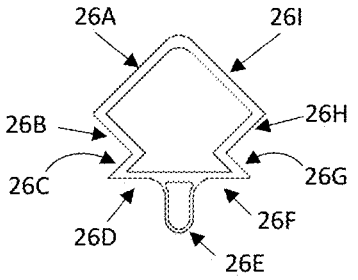

FIG. 57A presents a top view of a member 26 in a fourth embodiment disclosed herein.

Figure 57B:
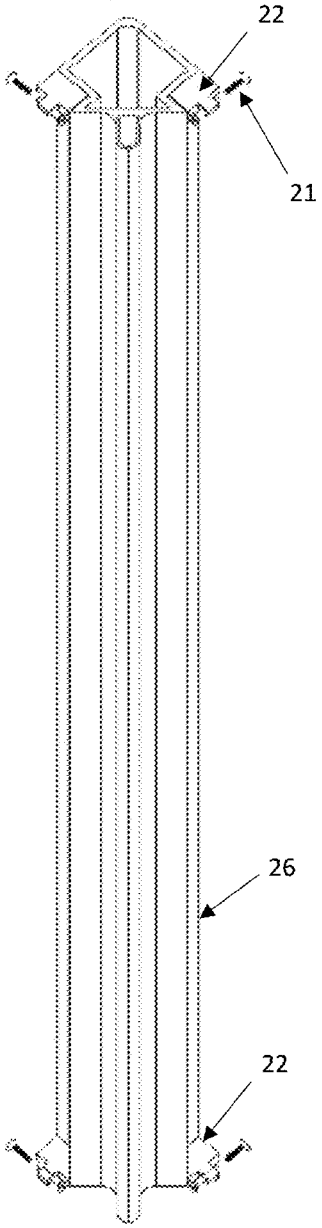

FIG. 57B presents an isometric view of a member 26 in a fourth embodiment disclosed herein.

Figure 57C:
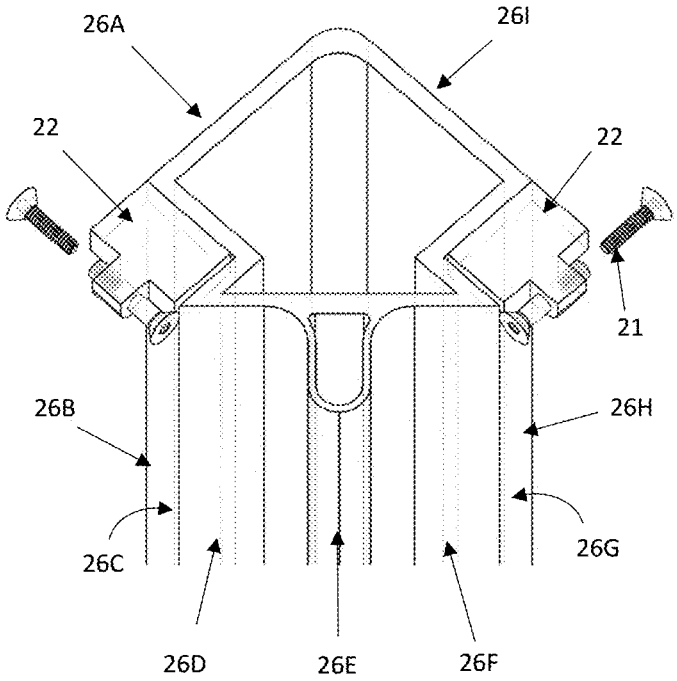

FIG. 57C presents a closeup top isometric view of a member 26 in a fourth embodiment disclosed herein.

Figure 57D:
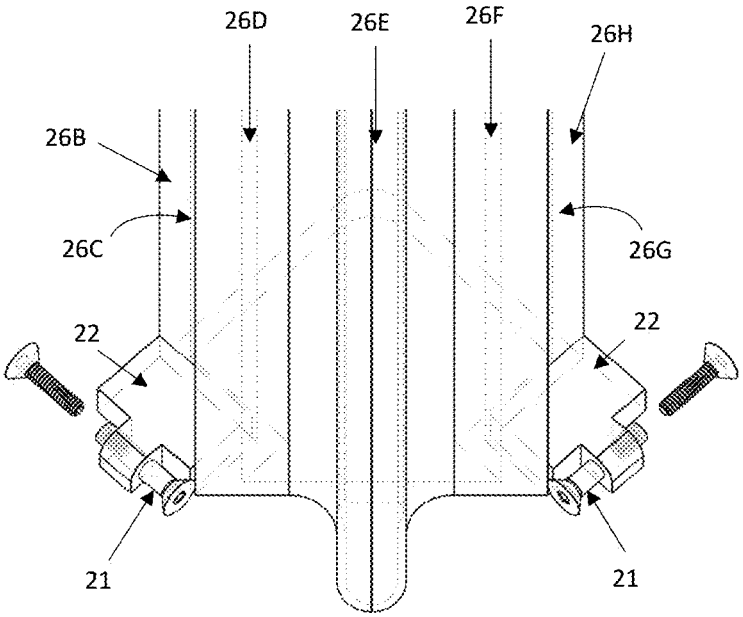

FIG. 57D presents a closeup bottom isometric view of a member 26 in a fourth embodiment disclosed herein.

Figure 58A:
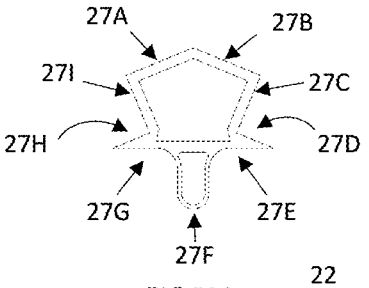

FIG. 58A presents a top view of a member 27 in a sixth embodiment disclosed herein.

Figure 58C:
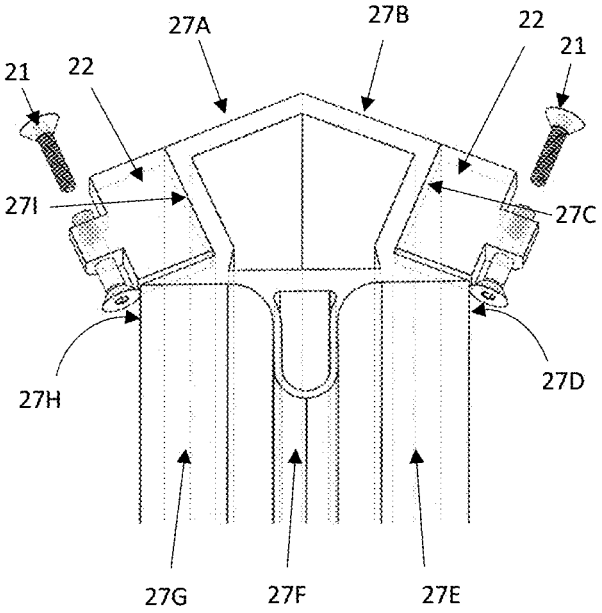
Figure 58B:
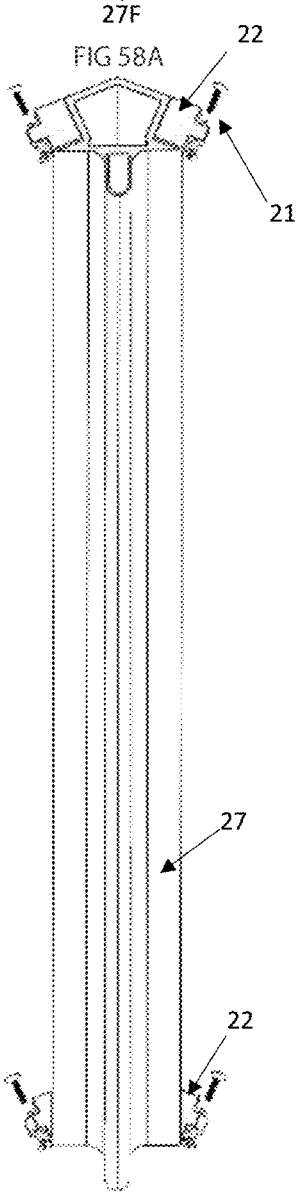

FIG. 58B presents an isometric view of a member 27 in a sixth embodiment disclosed herein.

FIG. 58C presents a closeup top isometric view of a member 27 in a sixth embodiment disclosed herein.

Figure 58D:
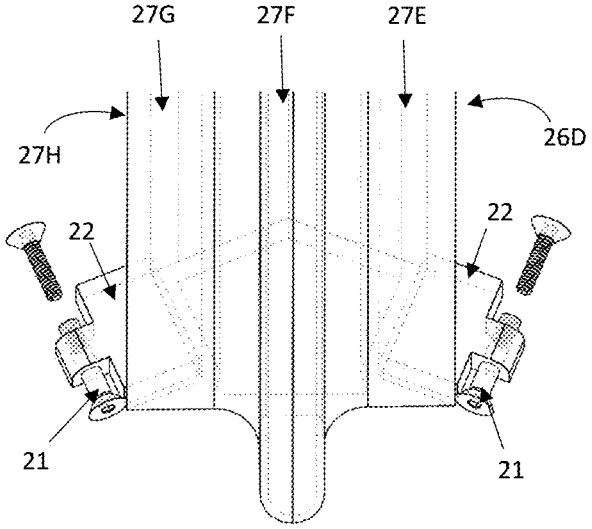

FIG. 58D presents a closeup bottom isometric view of a member 28 in a sixth embodiment disclosed herein.

Figure 59A:
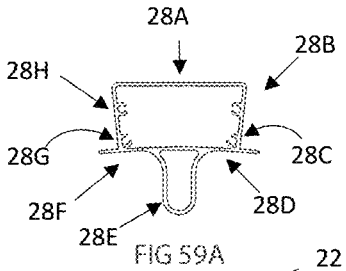

FIG. 59A presents a top view of a member 28 in a fifth embodiment disclosed herein.

Figure 59B:
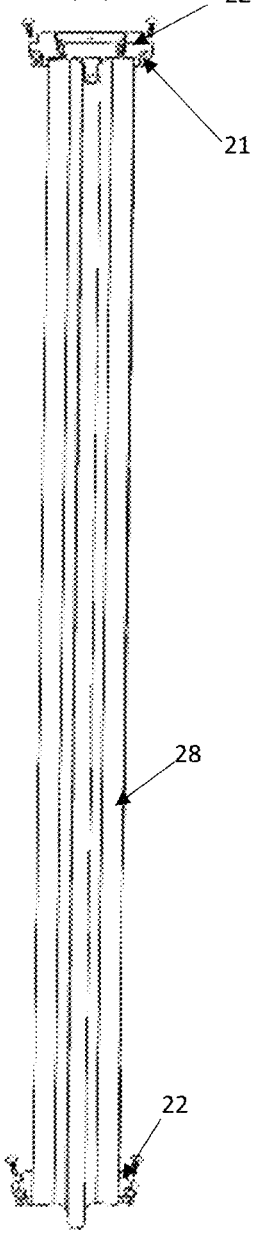

FIG. 59B presents an isometric view of a member 28 in a fifth embodiment disclosed herein.

Figure 59C:
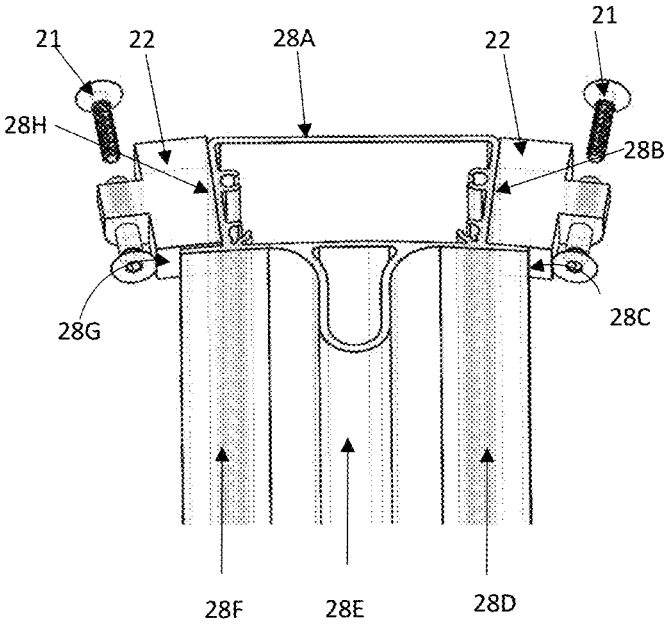

FIG. 59C presents a closeup top isometric view of a member 28 in a fifth embodiment disclosed herein.

Figure 59D:
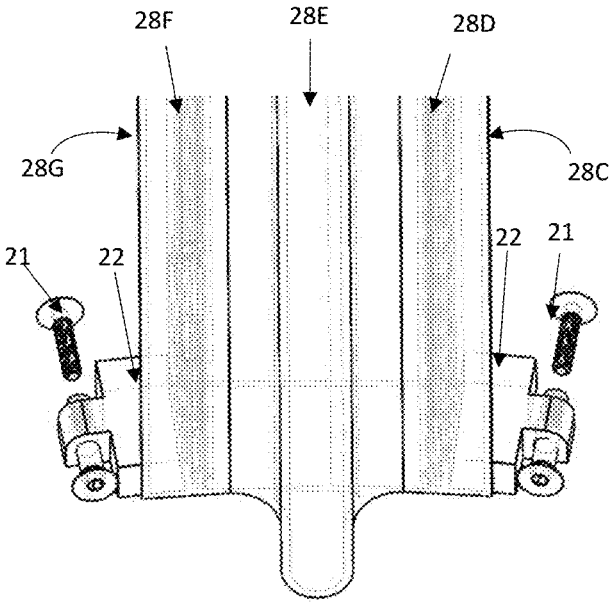

FIG. 59D presents a closeup bottom isometric view of a member 28 in a fifth embodiment disclosed herein.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A foldable elevator cabin and a foldable elevator shaft structure designed for easy setup and deployment are disclosed herein. First, the foldable elevator cabin has a plurality of members attached at two separate centralized points for centralized folding using arms attached between each member. A ceiling and a base are attached to the top and bottom of the various members (and column as appropriate). Secondly, a foldable elevator structure having a plurality of members is shown having each member sequentially attached between a preceding member and a succeeding member until all members have been attached. In this fashion, the foldable structure is foldable between each set of two adjacent members. In the exemplary embodiments shown there are four vertical members shown; however, in the first concept, that of the foldable elevator cabin one of the four members is further defined using the word 'column;' thus, those embodiments having a column have three members and a column or more generically four members. Most generally, however, in the lexicon described herein this particular item known as a 'column' can be interchangeably used with the word member when necessary to more broadly define the claims and description.

Figure 1A:
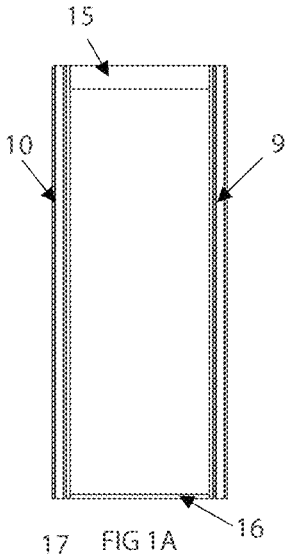
FIG. 1A presents a view of a foldable elevator cabin structure in a first embodiment taught herein.

FIG. 1A presents an isometric view of a foldable elevator cabin structure in a first embodiment taught herein. The foldable elevator cabin structure comprises most generally: three members 9, a column 10, a ceiling 15, a base 16, as well as various other components to be described below. The three members 9 and the column 10 are each attached to both the ceiling and base.

Figure 1B:
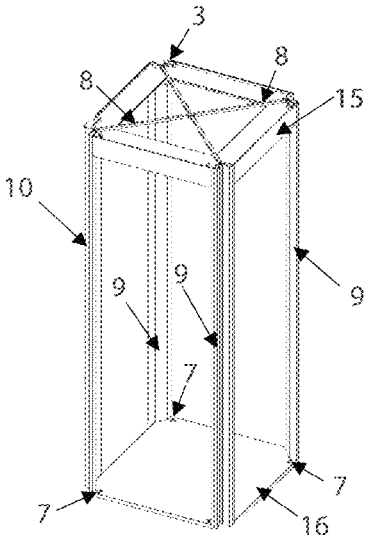
FIG. 1B presents an isometric view of a foldable elevator cabin structure in a first embodiment taught herein.

FIG. 1B presents an isometric view of a foldable elevator cabin structure in a first embodiment taught herein. Various column supports 3 (typically four, one per member and one for the column) are attached by welding to the top portion of the members 9 and the column 10 and subsequently attached to the ceiling 15 using fasteners. A set of four arms 8 each having two ends are centrally attached together using a first end of each arm; a second end of a single one of the arms 8 is attached to a top portion of a single one of the members 9; two other arms 8 are similarly attached to other top portions of the other two members 9. The final arm's 8 second end is attached to a top portion of the column 10. Various screws 7 (typically four) are used to attach the base 16 to the members 9 and column 10 using four support 3; each of these supports 3 are attached to a single one of the members 9 or column 10 different from those of the other supports 3.

Figure 2A:
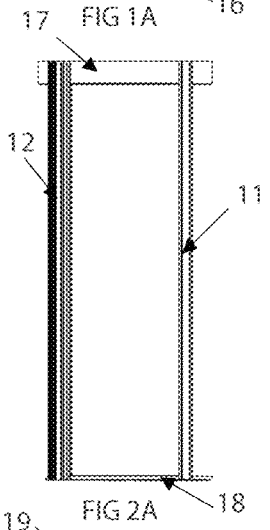
FIG. 2A presents a view of a foldable elevator cabin structure in a second embodiment taught herein.

FIG. 2A presents an isometric view of a foldable elevator cabin structure in a second embodiment taught herein. The foldable elevator cabin structure comprises most generally: three members 11, a column 12, a ceiling 17, a base 18, as well as various other components to be described below. The three members 11 and the column 12 are each attached to both the ceiling 17 and base 18.

Figure 2B:
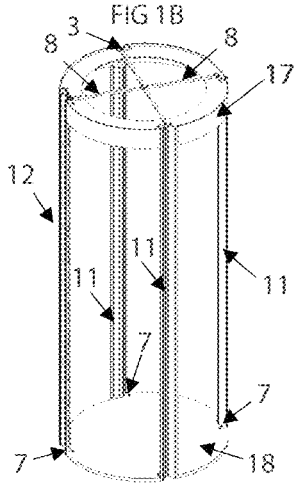
FIG. 2B presents an isometric view of a foldable elevator cabin structure in a second embodiment taught herein.

FIG. 2B presents an isometric view of a foldable elevator cabin structure in a second embodiment taught herein. Various column supports 3 (typically four, one per member and one for the column) are attached by welding to the top portion of the members 11 and the column 12 and subsequently attached to the ceiling 17 using fasteners. A set of four arms 8 each have two ends are centrally attached together using a first end of each arm; a second end of a single one of the arms 8 is attached to a top portion of a single one of the members 11; two other arms 8 are similarly attached to other top portions of the other two members 11. The final arm's 8 second end is attached to a top portion of the column 12. Various screws 7 (typically four) are used to attach the base 18 to the members 11 and column 12 using four supports 3; each of these supports 3 is attached to a single one of the members 11 or column 12 different from those of the other supports 3.

Figure 3A:
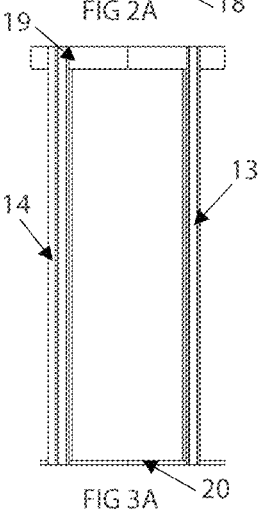
FIG. 3A presents a view of a foldable elevator cabin structure in a third embodiment taught herein.

FIG. 3A presents an isometric view of a foldable elevator cabin structure in a third embodiment taught herein. The foldable elevator cabin structure comprises most generally: three members 13, a column 14, a ceiling 19, a base 20, as well as various other components to be described below. The three members 13 and the column 14 are each attached to both the ceiling 19 and base 20.

Figure 3B:
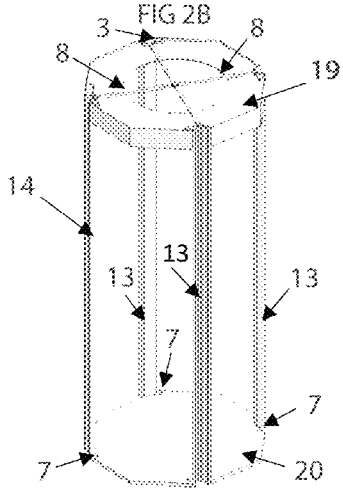
FIG. 3B presents an isometric view of a foldable elevator cabin structure in a third embodiment taught herein.

FIG. 3B presents an isometric view of a foldable elevator cabin structure in a third embodiment taught herein. Various column supports 3 (typically four, one per member and one for the column) are attached by welding to the top portion of the members 13 and the column 14 and subsequently attached to the ceiling 19 using fasteners. A set of four arms 8 each have two ends are centrally attached together using a first end of each arm through use of a pivot; a second end of a single one of the arms 8 is attached to a top portion of a single one of the members 13; two other arms 8 are similarly attached to other top portions of the other two members 13. The final arm's 8 second end is attached to a top portion of the column 14. Various screws 7 (typically four) are used to attach the base 20 to the members 13 and column 14 using four supports 3; each of these supports 3 is attached to a single one of the members 13 or column 14 different from those of the other supports 3.

Figure 4A:
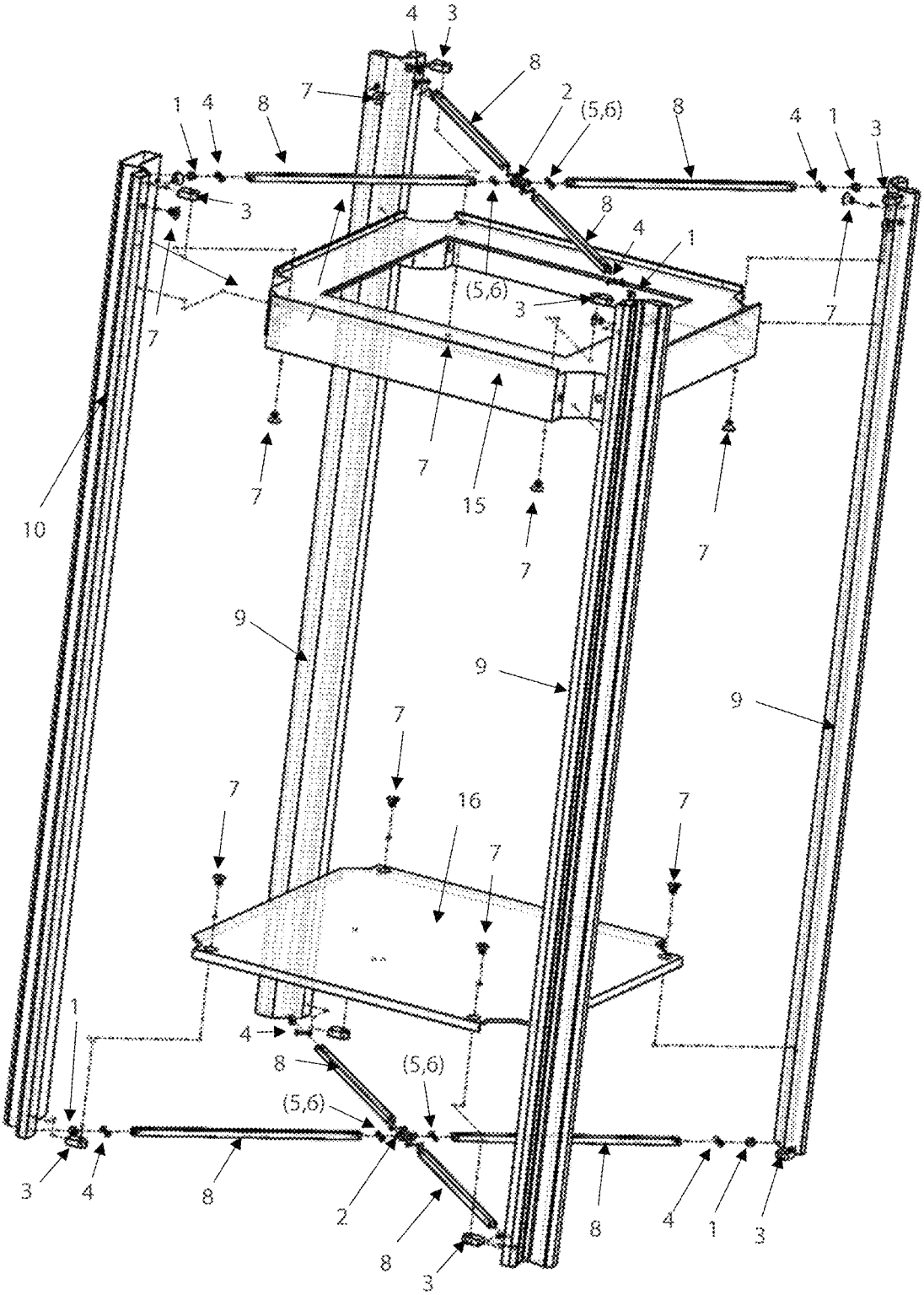
FIG. 4A presents a front isometric view of a foldable elevator cabin structure in a first embodiment disclosed herein.

FIG. 4A presents a front isometric view of a foldable elevator cabin structure in a first embodiment disclosed herein. Three members 9 and a column 10 are attached to a ceiling 15 and a base 16; in this regard, each of the three members 9 and the column 10 have two supports 3 welded to them, one near or at the top of each and one near or at the bottom of each (total of eight 8). Each of these supports 3 has a hole (threaded) therein for insertion of a screw 7 therethrough that also attaches to a separate hole (threaded) in a ceiling 15 plate or surface as described in the following. At top, the individual support 3 is located above ceiling 15 so that a single hole in the ceiling 15 plate (which has a cutout therein) is concentric with a single hole in the individual support 3. A screw 7 enters from the bottom opening of the single hole in ceiling plate and on into a corresponding hole in the top support 3. The other supports 3 are similarly attached to a single one of the members 9 or column 10. Further, the top of ceiling 15 plate has other holes therein and other screws for the attachment of the members 9 and column 10 using supports 3.

Likewise, the four bottom supports 3 each have a hole (threaded) therein for a single corresponding threaded hole of a plurality of holes (typically four) within base 16 attached together using a single screw 7 from a plurality of screws. Each screw 7 at bottom enters a single hole in the base 16 from the top thereof and on into a single threaded hole in a corresponding support 3 welded to a column 10 or member 9; it should be understood from the drawing that the four bottom supports 3 are placed underneath the base 16 in contradistinction with the supports above the ceiling 16. The other connections are made similarly using a single support 3, a single screw 7, a hole in base 16.

At an inwardly facing top portion of each member 9 and the column 10 is a single welded joint 1 (four); similarly, at an inwardly facing bottom portion of each member 9 and column 10 is a single welded joint 1 (four). These joints 1 at top are attached using a hole in each joint 1 to a corresponding second attachment (second dual holes) in an arm 8 with a barrel and screw fastener 4. Thus, at top there are four separate arms 8 attached to four separate joints 1 using four barrel and screw fasteners 4. The four arms 8 are thusly disposed to meet and attach to a central pivot 2 using a first first attachment (first dual holes) in the arms and four holes in four wings of the pivot 2; this thereby uses a separate barrel 5 and screw 6 combination for each arm 8 to pivot 2 attachment. These joints 1 at bottom are attached using a hole in each joint 1 to a corresponding second attachment (second dual holes) in an arm 8 with a barrel and screw fastener 4. Thus, at bottom there are four separate arms 8 attached to four separate joints 1 using four barrel and screw fasteners 4. The four arms 8 are thusly disposed to meet and attach to a central pivot 2 using a first attachment (first dual holes) in the arms and four holes in four wings of the pivot 2 thereby using a separate barrel 5 and screw 6 combination for each arm 8 to pivot 2 attachment.

It should be apparent from the drawing that the top folding assembly of arms 8, pivot 2, joints 1 and fasteners are disposed above the ceiling 15 whilst the bottom folding assembly of arms 8, pivot 2, joints 1 and fasteners are disposed below the base 16.

Figure 4B:
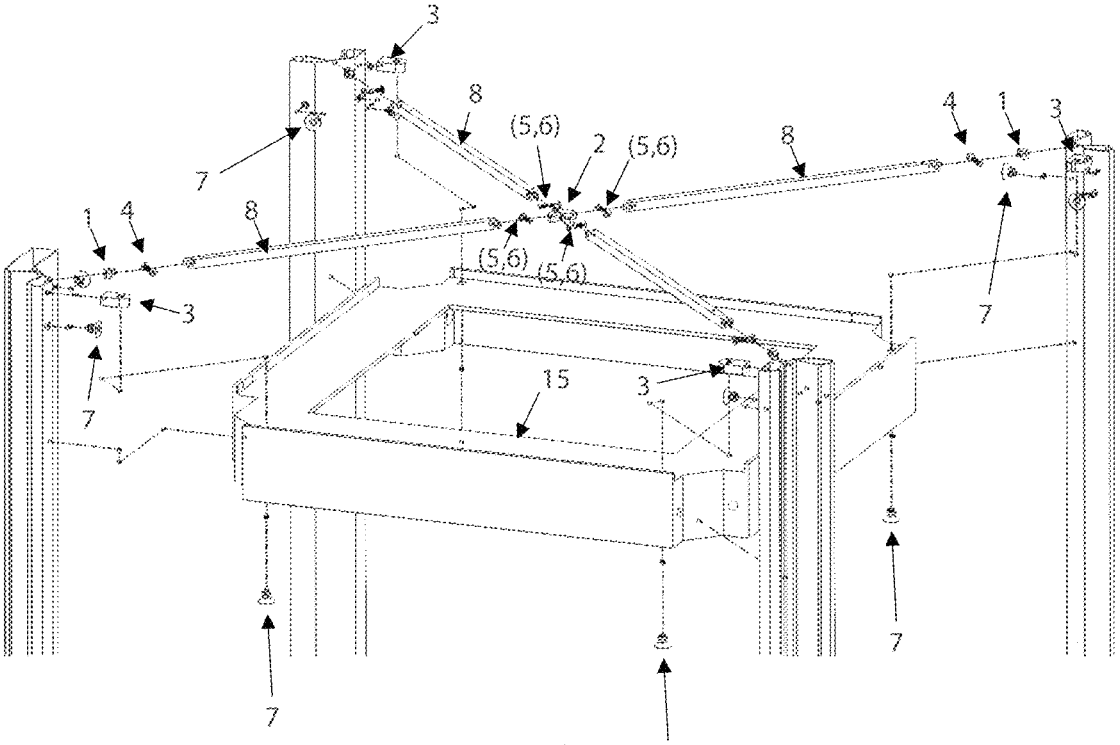
FIG. 4B presents a front isometric view of the top portion of a foldable elevator cabin structure in a first embodiment disclosed herein.
Figure 4C:
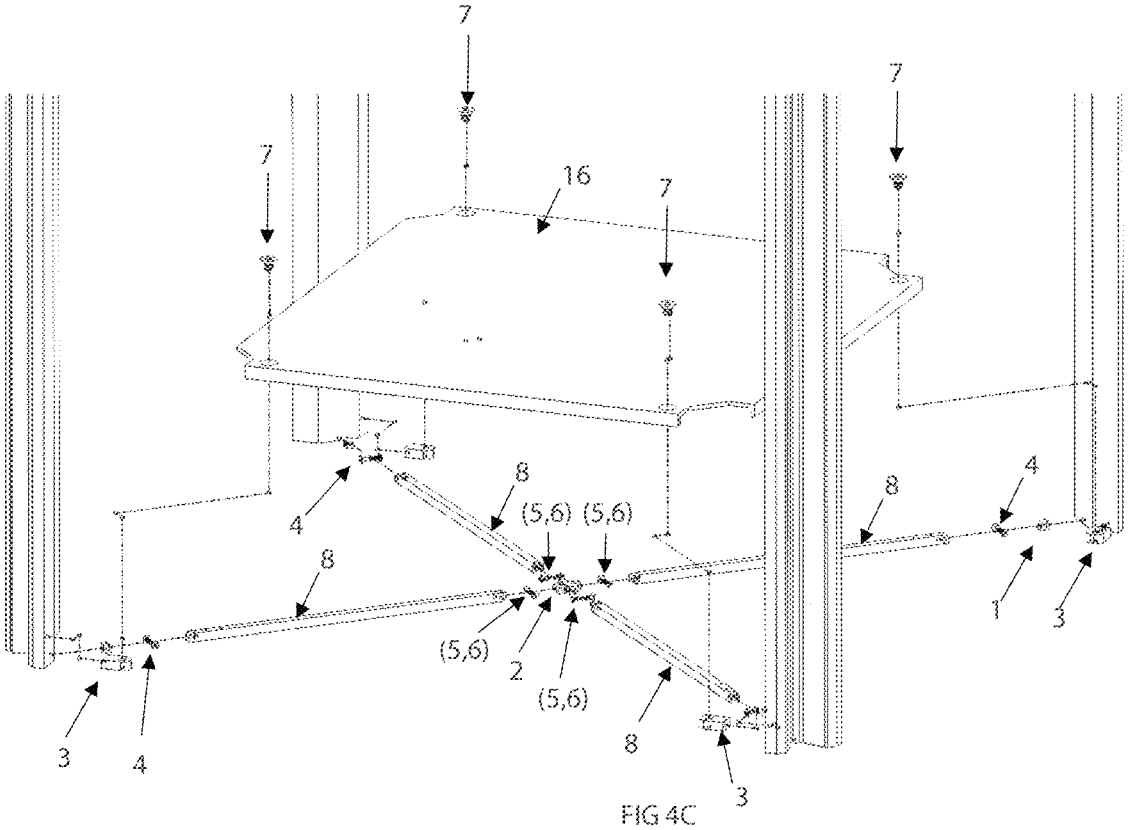
FIG. 4C presents a front isometric view of the bottom portion of a foldable elevator cabin structure in a first embodiment disclosed herein.

FIG. 4B presents a front isometric view of the top portion of a foldable elevator cabin structure in a first embodiment disclosed herein. FIG. 4C presents a front isometric view of the top portion of a foldable elevator cabin structure in a first embodiment disclosed herein. It should be apparent from the drawing that both ceiling 15 and base 16 have depressions in the four corners that match the general pattern of columns 9 and 10 so as to position these for close physical attachment thereto.

Figure 4D:
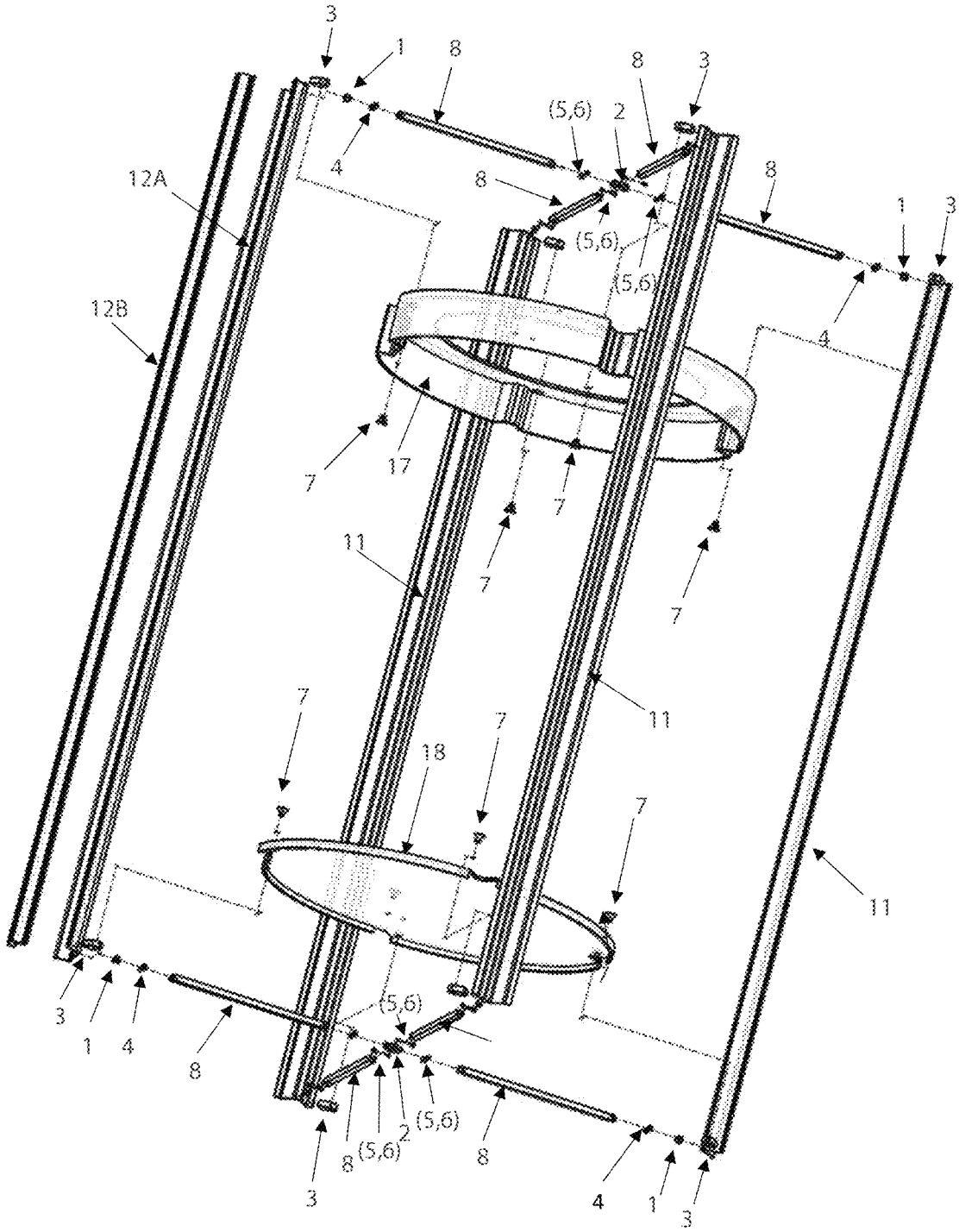
FIG. 4D presents a front isometric view of a foldable elevator cabin structure in a second embodiment disclosed herein.

FIG. 4D presents a front isometric view of a foldable elevator cabin structure in a second embodiment disclosed herein. Three members 11 and a column 12 (made of 12A-12B welded together longitudinally) are attached to a ceiling 17 and a base 18; in this regard, each of the three members 11 and the column 12 (made of 12A-12B welded together longitudinally) have two supports 3 welded to them, one near or at the top of each and one near or at the bottom of each (total of eight 8). Each of these supports 3 has a hole (threaded) therein for insertion of a screw 7 in top support 3 therethrough and on into a corresponding threaded hole in the ceiling 17 plate. At top, the individual support 3 is located above ceiling 17 so that a single hole in the ceiling 17 plate (which has a cutout therein) is concentric with a single hole in the individual support 3. A screw 7 enters from the bottom opening of the single hole in ceiling plate and on into a corresponding hole in the top support 3. The other supports 3 are similarly attached to a single one of the members 11 or column 12. Further, the top of ceiling 17 plate has other holes therein and other screws for the attachment of the members 11 and column 12 using supports 3.

Likewise, the four bottom supports 3 each have a hole (threaded) therein for a single corresponding threaded hole of a plurality of holes (typically four) within base 18 attached together using a single screw 7 from a plurality of screws. Each screw 7 at bottom enters a single hole in the base 18 from the top thereof and on into a single threaded hole in a corresponding support 3 welded to a column 12 or member 11; it should be understood from the drawing that the four bottom supports 3 are placed underneath the base 18 in contradistinction with the supports above the ceiling 17. The other connections are made similarly using a single support 3, a single screw 7, a hole in base 18.

At an inwardly facing top portion of each member 11 and the column 12 (made of 12A-12B) is a single welded joint 1 (four); similarly, at an inwardly facing bottom portion of each member 11 and column 12 is a single welded joint 1 (four). These joints 1 at top are attached using a hole in each joint 1 to a corresponding second attachment (second dual holes) in an arm 8 with a barrel and screw fastener 4. Thus, at top there are four separate arms 8 attached to four separate joints 1 using four barrel and screw fasteners 4. The four arms 8 are thusly disposed to meet and attach to a central pivot 2 using first attachment (first dual holes) in the arms and four holes in four wings of the pivot 2 thereby using a separate barrel 5 and screw 6 combination for each arm 8 to pivot 2 attachment. These joints 1 at bottom are attached using a hole in each joint 1 to a corresponding second attachment (second first dual holes) in an arm 8 with a barrel and screw fastener 4. Thus, at bottom there are four separate arms 8 attached to four separate joints 1 using four barrel and screw fasteners 4. The four arms 8 are thusly disposed to meet and attach to a central pivot 2 using first attachment (first dual holes) in the arms and four holes in four wings of the pivot 2 thereby using a separate barrel 5 and screw 6 combination for each arm 8 to pivot 2 attachment.

It should be apparent from the drawing that the top folding assembly of arms 8, pivot 2, joints 1 and fasteners are disposed above the ceiling 17 whilst the bottom folding assembly of arms 8, pivot 2, joints 1 and fasteners are disposed below the base 18.

Figure 4E:
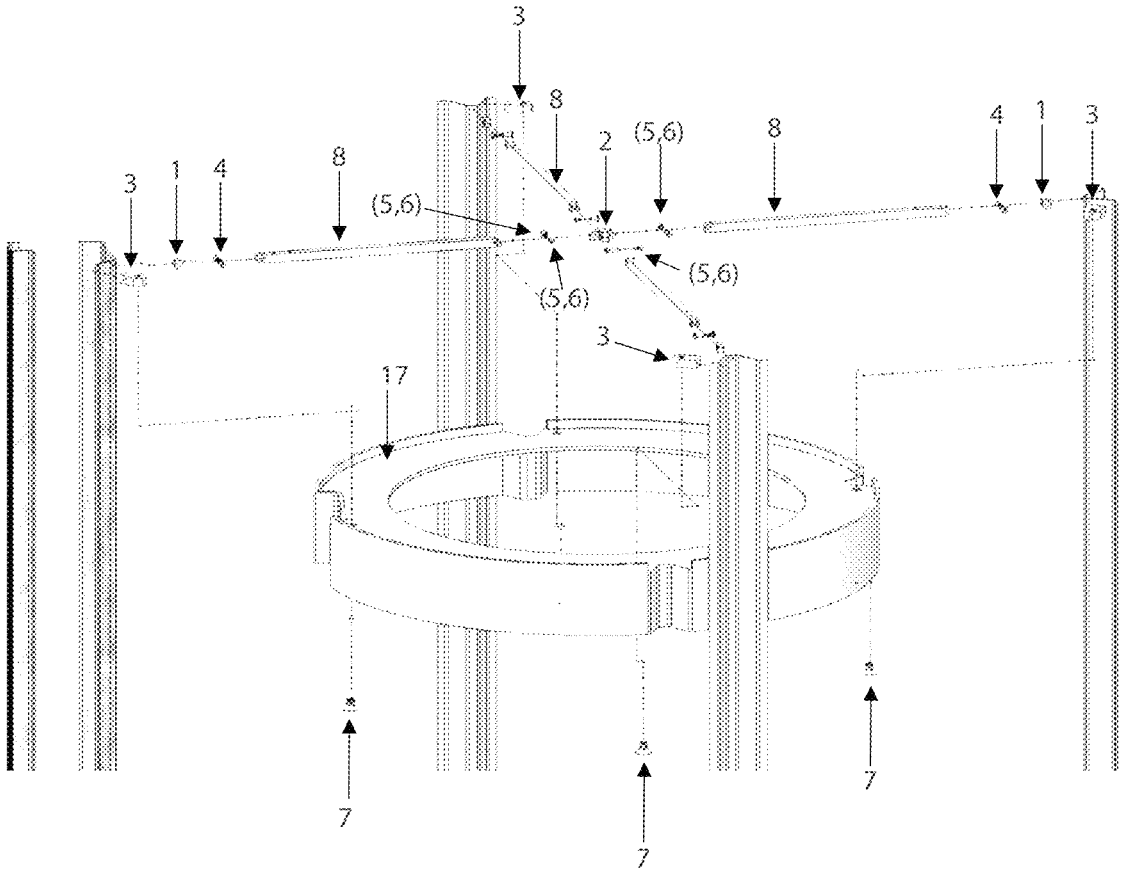
FIG. 4E presents a front isometric view of the top portion of a foldable elevator cabin structure in a second embodiment disclosed herein.
Figure 4F:
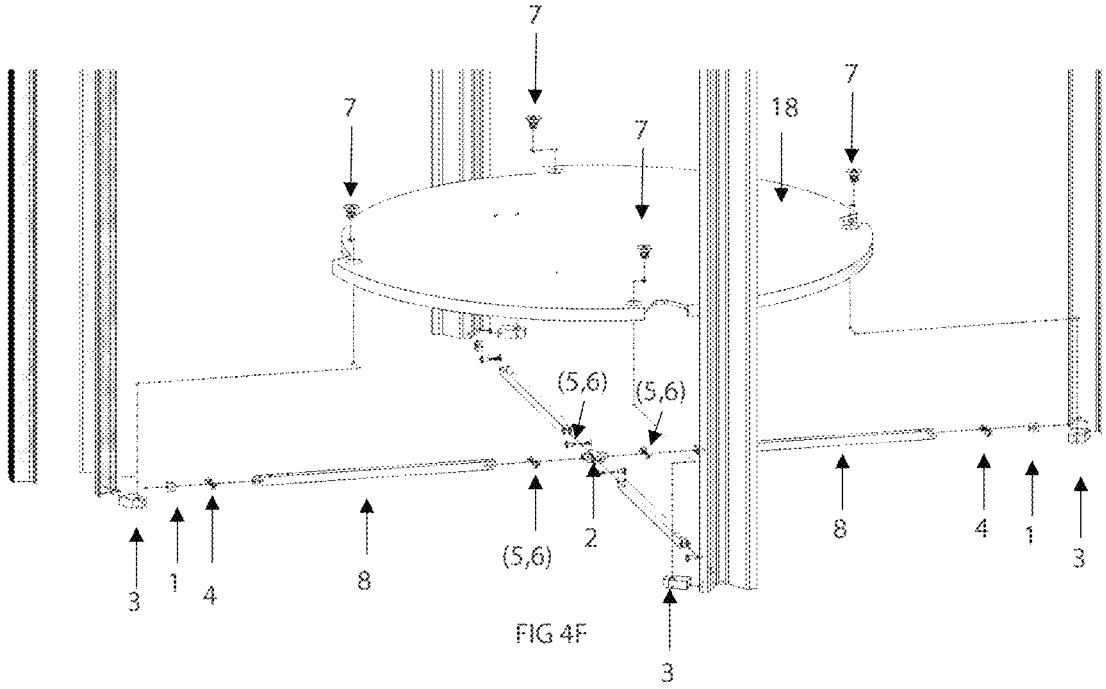
FIG. 4F presents a front isometric view of the bottom portion of a foldable elevator cabin structure in a second embodiment disclosed herein.

FIG. 4E presents a front isometric view of the top portion of a foldable elevator cabin structure in a second embodiment disclosed herein. FIG. 4F presents a front isometric view of the bottom portion of a foldable elevator cabin structure in a second embodiment disclosed herein. It should be apparent from the drawing that both ceiling 17 and base 18 have depressions in the four corners that match the general pattern of column 12 and members 11 so as to position these for close physical attachment thereto.

Figure 4G:
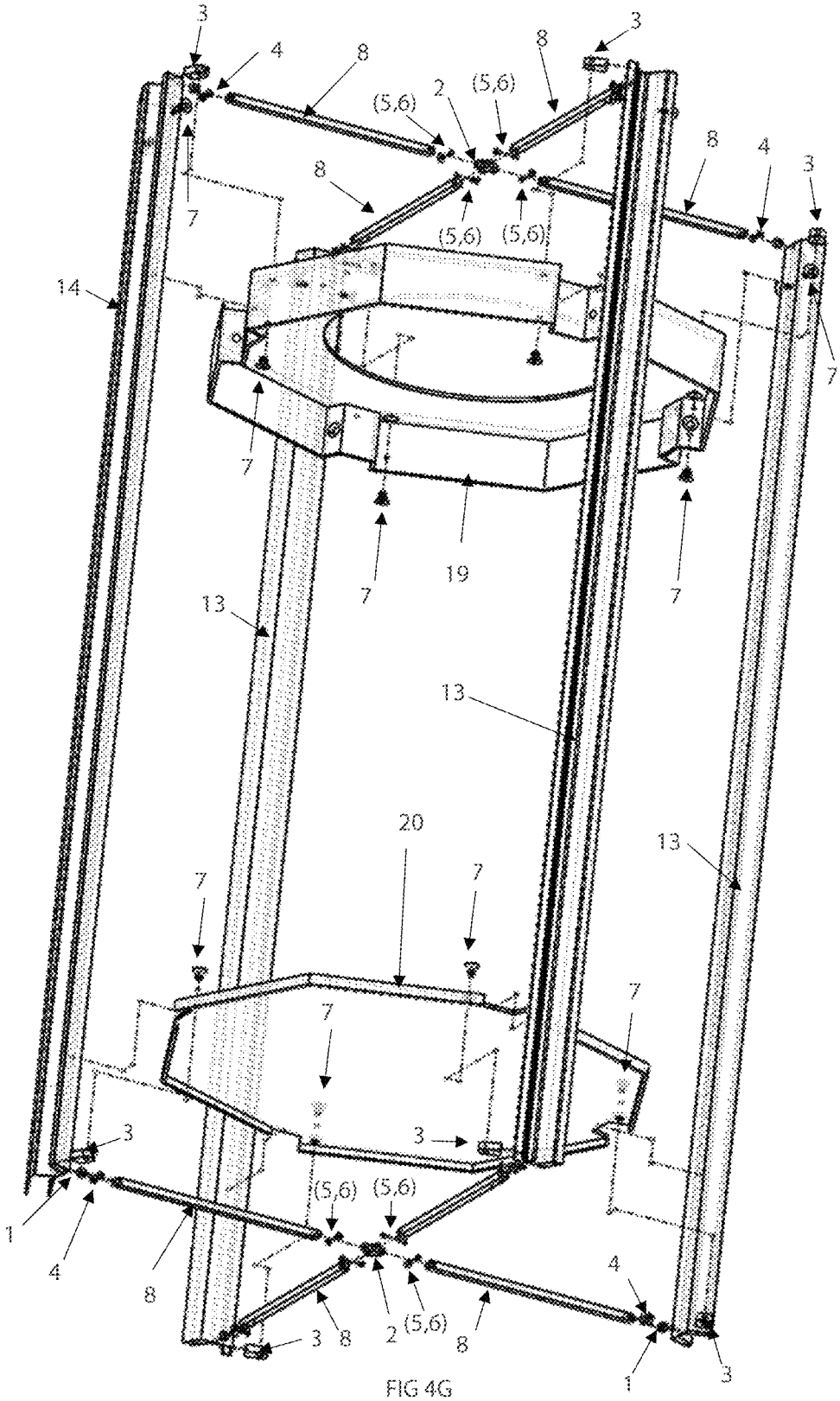
FIG. 4G presents a front isometric view of a foldable elevator cabin structure in a third embodiment disclosed herein.

FIG. 4G presents a front isometric view of a foldable elevator cabin structure in a third embodiment disclosed herein. Three members 13 and a column 14 are attached to a ceiling 19 and a base 20; in this regard, each of the three members 13 and the column 14 have two supports 3 welded to them, one near or at the top of each and one near or at the bottom of each. Each of these supports 3 has a threaded hole therein for insertion of a screw 7 therethrough and on into a corresponding threaded hole for the top support 3 attached to the ceiling 19 plate or surface as described in the following. At top, the individual support 3 is located above ceiling 19 so that a single hole in the ceiling 19 plate (which has a cutout therein) is concentric with a single hole in the individual support 3. A screw 7 enters from the bottom opening of the single hole in ceiling plate and on into a corresponding hole in the top support 3. The other supports 3 are similarly attached to a single one of the members 13 or column 14. Further, the top of ceiling 19 plate has other holes therein and other screws for the attachment of the members 13 and column 14 using supports 3.

Likewise, the four bottom supports 3 each have a hole (threaded) therein for a single corresponding threaded hole of a plurality of holes (typically four) within base 20 attached together using a single screw 7 from a plurality of screws. Each screw 7 at bottom enters a single hole in the base 20 from the top thereof and on into a single threaded hole in a corresponding support 3 welded to a column 14 or member 13; it should be understood from the drawing that the four bottom supports 3 are placed underneath the base 20 in contradistinction with the supports above the ceiling 19. The other connections are made similarly using a single support 3, a single screw 7, and a single hole in base 20.

At an inwardly facing top portion of each member 13 and the column 14 is a single welded joint 1 (four); similarly, at an inwardly facing bottom portion of each member 13 and column 14 is a single welded joint 1 (four). These joints 1 at top are attached using a hole in each joint 1 to a corresponding second attachment (dual holes) in an arm 8 with a barrel and screw fastener 4. Thus, at top there are four separate arms 8 attached to four separate joints 1 using four barrel and screw fasteners 4. The four arms 8 are thusly disposed to meet and attach to a central pivot 2 using a first attachment (dual holes) in the arms and four holes in four wings of the pivot 2 thereby using a separate barrel 5 and screw 6 combination for each arm 8 to pivot 2 attachment. These joints 1 at bottom are attached using a hole in each joint 1 to a corresponding second attachment (dual holes) in an arm 8 with a barrel and screw fastener 4. Thus, at bottom there are four separate arms 8 attached to four separate joints 1 using four barrel and screw fasteners 4. The four arms 8 are thusly disposed to meet and attach to a central pivot 2 using a first attachment (dual holes) in the arms and four holes in four wings of the pivot 2 thereby using a separate barrel 5 and screw 6 combination for each arm 8 to pivot 2 attachment. It should be apparent from the drawing that the top folding assembly of arms 8, pivot 2, joints 1 and fasteners are disposed above the ceiling 19 whilst the bottom folding assembly of arms 8, pivot 2, joints 1 and fasteners are disposed below the base 20.

Figure 4H:
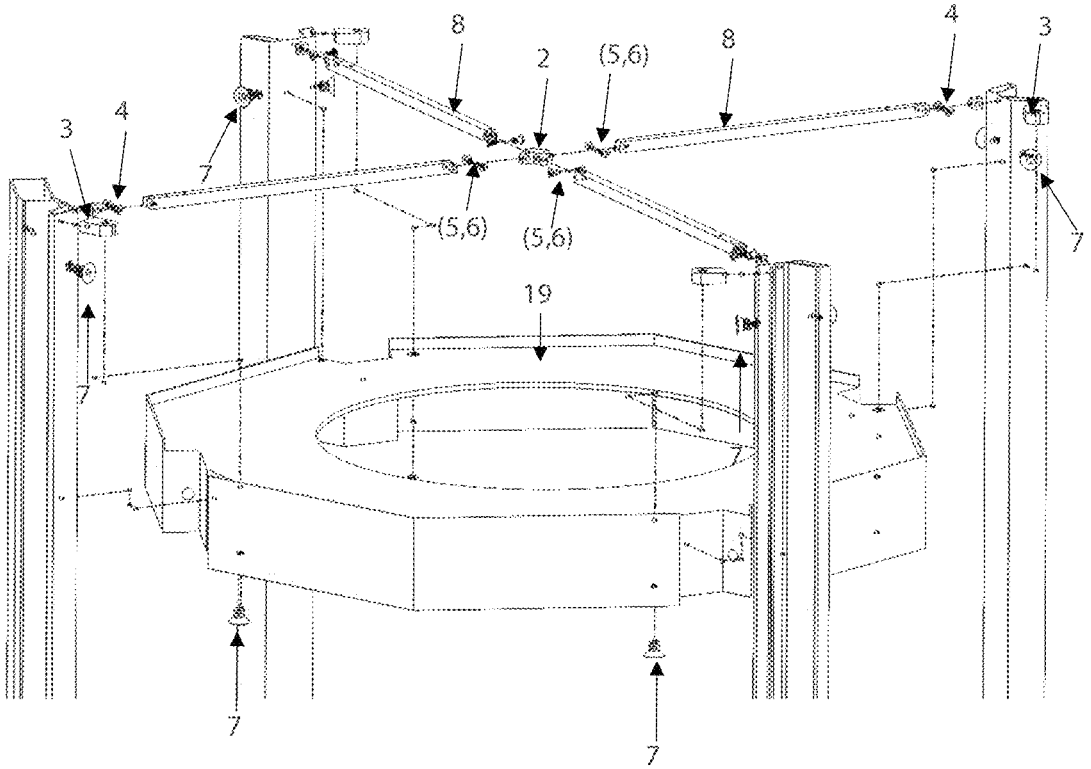
FIG. 4H presents a front isometric view of the top portion of a foldable elevator cabin structure in a third embodiment disclosed herein.
Figure 4I:
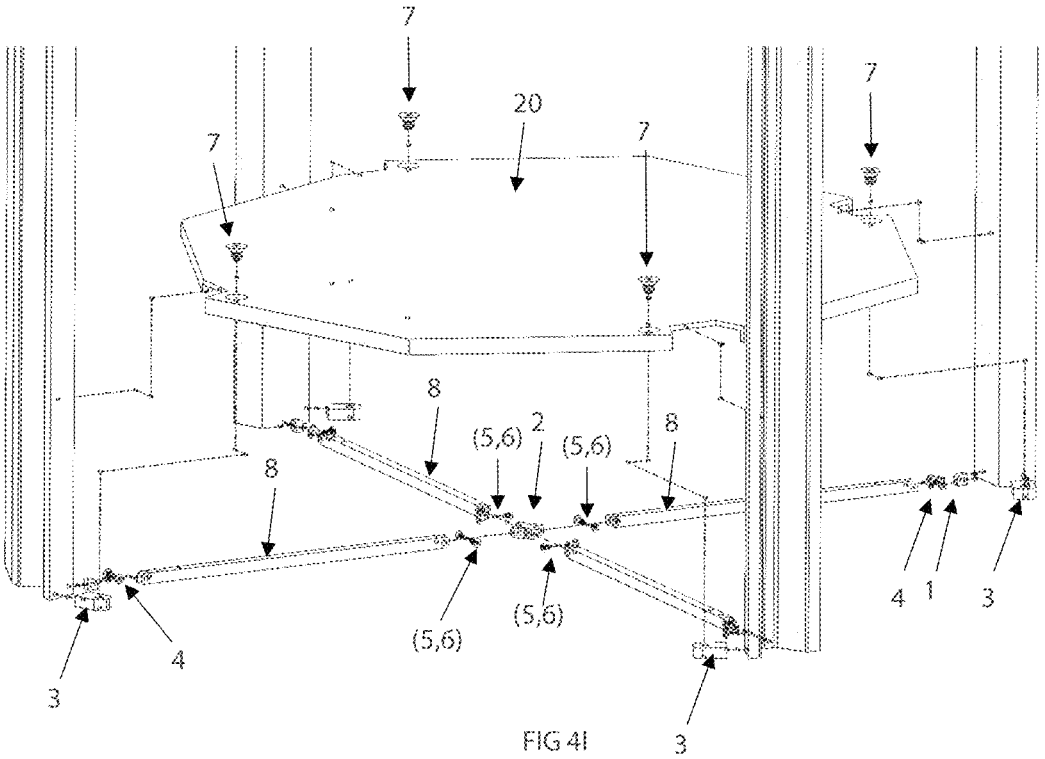
FIG. 4I presents a front isometric view of the bottom portion of a foldable elevator cabin structure in a third embodiment disclosed herein.

FIG. 4H presents a front isometric view of the top portion of a foldable elevator cabin structure in a third embodiment disclosed herein. FIG. 4I presents a front isometric view of the bottom portion of a foldable elevator cabin structure in a third embodiment disclosed herein. It should be apparent from the drawing that both ceiling 19 and base 20 have depressions in the four corners that match the general pattern of column 14 and members 13 so as to position these for close physical attachment thereto.

Figure 5A:
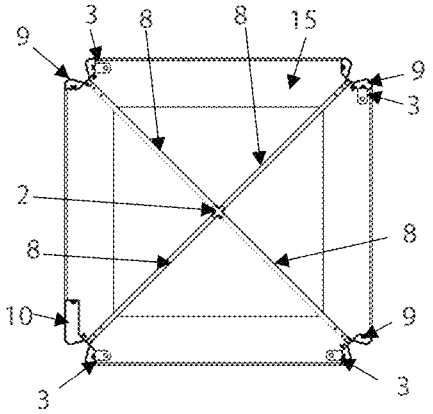
FIG. 5A presents a top view of a foldable elevator cabin structure in an first embodiment disclosed herein.

FIG. 5A presents a top view of a foldable elevator cabin structure in an first embodiment disclosed herein. Here four arms 8 are each connected to a pivot 2 using a first attachment (dual holes) in each arm 8 first end and a corresponding one of four holes in the pivot 2. The second attachment (dual holes) end of each arm is connected to a single one of a column 10 or member 9. A column 10 and a member 9 each have one of four supports 3 welded thereto; these supports 3 have a hole therein for a screw to connect the ceiling to the supports 3 using four threaded holes (one for each support 3) in the top portion of the ceiling.

Figure 5B:
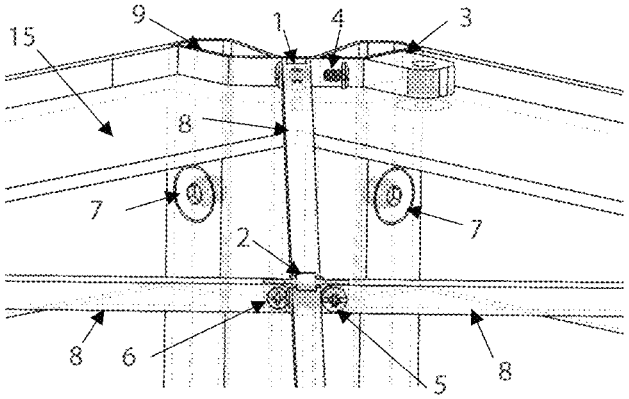
FIG. 5B presents a closeup isometric top view of a portion of the foldable elevator cabin structure in a first embodiment disclosed herein.

FIG. 5B presents a closeup isometric top view of a portion of the foldable elevator cabin structure in a first embodiment disclosed herein. Here the ceiling 15 is attached to a member 9 (the other members 9 and column 10 are similarly attached to the ceiling 15) using two screws 7 placed within two holes located within a matching attachment structure in the ceiling 15; here one hole on the left of the attachment structure and the other on the right of the attachment structure; it should be understood that the member 9 and column 10 are shaped to fit into depressions or spaces in the ceiling and the base for the respective design. As before, there are a pivot 2 attachment at center to the four arms 8 wherein each is attached using barrel 5 and screw 6 fasteners. Each arm is also attached to a single one of the members 9 or column 10 using barrel and screw collectively 4 fasteners. Also, another screw 7 attaches the member 9 (or column 10) through welded support 3 to the top of ceiling 15 using a threaded hole therein.

Figure 6A:
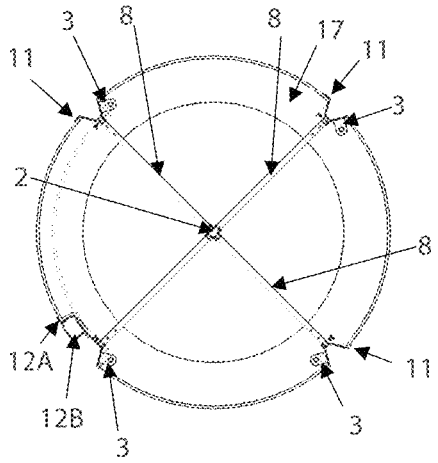
FIG. 6A presents a top view of a foldable elevator cabin structure in an second embodiment disclosed herein.

FIG. 6A presents a top view of a foldable elevator cabin structure in an second embodiment disclosed herein. Here four arms 8 are each connected to a pivot 2 using a first attachment (dual holes) in each arm 8 first end and a corresponding one of four holes in the pivot 2. The second attachment (dual holes) end of each arm is connected to a single one of a column 12 (12A-12B) or member 11. A column 12 (12A-12B) and a member 11 each having one of four supports 3 welded thereto; these supports 3 have a hole therein for a screw to connect the ceiling to the supports 3 using four threaded holes (one for each support 3) in the top portion of the ceiling.

Figure 6B:
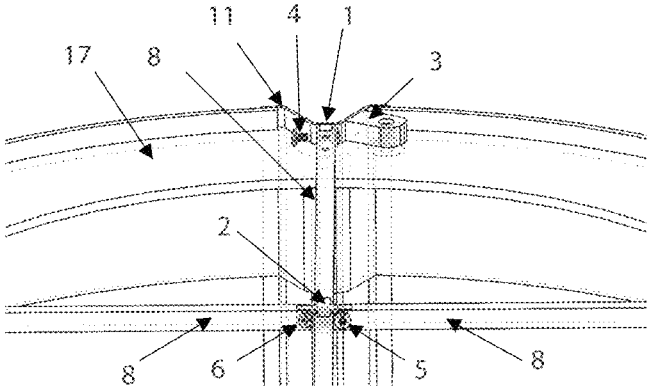
FIG. 6B presents a closeup isometric top view of a portion of the foldable elevator cabin structure in a second embodiment disclosed herein.

FIG. 6B presents a closeup isometric top view of a portion of the foldable elevator cabin structure in a second embodiment disclosed herein. Here the ceiling 17 is attached to a member 11 (the other members 11 and column 12 are similarly attached to the ceiling 17) using two screws 7 placed within two holes located within a matching attachment structure in the ceiling 17; here one hole on the left of the attachment structure and the other on the right of the attachment structure. As before, there are a pivot 2 attachment at center to the four arms 8 wherein each is attached using barrel 5 and screw 6 fasteners. Each arm is attached to a single one of the members 11 or column 12 using barrel and screw collectively 4 fasteners. Also, another screw 7 attaches the member 11 (or column 12) through welded support 3 to the top of ceiling 17 using a threaded hole therein.

Figure 7A:
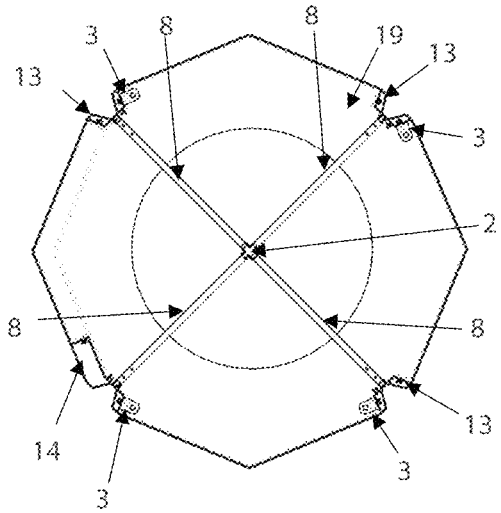
FIG. 7A presents a top view of a foldable elevator cabin structure in an third embodiment disclosed herein.

FIG. 7A presents a top view of a foldable elevator cabin structure in an third embodiment disclosed herein. Here four arms 8 are each connected to a pivot 2 using a first attachment (dual holes) in each arm 8 first end and a corresponding one of four holes in the pivot 2. The second attachment (dual holes) end of each arm is connected to a single one of a column 14 or member 13. A column 14 and a member 13 each having one of four supports 3 welded thereto; these supports 3 have a hole therein for a screw to connect the ceiling to the supports 3 using four threaded holes (one for each support 3) in the top portion of the ceiling.

Figure 7B:
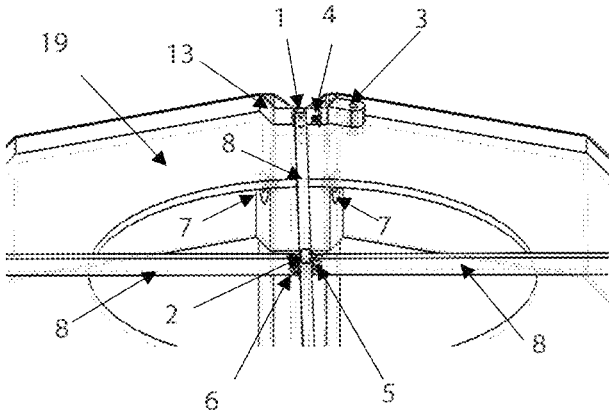
FIG. 7B presents a closeup isometric top view of a portion of the foldable elevator cabin structure in a third embodiment disclosed herein.

FIG. 7B presents a closeup isometric top view of a portion of the foldable elevator cabin structure in a third embodiment disclosed herein. Here the ceiling 19 is attached to a member 13 (the other members 13 and column 14 are similarly attached to the ceiling 19) using two screws 7 placed within two holes located within a matching attachment structure in the ceiling 19; here one hole on the left of the attachment structure and the other on the right of the attachment structure. As before, there are a pivot 2 attachment at center to the four arms 8 wherein each is attached using barrel 5 and screw 6 fasteners. Each arm is attached to a single one of the members 13 or column 14 using barrel and screw collectively 4 fasteners. Also, another screw 7 attaches the member 13 (or column 14) through welded support 3 to the top of ceiling 19 using a threaded hole therein.

Figure 8A:
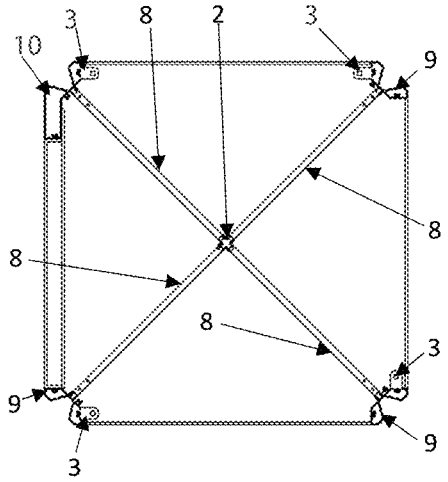
FIG. 8A presents a bottom view of a foldable elevator cabin structure in an first embodiment disclosed herein. FIG.

FIG. 8A presents a bottom view of a foldable elevator cabin structure in an first embodiment disclosed herein. As before, there are pivot 2 attachments at center to the four arms 8 wherein each is attached using barrel 5 and screw 6 fasteners to the pivot 2. Each arm is attached to a single one of the column 10 (or members 9) using barrel and screw fasteners collectively 4. Also, another one of a set of screws 7 attaches the column 10 (or members 9) through a support 3 welded to column 10 (or other supports 3 welded to members 9) to the bottom of base 16 using a threaded hole therein. At left in the figure is a cutout in the base serving to position the column 10.

Figure 8B:
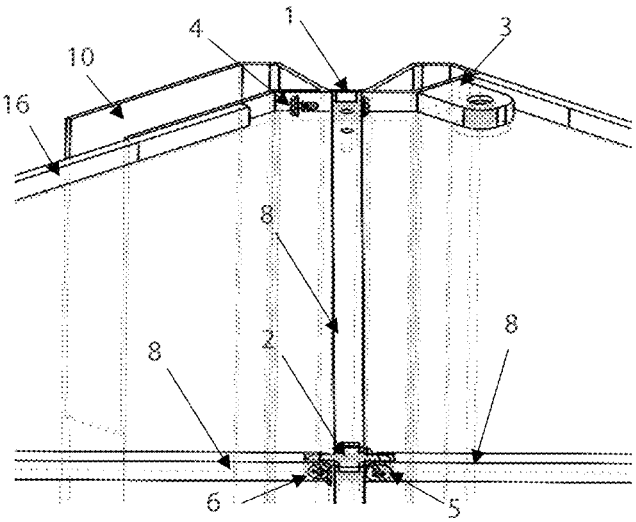

FIG. 8B presents a closeup isometric bottom view of a portion of the foldable elevator cabin structure in a first embodiment disclosed herein. As before, there are pivot 2 attachments at center to the four arms 8 wherein each is attached using barrel 5 and screw 6 fasteners to the pivot 2. Each arm is attached to a single one of the column 10 (or members 9) using barrel and screw collectively 4 fasteners. Also, another one of a set of screws 7 attaches the column 10 (or members 9) through a support 3 welded to column 10 (or other supports 3 welded to members 9) to the bottom of base 16 using a threaded hole therein.

FIG. 9A presents a bottom view of a foldable elevator cabin structure in an second embodiment disclosed herein. As before, there are pivot 2 attachments at center to the four arms 8 wherein each is attached using barrel 5 and screw 6 fasteners to the pivot 2. Each arm is attached to a single one of the column 12 (12A-12B) (or members 11) using barrel and screw collectively 4 fasteners. Also, another one of a set of screws 7 attaches the column 12 (or members 11) through a support 3 welded to column 12 (or other supports 3 welded to members 11) to the bottom of base 18 using a threaded hole therein. At left in the figure is a cutout in the base serving to position the column 12 (12A-12B).

FIG. 9B presents a closeup isometric bottom view of a portion of the foldable elevator cabin structure in a second embodiment disclosed herein. As before, there are pivot 2 attachments at center to the four arms 8 wherein each is attached using barrel 5 and screw 6 fasteners to the pivot 2. Each arm is attached to a single one of the column 12 (12A-12B) (or members 11) using barrel and screw collectively 4 fasteners. Also, another one of a set of screws 7 attaches the column 12 (or members 11) through a support 3 welded to column 12 (or other supports 3 welded to members 11) to the bottom of base 18 using a threaded hole therein.

FIG. 10A presents a bottom view of a foldable elevator cabin structure in an third embodiment disclosed herein. As before, there are pivot 2 attachments at center to the four arms 8 wherein each is attached using barrel 5 and screw 6 fasteners to the pivot 2. Each arm is attached to a single one of the column 14 (or members 13) using barrel and screw collectively 4 fasteners. Also, another one of a set of screws 7 attaches the column 14 (or members 13) through a support 3 welded to column 14 (or other supports 3 welded to members 14) to the bottom of base 20 using a threaded hole therein. At left in the figure is a cutout in the base serving to position the column 14.

FIG. 10B presents a closeup isometric bottom view of a portion of the foldable elevator cabin structure in a third embodiment disclosed herein. As before, there are pivot 2 attachments at center to the four arms 8 wherein each is attached using barrel 5 and screw 6 fasteners to the pivot 2. Each arm is attached to a single one of the column 14 (or members 13) using barrel and screw collectively 4 fasteners. Also, another one of a set of screws 7 attaches the column 14 (or members 13) through a support 3 welded to column 13 (or other supports 3 welded to members 14) to the bottom of base 20 using a threaded hole therein.

FIG. 11A presents an isometric view of an OPEN POSITION of a portion of a foldable elevator cabin structure; this represents most particularly the frame of the foldable elevator cabin structure. Once created at a manufacturer's facility, a finished foldable elevator cabin structure frame is tested and placed into an OPEN POSITION. To prepare the frame for transport a user pulls down the top assembly and pulls up on the bottom assembly and pushes inwards from one or more sides thereby causing motion towards the center of the frame. FIG. 11B presents an isometric view of a HALF OPEN POSITION of a portion of a foldable elevator cabin structure. After the user has moved the frame as indicated in FIG. 11A the frame is in this HALF-OPEN POSITION. The user then continues the same procedure, in other words, a user pulls down the top assembly and pulls up on the bottom assembly and pushes inwards from one or more sides thereby causing motion towards the center of the frame. FIG. 11C presents an isometric view of a CLOSED POSITION of a portion of a foldable elevator cabin structure.

FIG. 12A presents an assembled view of the second embodiment. In this figure is shown once again the pivot 2 attachment of four arms 8 above ceiling 17 and the attachment of the arms to the various member 11, and column 12. Further, it shows how the ceiling 17 is attached to supports 3 situated above the ceiling 17. Also, at bottom this view shows how the base 18 is attached above supports 3; additionally, it shows how the four arms in the bottom assembly are attached underneath the base 18 as they are shown in dotted invisible lines. FIG. 12B presents a section assembled view of the second embodiment disclosed herein. It should be apparent from FIG. 1A-4I and the other preceding drawings that there are three embodiments shown having a square, circular and octagonal configuration. FIG. 12A-12B illustrate a circular configuration.

FIG. 12B presents a portion of the foldable elevator cabin structure in a circular embodiment disclosed herein. The figure shows how two members 11 attach to the ceiling 17 and the base 18 while also attached together through a pivot 2 using two arms 8 each attached together through the pivot 2 and also attached to a single one of the members 11. The ceiling 17 is shown cut in half so that the ceiling 17 is attached to the members 11 using two screws 7 through separate holes in separate supports 3; this such that one screw 7 goes through a hole in one support 3 to a hole in top portion of the ceiling 17 and the other screw 7 goes through another support hole on into another hole in the top portion of the ceiling 17.

A base 18 is shown as if cut in half having a second set of arms 8 underneath the base that are attached using a second pivot and such that the second set of arms are attached as described previously to the bottom of the members 11. Two screws 7 are shown one attached through a hole in the base 18 to a support 3 having a hole therein and the other likewise attached through another hole in the base 18 to a support 3 having another hole therein.

FIG. 13A presents an isometric view of a frame for the foldable cabin structure taught in an embodiment herein. The frame as was discussed previously is formed with three vertical members 11 and a vertical column 12. These are centrally attached together at top and bottom using two folding assemblies, one assembly for the top and one for the bottom. Each of the assemblies is formed as follows. The four arms 8 are attached to a pivot 2. Then three arms 8 are each attached to a single one of the members 11, and the last arm is attached to the column 12; the attachment to 11 and 12 is through the use of four joints 1 where there is a single joint that is welded (these are disposed inwardly towards the central part of the frame as defined by a centerline between the two pivots when viewed from the top in the figure) to a top (or bottom) portion of the column 12, and three others one per top (or bottom) portion of members 11 for this purpose; this joint 1 is a slab of material having a hole therein for this attachment. There are also various supports 3 that are disposed about the periphery of the frame.

FIG. 13B presents a closeup view of a central portion of a folding assembly for the foldable cabin structure taught in an embodiment herein. The central portion of the folding assembly has a pivot 2 attaching four arms 8 thereto using four holes in the cross shaped pivot 2. A barrel 5 and screw 6 combination are placed in through the end of a given arm 8 whilst the end of a given arm has its two end holes aligned with the hole in the pivot 2. By engagement together with screw 6 within barrel 5 the aforementioned are held together and the other arms 8 are similarly attached.

FIG. 13C presents a closeup view of the connection between a bottom portion of a column 12 for the foldable cabin structure taught in an embodiment herein. Here there is shown a support 3 which is a slab of material welded to an appropriate bottom portion of column 12. This support 3 has a hole therein such that a screw 7 is placed within a hole in the base 18 and on into the threaded hole in support 3. Similar supports are present on bottom portions of the members 11 and top portions of members 11 and column 12. A barrel and screw collectively 4 are attached together through an end of member 8 (having 2 holes at its end for this purpose) also using a concentric hole in joint 1 welded to the bottom portion of the column 12.

FIG. 14A presents a HALF OPEN POSITION of a frame structure in an embodiment disclosed herein. Here are shown both the top assembly and the bottom assembly. These are formed as follows: the pivot 2 is attached to four movable arms 8 attached thereto; in turn these arms 8 are attached to a single one of: the members 11 or the column 12 using a joint 1 (of a plurality thereof) welded to a top portion of members 11 or column 12. Similarly, the bottom assembly is formed as follows: the pivot 2 is attached to four movable arms 8 attached thereto; in turn these arms 8 are attached to a single one of: the members 11 or the column 12 using a joint (of a plurality thereof) 1 welded to a bottom portion of members 11 or column 12. An opening 12A in column 12 is shown for cabin electrical cabling that is place therein. Various supports 3 are shown attached to both the top and bottom of members 11, and column 12 for attachment of the ceiling to the top thereof or the base to the bottom thereof.

FIG. 14B presents a closeup view of the top folding assembly as attached to two members in an embodiment disclosed herein. This top folding assembly is designed to fold downwards and as described before has a central pivot 2 having a cross shape with four wings of the cross having four holes one through each wing. These holes are used to attach the four arms 8 thereto. The other ends of the arms each have two concentric holes utilized to attach to different joints 1 welded to the top portions of two members 11. This attachment is through the use of a barrel and screw collectively 4 fasteners threaded through the joint 1 when the two concentric holes of each arm 8 is positioned concentrically with a hole in the corresponding joint 1 welded to a top portion of the respective member 11.

FIG. 14C presents a closeup view of the bottom central folding assembly as attached to a member in an embodiment disclosed herein. This bottom folding assembly is designed to fold upwards and as described before has a central pivot 2 having a cross shape with four wings of the cross having four holes one through each wing. These holes are used to attach the four arms 8 thereto using each arms first attachment (dual holes) to a hole through a single one of the wings of the cross shaped pivot 2 using a barrel 5 with a screw 6. The other ends of the arms 8 each have two concentric holes utilized to attach to a single different joint 1 welded to the top portions of a single column 11. This attachment is through the use of a barrel and screw fastener 4 threaded through the joint 1 when the two concentric holes of arm 8 is positioned concentrically with a hole in the corresponding joint 1 welded to a top portion of the respective column 11. Here there is shown a support 3 which is a slab of material welded to an appropriate bottom portion of column 11. This support 3 has a hole therein such that a screw 7 is placed within a hole in the base 18 and on into the threaded hole in support 3. Similar supports 3 are present on bottom portions of the members 11 and column 12 and top portions of members 11 and column 12.

FIG. 15A presents a CLOSED POSITION of the foldable cabin structure in an embodiment disclosed herein. Here are shown a cabin column 12 having a portion 12A-12B and members 11 attached together using arms 8. Also shown are top and bottom supports 3 welded respectively to top and bottom members 11.

FIG. 15B presents a top view of a folding frame structure in a CLOSED POSITION in an embodiment disclosed herein. This view is rotated ninety degrees clockwise from that found in FIG. 15C. Items 12A-12B are portions forming the electrical conduit of column 12. Here are shown members 11 and column 12 attached together using arms 8 connected to pivot 2 and to four joints 1 attached to the inner top portion of the members 11 and column 12. The three members 11 have a generally V shaped pattern with the opening of the V disposed away from a center of the device from above where the pivot 2 would be. Column 12 is a U shaped device with an electrical passageway attached by welding at right running down it longitudinally. The left side of the U shaped column 12 has a support 3 and other supports 3 are shown on the members 11 top portions of the V shaped surface of member 11 at left in the drawing; this so that the two supports 3 face each other on the external surface of the U and V shape respectively. The bottom V shape member 11 has a support 3 facing the bottom side of the left disposed V shape member 11. Finally the right disposed V shaped member 11 has a support 3 on its bottom surface in the drawings that is directed to the right side of the bottom disposed V shaped member. Barrels and screws 4A-4B collectively 4 are shown to connect the arms to the joints 1.

FIG. 15C presents an OPEN POSITION of the foldable cabin structure in an embodiment disclosed herein. This view is rotated ninety degrees counterclockwise from that found in FIG. 15B.

FIG. 16 presents a joint 1 in an embodiment disclosed herein. The joint 1 has a hole 1B through its body, a flat surface 1C at top meets a curved surface 1A that blends into a flat left vertical surface; it also has a flat back for attachment to members or a column and also has a flat bottom.

FIG. 17 presents a support 3 in an embodiment disclosed herein. The support 3 has a threaded hole 3A for passing from one flat side to the other flat side of the support 3. Also, there is a flat surface 3B at top in the figure for welded attachment to a column or members. The bottom surface of support 3 is generally curved and it blends with right and left side flat surfaces.

FIG. 18 presents a pivot 2 in an embodiment disclosed herein. The pivot 2 has four wings arranged in a plus or cross shape each wing at ninety degrees from the other and has a flat front surface as shown in the front of the image. There are small square shaped protrusions 2A that are shown between each wing of the device; these help position the arms connections to the pivot. The first wing has a hole 2C therein passing through the entirety of the wing and is parallel to the wings which are disposed at ninety degrees to the wing having hole 2C; similarly, the right, left and bottom wings each have corresponding holes 2D, 2B, 2E therethrough. Each wing has a front surface which is flat and blends into a curved shape 2F, 2G, 2I, 2H and then turns down at back and ends in a respective flat surface as it turns back into the center of the pivot 2 completing each separate wing. Thus, each hole centerline is at ninety degrees from the two other nearest centerline holes in the nearest wings.

FIG. 19 presents a barrel and screw 4A-4B collectively 4 in an embodiment disclosed herein. FIG. 20 presents a barrel 5 for the barrel and screw combo 5 & 6 in an embodiment disclosed herein. FIG. 21 presents a flat head screw 6 for the barrel and screw combo 5 & 6 in an embodiment disclosed herein. FIG. 22 presents a flat head hex screw 7 in an embodiment disclosed herein.

FIG. 23A presents an arm 8 in an embodiment disclosed herein. The arm 8 is a longitudinal member having two ends that are curved on a portion of each end thereof. The curved ends are disposed in opposite directions from one another so that they point such that if the top ends front surface has the portion that is curved then the bottom ends back surface will have the portion that is curved. FIG. 23B presents a closeup view of the top portion of an arm 8 through a rotation. Here there are two holes 8D-8E passing through the narrow body of the arm 8. The top portion of the member 8 has two flat raised protrusions each having a hole therein 8B and 8C and a flat space 8F betwixt the protrusions defining their separation. There is also a flat top edge of each protrusion blending into a respective curved edge 8G, 8H in the figure that blends into a respective flat front surface and on into the rest of the member 8 body. FIG. 23C illustrates the bottom portion of member 8 has two downwardly disposed protrusions each having a single hole 8I, 8J in each protrusion. There is also a curved back edge 8K, 8L on each protrusion that blends from the back of the member 8 to a flat surface and ends in an edge at front.

FIG. 24A presents the column 10 having a cabling (elevator equipment) passageway integrally associated therewith in an embodiment disclosed herein. The view also shows two supports 3 for attachment to the ceiling 15 and base 16. FIG. 24B presents a closeup view of the top portion of the column 10 in an embodiment disclosed herein. Starting from the back of the cabin electrical column passageway (hollow down the length of the column 10) at flat portion 10A proceeding at an upwardly disposed angle to the left until integration at an edge with small portion 10F; moving to the left, small portion 10F has another common edge with portion 10G that itself proceeds downwards and to the left at an angle that ends at a weld to the back of portion 10M almost at the midpoint thereof. The front side of portion 10M proceeds a little more to the right and then integrally forms an edge with a portion 10N that parallels the portion 10A and ends at an edge with portion 10E that itself integrates with a starting edge of 10A. Proceeding further (from the end weld of 10G above) to the left along the back portion of 10M is a small portion 10H that integrates along a weld point with an upward and to the left angled portion 10I; this further integrates along an edge with a flat small portion 10J moving to the left that itself integrates with a small portion 10K moving to the left and down angle. Finally, the portion 10K integrates along an edge with portion 10L that returns down and to the right to another edge of portion 10M integrally forming these parts through welds. It should be appreciated that a support 3 is welded to the portion 10L top. Also, there are holes 10B in 10E and 10C in 10L for attachment to a ceiling attachment structure shown in another figure.

FIG. 24C presents a closeup bottom view of the column 10 in an embodiment disclosed herein. Here are shown the continuation of the portions described above regarding 10A, 10E, 10L, 10M, 10N. It should be appreciated that a support 3 is welded to the surface 10L bottom. In FIG. 24B-24C the surfaces 10L, 10M, 10N, 10E match the cutouts in ceiling 15 shown as 15E, 15F in FIG. 30C-D at left. It should be apparent that there is an entryway 10D cutting a passage through portion 10E (typically for cabling, however other equipment, electrical controls and or similar elevator items can also be included).

FIG. 25A presents a member 9 in an embodiment disclosed herein. The view also shows two supports 3 for attachment to the ceiling 15 and base 16. A hole 9B is shown in surface 9A. FIG. 25B presents a closeup view of the top portion of the member 9 in an embodiment disclosed herein. Here the left front portion 9A of the member 9 is disposed at an angle towards the upper left and has a hole 9B therein and proceeds to integrate along an edge with small portion 9D proceeding to the upper right that itself integrates at an edge with small portion 9E proceeding to the lower right. From there, small portion 9E proceeds to integrate at an edge with portion 9F descending down to the right rapidly and welded to the back portion of front portion 9K. This back portion is shown as 9G that proceeds to the right downwards slowly and integrates at a weld on the back of front portion of 9K with a portion 9H proceeding upwards to the right; at this point, 9H integrates at an edge with a portion 9I proceeding to the right and downwards that integrates at an edge with a small portion 9J proceeding right and downwards faster. Small portion 9J integrates with portion 9L at an edge that turns backwards to the left and downwards meeting an edge of front portion 9K; front portion 9K proceeds to the left upwards meeting an edge of left front portion 9A completing the figure. A support 3 is welded to a top of the portion 9L for attachment to a ceiling; there is a hole 9C located on 9L somewhat below the support 3 for screw 7 attachment with an attachment structure of a ceiling along with a screw 7 in hole 9B also attached to the attachment structure of a ceiling.

FIG. 25C presents a closeup bottom view of the member 9 in an embodiment disclosed herein. Left front portion 9A, front portion 9K and portion 9L are shown as well as a support 3 welded to 9L for base 16 attachment. Hole 9B and 9C are used to attach to ceiling 15 through corresponding holes in the ceiling attachment structure. These holes 9B, 9C are repeated in other members 9 for corresponding holes in the ceiling 15 attachment structure. Three members 9 have their front portion 9K situated within three cutouts of the ceiling with 9A and 9L placed for engagement with screws and holes 15C, 15D repeated at three cutouts in the ceiling 15 (FIG. 30C). The ceiling 15 also has a fourth cutout for matching attachment of column 10 at contours 15E-15F in FIG. 30C. The placement of the contours of 10L, 10M, 10N, and 10E are as appropriate to make the aforementioned match.

FIG. 26A presents the column 12 having a passageway for other components of the elevator system integrally associated therewith in an embodiment disclosed herein. At top there is a support 3 for attachment to the ceiling and at bottom there is another support 3 for attachment to a base as previously discussed. FIG. 26B presents two longitudinal portions of column 12 in an embodiment disclosed herein. A first portion 12A is generally U shaped having a flanged first and second end that flare out to the left at left and to the right at right. Within the confines of the U shape the second portion 12B is to be welded thereto as shown more particularly in FIG. 26C.

FIG. 26C presents a closeup top view of the column 12 in an embodiment disclosed herein. At right, there is shown a support 3 having a hole 3A therein for attachment to a ceiling. There is a first portion 12A and second portion 12B of column 12 welded together longitudinally. Starting from the left in the figure, (the first portion 12A) there is a first flange 12AA integrally forms along a common edge with a first small portion 12C moving down sharply and to the right. Then this first small portion 12C integrates along a common edge with a first front portion 12D that moves to the right and slightly upwards. At a common edge, the first front portion 12D integrates with a second front portion 12E that moves to the right and slightly downwards. This second front portion 12E moving to the right integrates along a common edge with a small left portion 12F (left of flange 12G) that bends to the right whilst moving up. Finally, this small left portion 12F integrates along a common edge with a flange 12G that flares to the right.

The second portion 12B of the column 12 is shown having a left end bent inwards and attached to the back of the first small portion 12C. This left end integrates along a common edge at top with a first horizontal back portion 12BB that itself integrates along another common edge at right with a small connecting portion 12H moving down and then to the right forming a small bent portion that moves to the right and is welded to the back of second front portion 12E. FIG. 26D presents a closeup bottom view of the column 12 in an embodiment disclosed herein. Here portions 12AA, 12C, 12D, 12E, 12F, 12G are shown; also, there is shown a support 3 having a hole 3A therein for attachment to a base. It should be appreciated that the column 12 is situated within a cutout shown in FIG. 32D near the label 17H as appropriate to make a flush positioning therewith.

FIG. 27A presents a member 11 in an embodiment disclosed herein. The view also shows two supports 3 for attachment to a ceiling and a base. FIG. 27B presents a closeup view of the top portion of the member 11 in an embodiment disclosed herein. Here a left flange 11A moves to the right and integrates along a common edge with a first slanted portion 11B that moves to the right and slanted down in the figure. At this point, the first slanted portion 11B integrates along a common edge with a front portion 11C. The front portion 11C then integrates at an edge with second slanted portion 11D that moves to the right and slanted upwards; the second slanted portion 11D integrates along a common edge with the right flange 11E that flares to the right in the figure. There is a welded support 3 on 11D having a hole 3A for attachment to a ceiling.

FIG. 27C presents a closeup bottom view of the member 11 in an embodiment disclosed herein. Here there is another support 3 welded to 11D with hole 3A for attachment to a base. Also, there are three members 11 that each are separately placed within different cutouts in a ceiling 17. It should be appreciated that the front portion 11C is placed furthest therein with 11B, 11D also flush with the contours of the cutout as shown in FIG. 32C-32D.

FIG. 28A presents the column 14 having a cabling passageway integrally associated therewith in an embodiment disclosed herein. The view also shows two welded supports 3 for attachment to the ceiling 19 and base 20. FIG. 28B presents a closeup view of the top portion of the column 14 in an embodiment disclosed herein. Starting from the back of the cabin cable passageway (hollow down the length of the column 14) we start at flat portion 14A proceeding left at an upwardly disposed angle to integrate at an edge with small portion 14F that proceeds left to integrate at an edge with portion 14G. Portion 14G moves left at a downward angle and ends at a weld to the back of portion 14L almost at the midpoint thereof. The front side of portion 14L proceeds a little more to the right and then integrally forms an edge with a portion 14M that runs down to the right parallel to the portion 14A and ends at an edge with portion 14E that turns up to integrate with a starting edge of 14A. Proceeding further to the left on the back surface of 14L is a small portion 14H that integrates along a weld point with angled portion 14I that itself moves upwards and to the left. This angled portion 14I integrates at an edge with a flat small portion 14J moving to the left that itself integrates at an edge with a portion 14K moving to the right and down; finally, the portion 14K integrates along an edge with front portion 14L that returns to a left end point edge of portion 14M. It should be appreciated that a support 3 is welded to the top of portion 14K for attachment to a ceiling through hole 3A. There is a hole 14C in 14K and a hole 14B in 14E for engagement with a ceiling attachment structure using screws.

FIG. 28C presents a closeup bottom view of the column 14 in an embodiment disclosed herein. Here are shown the continuation of the surfaces described above regarding 14A, 14E, 14L, 14M, 14K. It should be appreciated that a support 3 is welded to the surface 14K bottom for attachment to a base through hole 3A. A passageway or opening 14D is shown for elevator cabling, equipment, controls or similar items. It should be appreciated that the top of column 14 having holes 14B, 14C sits flush with a contoured cutout shown in FIG. 34C, 34D at bottom. Corresponding holes in an engagement structure (shown as a circumferential or perimeter integral with and generally perpendicular to and away from the main plate of the ceiling) are attached together using screws in the respective threaded holes.

FIG. 29A presents a member 13 in an embodiment disclosed herein. A member 13 is shown having a first support 3 welded at top and a second support 3 welded at bottom for screw attachment with a ceiling and base respectively. FIG. 29B presents a closeup view of the top portion of the member 13 in an embodiment disclosed herein. The member 13 has two enclosed portions, one at left and one at right; the left enclosed portion is formed by the portions 13A, 13D, 13E and a small left part of 13I; the right enclosed portion in formed from portions 13G, 13H, 13J and a small right part of 13I. Moving clockwise and starting at the front portion 13I moving to the left, it integrates along a common edge with a left portion 13A that moves up and slanted to the left; left portion 13A integrates along a common edge with small left portion 13D that moves to the right. This small left portion 13D integrates along a common edge with left slanted portion 13E moving down slanted and to the right; left slanted portion 13E integrates along a common edge with a small intermediate portion 13F (that is also a back part of front portion 13I). The small intermediate portion 13F integrates at a common edge with right slanted portion 13G moving to the right and slanted upwards; the right slanted portion 13G integrates along a common edge with a small right portion 13H. This small right portion 13H moves to the right and integrates at a common edge with a right portion 13J moving down and to the left finally integrating with another common edge of the front portion 13I. A first 13B and a second 13C threaded hole (on 13A and 13J respectively) are for screw attachment with a ceiling structure.

FIG. 29C presents a closeup bottom view of the member 13 in an embodiment disclosed herein. Here there is a support 3 with hole 3A for attachment to a base. Three members 13 sit within three identical but separate cutouts in the ceiling 19. There are two holes 19D for engagement using screws with corresponding holes 13B, 13C in the member 13. Portions 13A, 13I, 13J abut the inner surface of the respective cutout as appropriate.

FIG. 30A presents a bottom closeup of a ceiling in an embodiment disclosed herein. The ceiling plate has a hole therein and is integrally formed with an attachment structure 15A. Here is shown a hole 15B in the ceiling plate bottom for attachment to a support 3 using a hole 3A therein. There are three cutouts in three corners of the ceiling 15 having a first and second surface that are at a certain angle with respect to one another and are connected to an angled surface there between; the final cutout in the fourth corner is a unique shape of two indented connected portions 15E-15F designed to match the specific column 10 to this embodiment. The two surfaces that are at a certain angle in orientation each has a single hole 15C, 15D therein for attachment to a member 9 (using threaded holes 9B, 9C) that has the narrow portion of its silhouette inserted in this depression. Also, there is a hole 15B in the ceiling plate for attachment to a support 3 attached to a member 9 using hole 3A therein with screws. A perimeter attachment structure 15A extends away from the ceiling plate (having a hole therein) for attachment using holes 15C, 15D.

FIG. 30B presents a top closeup of a ceiling in an embodiment disclosed herein. There is a hole 15B in the ceiling plate for attachment to a support 3 attached to a member 9 using hole 3A therein with screws; there are also shown holes 15C, 15D for attachment to a member 9 directly using holes 9B, 9C in member 9 using screws. FIG. 30C presents a bottom of a ceiling in an embodiment disclosed herein. This view again shows the central square hole from the bottom of the ceiling in addition to a perimeter attachment structure 15A that is welded to the ceiling plate and runs about the entire edge of the ceiling plate. Of course, as previously described there are cutouts at each of the four corners of the ceiling 15 for attachment points to members 9 and column 10. FIG. 30D presents a top surface ceiling plate having a cutout therein of a ceiling in an embodiment disclosed herein.

FIG. 31A presents a closeup view of a top portion of a base in an embodiment disclosed herein. The base 16 is formed as a generally square sheet 16A of material having a top surface and an integral bottom surface with the top surface; additionally, there is a perimeter material 16D that is welded to and runs at ninety degrees to and about the edge of the sheet 16A of the base 16; except the perimeter is absent at four cutouts 16C disposed at four corners of the base 16. Hole 16B is shown penetrating the sheet for attachment to a support 3 attached to a member or column at bottom. FIG. 31B presents a closeup view of a bottom portion of a base in an embodiment disclosed herein. FIG. 31C presents an isometric view of a bottom portion of a base in an embodiment disclosed herein. The base does not extend to the left side as far as the right side does to make it possible to position the column. This corresponds to the cutout shown in other figures.

FIG. 32A presents a bottom closeup view of a ceiling in an embodiment disclosed herein. Here are shown four holes 17C, 17D, 17E, 17F in a flat sheet of material 17B (having a large central hole therein) of the ceiling 17 for attachment each to one support 3 themselves attached by welding to a column 12 or member 11. There are three V shaped cutouts disposed appropriately about the perimeter in the ceiling 17 perimeter 17A (and portions of the sheet 17B); this perimeter 17A is welded to sheet 17B. The three V shaped cutouts are formed as cutouts in the perimeter 17A and a V shaped bending into the sheet 17B forming two outer sides with a small portion there between; the top edge of the perimeter 17A that extends slightly above the sheet is removed in this area. FIG. 32B presents a top closeup view of a ceiling in an embodiment disclosed herein. FIG. 32C presents a bottom isometric view of a ceiling in an embodiment disclosed herein. FIG. 32D presents a top isometric view of a ceiling in an embodiment disclosed herein. Here is shown a cutout portion 17H for the column 12 particular to this embodiment which is contoured to match this area.

FIG. 33A presents a closeup view of a top portion of a base in an embodiment disclosed herein. The base is composed of a flat sheet 18C of material having a perpendicular perimeter 18A welded to the edge of the sheet 18C and disposed to the bottom portion of the base about most but not all of the sheet 18C. Also, there is a set of holes 18B shown about the sheet 18C for fastener attachment to a support 3 which is itself attached to a lower portion of a member 11 or column 12; the other holes have other fasteners and are attached to the remaining ones of column 12, members 11 that are not yet attached. There are two V shaped triangular cutouts 18D about the sheet 18C that remove a portion of the perimeter 18A at the location of the cutouts. These are for insertion of members 11 therein. FIG. 33B presents a closeup view of a bottom portion of a base in an embodiment disclosed herein. FIG. 33C presents an isometric view of a bottom portion of a base in an embodiment disclosed herein. At top center is a radially shorter section for positioning of the lower portion of column 12 thereto as well as a single member 11. This corresponds to the cutout shown in other figures.

FIG. 34A presents a bottom closeup view of a ceiling in an embodiment disclosed herein. A ceiling 19 has a perimeter 19E welded at ninety degrees to a sheet of material 19A. A large hole is cutout in the center of the sheet of material 19A. Also, there is shown a hole 19B of the several holes in a flat sheet of material 19A for attachment each to one support 3 themselves attached by welding to a column 14 or member 13. There are three U shaped cutouts disposed appropriately about the perimeter in the ceiling 19 perimeter 19E (and portions of the sheet 19A); this perimeter 19E which is welded to sheet 19A. The three U shaped cutouts are formed as depressions in the perimeter 19E bending into the sheet 19A forming two outer sides integrated with a small portion there between; the top edge of the perimeter 19E that extends slightly above the sheet 19A is removed in this area. The U shaped cutouts each have a first hole 19C and second hole 19D for attachment to a single one of members 13 having holes therein with threads for screws.

FIG. 34B presents a top closeup view of a ceiling in an embodiment disclosed herein. FIG. 34C presents a bottom isometric view of a ceiling in an embodiment disclosed herein. The bottom side of the drawing shows an irregular depression. This depression are formed (an irregular M shaped portion attached to the sheet of material 19A) so at to match the column 14 surface pattern as appropriate. FIG. 34D presents a top isometric view of a ceiling in an embodiment disclosed herein.

FIG. 35A presents a closeup view of a top portion of a base in an embodiment disclosed herein. The base is composed of a flat sheet 20A of material having a perpendicular perimeter welded to the edge of the sheet 20A and disposed to the bottom portion of the base about most but not all of the sheet 20A. Also, there is a set of holes 20B, shown about the sheet 20A for fastener attachment to a support 3 which is itself attached to a lower portion of a member 13 or column 14; the other holes 20B have other fasteners and are attached to the remaining ones of column 14, members 13 that are not yet attached. FIG. 35B presents a closeup view of a bottom portion of a base in an embodiment disclosed herein. FIG. 35C presents an isometric view of a bottom portion of a base in an embodiment disclosed herein. At top in the drawing is shown a first base structure having an arrowhead shape made of two sections 20D of the perimeter and sheet 20A; the first section 20D ascends to the right in the figure and meets the second section 20D at a center point; then, the second section 20D descends to the right. What this accomplishes is that the center point of the two portions of this first base structure is the furthest away from the center of the sheet 20A.

This first base structure has a first hole 20B at right in the drawing near the first cutout. This first base structure is repeated with a second base structure at right and a third base structure at left in the figure. The separation between the first and the second base structure is a first U shaped cutout in the sheet 20A and perimeter. The separation between the first and the third base structure is a second U shaped cutout in the sheet 20A and perimeter 20C. The second base structure has a single hole 20B at the bottom of its shape in the figure for attachment as described above. This third base structure has two holes 20B for attachment as described above. The bottom portion of the figure has a fourth base structure with a section 20F having increasing separation from the center of sheet 20A from left to right meeting at a center of the base structure and declining on the other section 20G. It should be readily apparent from the drawing that the fourth base structure is closer to the center of the sheet 20A then the other three base structures. This because the column 14 is situated at bottom which requires more space therewith.

FIG. 36A presents a front view of a foldable shaft structure in a fourth embodiment taught herein. Members 26 are connected together at top and bottom with various pairs of arms 24CC as more fully described below.

FIG. 36B presents an isometric view of a foldable shaft structure in a fourth embodiment taught herein. Four members 26 each have a top and a bottom portion and are disposed vertically; they are connected together with various arms 24CC wherein each arm 24CC has two ends. A first member 26 and a second member 26 are connected together with two pairs of arms 24CC. A first arm 24CC in a pair of arms 24CC is connected to the second arm in the pair at a first end of the first arm 24CC together with a first end of the second arm 24CC in the pair; the second end of a first arm 24CC of the pair of arms 24CC is connected to a first member 26 at the top portion thereof while the second end of the second arm 24CC is connected to a second member 26 at the top portion thereof. Another pair of arms 24CC is likewise attached to the bottom portion of the first member 26 and the bottom portion of the second member 26.

It should then be understood that the top and bottom portions of the first member 26 is similarly attached to the top and bottom portions of a fourth member 26. Likewise, the top and bottom portions of the second member 26 is attached to the top and bottom portions of a third member 26. Finally, the third member 26 and the fourth member 26 are similarly attached together at the top and bottom portions of the third member and the top and bottom portions of the fourth member.

FIG. 37A presents a front view of a foldable shaft structure in a fifth embodiment taught herein. Members 28 are connected together at top and bottom with various pairs of arms 24BB as more fully described below.

FIG. 37B presents an isometric view of a foldable shaft cabin structure in a fifth embodiment taught herein. Four members 28 each have a top and a bottom portion and are disposed vertically and are connected together with various arms 24BB where each arm 24BB has two ends. A first member 28 and a second member 28 are connected with two pairs of arms 24BB. A first arm 24BB in a pair of arms 24BB are connected to the second arm in a pair of arms 24BB at a first end of the first arm 24BB in the pair together with the first end of the second arm 24BB in the pair of arms 24BB; the second end of a first arm 24BB of a pair of arms 24BB is connected to a first member 28 at the top portion thereof while the second end of the second arm 24BB is connected to the second member 28 at the top portion thereof. Another pair of arms 24BB is likewise attached to the bottom portion of the first member 28 and the bottom portion of the second member 28.

It should then be understood that the top and bottom portions of the first member 28 is similarly attached to the top and bottom portions of a fourth member 28. Likewise, the top and bottom portions of the second member 28 is attached to the top and bottom portions of a third member 28. Finally, the third member 28 and the fourth member 28 are attached together at the top and bottom portions of the third member and at the top and bottom portions of the fourth member.

FIG. 38A presents a front view of a foldable shaft structure in a sixth embodiment taught herein. Members 28 are connected together at top and bottom with various pairs of arms 24AA as more fully described below.

FIG. 38B presents an isometric view of a foldable shaft cabin structure in a sixth embodiment taught herein. Four members 27 each have a top and a bottom portion and are disposed vertically and are connected together with various arms 24AA where each arm 24AA has two ends. A first member 27 and a second member 27 are connected with two pairs of arms 24AA. The first arm 24AA in a pair of arms 24AA is connected at a first end of the first arm 24AA together with a first end of the second arm 24AA; the second end of the first arm 24AA of a pair of arms 24AA is connected to a first member 27 at the top portion thereof while the second end of the second arm 24AA is connected to a second member 27 at the top portion thereof. Another pair of arms 24AA is likewise attached to the bottom portion of the first member 27 and the bottom portion of the second member 27.

It should then be understood that the top and bottom portions of the first member 27 is similarly attached to the top and bottom portions of a fourth member 27. Likewise, the top and bottom portions of the second member 27 is attached to the top and bottom portions of a third member 27. Finally, the third member 27 and the fourth member 27 are attached together at the top and bottom portions of the third member and the top and bottom portions of the fourth member.

FIG. 39A presents an isometric assembly view of a foldable shaft structure in a fourth embodiment taught herein. Four members 26 arranged vertically are attached together forming a square shape by using pairs of arms 24CC. Each pair of arms 24CC is connected together at a first end of the first arm 24CC and at a first end of the second arm 24CC using a pivot 23. A barrel and screw 21 fastener connects the pivot 23 to the first arm 24CC through dual holes (otherwise known as an attachment point) in the first arm 24CC first end and a first corresponding hole in the pivot 23. Another barrel and screw 21 fastener connects the pivot 23 to the second arm 24CC first end through dual holes (otherwise known as an attachment point) in the second arm 24CC first end and a second corresponding hole in the pivot 23.

The connection of the second end of the first arm 24CC is to a top portion of a first member 26 whilst the second end of the second arm 24CC is to a top portion of a second member 26. It should be understood that each member 26 has a top portion and a bottom portion that facilitate attachment of the arms 24CC. The top portion has a space for welded attachment of a support 22 and another space for welded attachment of another support 22. The spatial locations of these spaces are generally disposed at an angle to one another that forms the rectangular foldable frame structure. Similarly disposed, each member 26 has a bottom portion having a space for welded attachment of a support 22 and another space for welded attachment of another support 22; these spatial locations are generally disposed at an angle to one another that forms the rectangular foldable frame structure.

Now we continue the attachment of the first arm 24CC to the first member top portion and a second arm 24CC to the second member top portion. A first support 22 is welded on a top portion of a first member 26; this support 22 has a hole therein for corresponding dual holes (otherwise known as an attachment point) in the second end of a first arm 24CC attached together with a screw and barrel 21 fastener. A second support 22 is welded on the top portion of a second member 26; this support 22 has a hole therein for a corresponding dual holes (otherwise known as an attachment point) in the second end of a second arm 24CC attached together with another screw and barrel 21 fastener set. It should be apparent as previously described, that the top and bottom portions of the four members 26 of the foldable shaft structure are likewise attached together by eight pairs of arms 24CC, 16 supports 22 with eight associated pivots 23 and thirty-two barrel and screw 21 fastener sets.

FIG. 39B presents a top isometric assembly view of a foldable shaft structure in a fourth embodiment taught herein.

FIG. 39C presents a bottom isometric assembly view of a foldable shaft structure in a fourth embodiment taught herein.

FIG. 40A presents an isometric assembly view of a foldable shaft structure in a fifth embodiment taught herein. Four members 28 are attached together forming a circular shape by using pairs of arms 24BB. Each pair of arms 24BB is connected together at a first end of the first arm 24BB and at a first end of the second arm 24BB using a pivot 25B. A barrel and screw 21 fastener connects the pivot 25B to the first arm 24BB first end through dual holes (otherwise known as an attachment point) in the first arm 24BB first end and a first corresponding hole in the pivot 25B. Another barrel and screw 21 fastener connects the pivot 25B to the second arm 24BB first end through dual holes (otherwise known as an attachment point) in the second arm 24BB first end and a second corresponding hole in the pivot 25B.

The connection of the second end of the first arm 24BB is to a top portion of a first member 28 whilst the second end of the second arm 24BB is to a top portion of a second member 28. It should be understood that each member 28 has a top portion and a bottom portion that facilitate attachment of the arms 24BB. The top portion has a space for welded attachment of a support 22 and another space for welded attachment of another support 22. The spatial locations of these spaces are generally disposed at an angle to one another that facilitates the formation of a circular foldable frame structure. Similarly disposed, each member 28 has a bottom portion having a space for welded attachment of a support 22 and another space for welded attachment of another support 22.

Now we continue the attachment of the first arm to the first member 28 top portion and a second arm to the second member 28 top portion. A first support 22 is welded on a top portion of a first member 28; this support 22 has a hole therein for concentric location with a corresponding dual hole (otherwise known as an attachment point) in the second end of a first arm 24BB attached together with a screw and barrel 21 fastener. A second support 22 is welded on the top portion of a second member 28; this support 22 has a hole therein for concentric location with a corresponding dual hole (otherwise known as an attachment point) in the second end of a second arm 24BB attached together with another screw and barrel 21 fastener set. It should be apparent as previously described, that the top and bottom portions of the four members 28 of the foldable shaft structure are likewise attached together by eight pairs of arms 24BB, 16 supports 22, eight associated pivots 25B and thirty two barrel and screw 21 fasteners.

FIG. 40B presents a top isometric assembly view of a foldable shaft structure in a fifth embodiment taught herein.

FIG. 40C presents a bottom isometric assembly view of a foldable shaft structure in a fifth embodiment taught herein.

FIG. 41A presents an isometric assembly view of a foldable shaft structure in a sixth embodiment taught herein. Four members 27 are attached together forming an octagonal shape by using pairs of arms 24AA. Each pair of arms 24AA is connected together at a first end of the first arm 24 and at a first end of the second arm 24AA using a pivot 25A. A barrel and screw 21 fastener connects the pivot 25A to the first arm 24 through a dual hole (otherwise known as an attachment point) in the first arm 24AA first end and a concentrically located first corresponding hole in the pivot 25A. Another barrel and screw 21 fastener connects the pivot 25A to the second arm 24AA first end through a dual hole (otherwise known as an attachment point) in the second arm 24AA first end and a second concentrically located corresponding hole in the pivot 25A.

The connection of the second end of the first arm is to a top portion of a first member 27 whilst the second end of the second arm is to a top portion of a second member 27. It should be understood that each member 27 has a top portion and a bottom portion that facilitate attachment of the arms 24AA. The top portion has a space for welded attachment of a support 22 and another space for welded attachment of another support 22. The spatial locations of these support 22 spaces are generally disposed at an angle to one another that forms the octagonal foldable frame structure. Similarly disposed, each member 27 has a bottom portion having a space for welded attachment of a support 22 and another space for welded attachment of another support 22 thereby similarly facilitating the octagonal foldable frame structure.

Now we continue the attachment of the first arm to the first member top portion and a second arm to the second member top portion. A first support 22 is welded on a top portion of a first member 27; this support 22 has a hole therein concentric with a corresponding dual hole (otherwise known as an attachment point) in the second end of a first arm 24AA attached together with a screw and barrel 21 fastener. A second support 22 is welded on the top portion of a second member 27; this support 22 has a hole therein for a concentrically disposed corresponding dual hole (otherwise known as an attachment point) in the second end of a second arm 24AA attached together with another screw and barrel 21 fastener set. It should be apparent as previously described, that the top and bottom portions of the four members 27 of the foldable shaft structure are likewise attached together by eight pairs of arms 24AA, 16 associated supports 22, eight associated pivots 25A and thirty-two barrel and screw 21 fasteners.

FIG. 41B presents a top isometric assembly view of a foldable shaft structure in a sixth embodiment taught herein.

FIG. 41C presents a bottom isometric assembly view of a foldable shaft structure in a sixth embodiment taught herein.

FIG. 42A presents a top view of a foldable shaft structure in a fourth embodiment disclosed herein. Here are shown the top of four members 26 having two arms 24CC attached between each adjacent two members 26 such that only two arms are shown attached to each member 26. FIG. 42B presents a top isometric closeup view of a portion of a foldable shaft structure in a fourth embodiment disclosed herein. A second end of an arm 24CC is attached using a hole therein with a corresponding hole in a support 22 that has been welded to a top portion of the member 26. Barrel and screw 21 fasteners attach the arm 24CC to a pivot 23 using a hole in the first end of the arm 24CC and a corresponding hole in the pivot 23; this is also similarly attached to a second arm 24CC using a separate hole in the pivot 23 and a corresponding hole in the second arm 24CC using another barrel and screw fastener 21. The second arm 24CC has its second end hole attached to a corresponding hole in another support 22 welded to another member 26. This attachment process is repeated about the top and bottom of the foldable shaft structure thereby forming a square shape.

FIG. 43A presents a top view of a foldable shaft structure in a fifth embodiment disclosed herein. Here are shown the top of four members 28 having two arms 24BB attached between each adjacent two members 28 such that only two arms 24BB attach to each member 28. FIG. 43B presents a top isometric closeup view of a portion of a foldable shaft structure in a fifth embodiment disclosed herein. A second end of an arm 24BB is attached using a hole therein with a corresponding hole in a support 22 that has been welded to a top portion of the member 28. Barrel and screw 21 fastener set attaches the arm 24BB to a pivot 25B using a hole in the first end of the arm 24BB and a corresponding hole in the pivot 25B; this is also similarly attached to a second arm 24BB using a separate hole in the pivot 25B and a corresponding hole in the second arm 24BB using another barrel and screw fastener 21 set. The second arm 24BB has its second end hole attached to a corresponding hole in another support 22 welded to another member 28. This attachment process is repeated about the top and bottom of the foldable shaft structure thereby forming a circular shape.

FIG. 44A presents a top view of a foldable shaft structure in a sixth embodiment disclosed herein. Here are shown the top of four members 27 having two arms 24AA attached between each adjacent two members 27 such that only two arms attach to each member 27. FIG. 44B presents a top isometric closeup view of a portion of a foldable shaft structure in a sixth embodiment disclosed herein. A second end of an arm 24AA is attached using a hole therein with a corresponding hole in a support 22 that has been welded to a top portion of the member 27. Barrel and screw 21 fasteners attach the arm 24AA to a pivot 25A using a hole in the first end of the arm 24AA and a corresponding hole in the pivot 25A; this is also similarly attached to a second arm 24AA using a separate hole in the pivot 25A and a corresponding hole in the another arm 24AA using another barrel and screw fastener 21 set. The another arm 24AA has its second end hole attached to a corresponding hole in another support 22 welded to another member 27. This attachment process is repeated about the top and bottom of the foldable shaft structure thereby forming an octagonal shape.

FIG. 45 presents a top isometric closeup view of a portion of a foldable shaft structure in a fourth embodiment disclosed herein. Here are shown the top of four members 26 having two arms 24CC attached between each adjacent two members 26 such that only two arms 24CC attach to each member 26 at top and two arms 24CC attach at bottom to each member 26. A second end of an arm 24CC is attached using a dual hole therein with a corresponding hole in a support 22 that has been welded to a top portion of the member 26. Barrel and screw 21 fastener attaches the arm 24CC to a pivot 23 using a dual hole in the first end of the arm 24CC and a corresponding hole in the pivot 23; this is also similarly attached to a second arm 24CC using a separate hole in the pivot 23 and a corresponding dual hole in the second arm 24CC using another barrel and screw fastener 21. The second arm 24CC has its second end dual hole attached to a corresponding hole in another support 22 welded to another member 26. This attachment process is repeated about the top and bottom of the foldable shaft structure thereby forming an circular shape.

FIG. 46 presents a top isometric closeup view of a portion of a foldable shaft structure in a fifth embodiment disclosed herein. Here are shown the top of four members 28 having two arms 24BB attached between each adjacent two members 28 such that only two arms attach to each member 28 at top and two arms 24BB attach at bottom to each member 28. A second end of an arm 24BB is attached using a dual hole therein with a corresponding hole in a support 22 that has been welded to a top portion of the member 28. Barrel and screw 21 fastener attaches the arm 24BB first end to a pivot 25B using a dual hole in the first end of the arm 24BB and a corresponding hole in the pivot 25B; this is also similarly attached to a second arm 24BB first end using a separate hole in the pivot 25B and a corresponding dual hole in the second arm 24BB first end using another barrel and screw fastener 21. The second arm 24BB has its second end dual hole attached to a corresponding hole in another support 22 welded to another member 28. This attachment process is repeated about the top and bottom of the foldable shaft structure thereby forming a circular shape.

FIG. 47 presents a top isometric closeup view of a portion of a foldable shaft structure in a sixth embodiment disclosed herein. Here are shown the top of four members 27 having two arms 24AA attached between each adjacent two members 27 such that only two arms 24AA attach to each member 27 at top and two arms 24AA attach at bottom to each member 27. A second end of an arm 24 is attached using a dual hole therein with a corresponding hole in a support 22 that has been welded to a top portion of the member 27. Barrel and screw 21 fastener attaches the arm 24AA to a pivot 25A using a dual hole in the first end of the arm 24 and a corresponding hole in the pivot 25A; this is also similarly attached to a second arm 24AA using a separate hole in the pivot 25A and a corresponding dual hole in the second arm 24AA first end using another barrel and screw fastener 21. The second arm 24AA has its second end dual hole attached to a corresponding hole in another support 22 welded to another member 27. This attachment process is repeated about the top and bottom of the foldable shaft structure thereby forming an octagonal shape.

FIG. 48A presents an isometric view of the foldable shaft structure in a fourth embodiment disclosed herein. Here are shown four members 26 arranged vertically and attached at a top portion of two adjacent members 26 and at a bottom portion of two adjacent members 26 as previously described thereby forming a square structure as the attachment is repeated between each successive pair of members. The first end of each of two arms 24AA are attached to a pivot using two sets of barrel and screw fasteners; a first arm 24AA is attached at its second end to a top portion of a first member 26 and a second arm 24AA is attached at its second end to a second member 26 top portion. The other top portions of the other adjacent members are similarly attached forming a square shape. The bottom portions of the various members 26 are similarly attached.

FIG. 48B presents a closeup view of a joint 23 between two arms 24CC of the foldable shaft structure in a fourth embodiment disclosed herein. Here a first end of a first arm 24CC has a dual hole therein for attachment to a first hole in a pivot 23 using a first barrel and screw fastener 21 set. Then a first end of a second arm 24CC has a dual hole therein for attachment to a second hole in a pivot 23 using a second barrel and screw fastener 21 set.

FIG. 48C presents an closeup view of a connection between an end of an arm 24CC and a bottom portion of a member of the foldable shaft structure in a fourth embodiment disclosed herein. A bottom portion of a member 26 is shown having a space for welded attachment of a first support 22 at bottom left in the figure; also, member 26 has a space for welded attachment of second support 22 at bottom right which is at an angle with the first support 22. A first arm 24CC is shown at left having its second end having a dual hole therein attached to a first support 22 using a hole in first support 22 for concentric attachment with screw and barrel 21 fastener set. Also shown is a second arm 24CC having its second end having a dual hole therein attached to a second support 22 using a hole in second support 22 for concentric attachment with screw and barrel 21 fastener set.

FIG. 49A presents an isometric view of a partially closed or open foldable shaft structure in an embodiment disclosed herein. Here the four sets of two arms 24CC are attached at the top portions of two adjacent members 26 and the four sets of two other arms 24CC are attached at the bottom portions of two adjacent members 26 and this is repeated about the four vertical members 26. The two arms 24CC are folded about the pivot 23 between them and the four sets of top member 24CC are folded downwards whilst the four sets of bottom members 24CC are folded upwards.

FIG. 49B presents an isometric closeup top portion view of a partially closed or partially open foldable shaft structure in an embodiment disclosed herein. Proceeding from the top portion of the leftmost member 26 one finds a support 22 welded thereto and a second end of a first arm 24CC attached thereto using holes in support 22 and dual hole in arm 24CC second end for attachment together using a barrel and screw fastener 21. The central pivot 23 between the two arms 24CC is attached with two oppositely situated holes in the pivot 23 for a first end of the first arm 24 and for the first end of the second arm 24CC at right using barrel and screw fasteners 21. Finally, the second arm 24CC has its second end attached to a support 22 using a hole in support 22 and in arm 24CC second end for attachment using a barrel and screw fastener 21. The second support 22 is of course welded to the top portion of the rightmost member 26.

FIG. 49C presents an isometric closeup bottom portion view of a partially closed or partially open foldable shaft structure in an embodiment disclosed herein. Proceeding from the bottom portion of the leftmost member 26 one finds a support 22 welded thereto and a second end of a first arm 24CC attached thereto using holes in support 22 and in arm 24CC second end for attachment together using a barrel and screw fastener 21 set. The central pivot 23 between the two arms 24CC is attached with two holes in the pivot 23 for a first end of the first arm 24CC and for the first end of the second arm 24CC at right using barrel and screw fasteners 21. Finally, the second arm 24CC has its second end attached to a support 22 using a hole in support 22 and in arm 24CC second end for attachment using a barrel and screw fastener 21. The second support is of course welded to the bottom portion of the rightmost member 26.

FIG. 50A presents a front isometric CLOSED position view of the foldable shaft structure in an embodiment disclosed herein. Four members 26 are shown at the vertical periphery thereof along with folded members 24CC attached to top and bottom portions in front and on the right side of the drawings between adjacent two members.

FIG. 50B presents a top CLOSED view of the top portion of the foldable shaft structure in an embodiment disclosed herein. Here four members 26 are shown from the top of the foldable shaft structure. Between two adjacent members 26 are a first support 22 welded to a top portion of a first member 26 and a second support 22 welded to a top portion of a second member 26. Between these two supports are two narrowly defined arms 24CC the first of which is attached to the first support 22 using corresponding holes in the first support 22 and the first arm 24CC; likewise, the second arm 24CC is attached to the second support 22 using corresponding holes in the second support 22 and the second arm 24CC. Finally, there is (not shown in this view) a connection by the second end of the first arm 24CC to a pivot (not shown) through corresponding holes between these two and a connection by the second end of the second arm 24CC to the pivot (not shown) through corresponding holes between these two. Various fastener barrel and screw sets 21 facilitate the connections.

FIG. 50C presents a top OPEN view of the top portion of the foldable shaft structure in an embodiment disclosed herein. Here four members 26 and various other components are shown from the top of the foldable shaft structure. Between two adjacent members 26 are a first support 22 welded to a top portion of a first member 26 and a second support 22 welded to a top portion of a second member 26. Between these two supports 22 are two arms 24CC the first of which is attached to the first support 22 using corresponding holes in the first support 22 and the first arm; likewise, the second arm 24CC is attached to the second support 22 using corresponding holes in the second support 22 and the second arm 24CC. Finally, there is a connection by the second end of the first arm 24CC to a pivot 23 through corresponding holes between these two; there is also a connection by the second end of the second arm 24CC to the pivot 23 through corresponding holes between these two. These connections use four sets of barrel and screw 21 fasteners between a single assembly at top or bottom between two adjacent members 26. This connection is repeated around the circuit of the overall structure between other sets of members 26.

FIG. 51A presents an isometric view of an OPEN POSITION of a foldable shaft structure in an embodiment herein disclosed. Once created at a manufacturer's facility, a finished foldable shaft structure is tested and placed into an OPEN POSITION. To prepare the frame for transport a user pulls down on one or more of the top assemblies and pulls up on one or more of the bottom assemblies and pushes the members inwards from one or more sides thereby causing motion towards the center of the frame. Here an assembly is the two supports each attached to a single one of two adjacent members wherein a support is attached to one arm and the other support is attached to another arm and wherein the two arms attach together through the pivot.

FIG. 51B presents an isometric view of a HALF OPEN POSITION (or partially open position) of a foldable shaft structure in an embodiment herein disclosed. After the user has moved the frame as indicated in FIG. 51A the frame is in this HALF-OPEN POSITION (or partially open position). The user then continues the same procedure, in other words, a user pulls down on or more of the top assemblies and pulls up on one or more of the bottom assemblies and pushes inwards on the members from one or more sides thereby causing motion towards the center of the foldable shaft structure. FIG. 51C presents an isometric view of a CLOSED POSITION of a foldable haft structure in an embodiment herein disclosed; this once the limits of the motion have been reached whereby the entire foldable shaft structure has had its top and bottom assemblies completely folded.

FIG. 52 presents an isometric view of a support 22 in an embodiment disclosed herein. The support 22 is a single piece of material having a generalized square or rectangular shape. It has a back surface 22D which is to be welded to various portions of members 26, 27, 28 as appropriate in the particular implementation. The front surface has a protrusion 22A at its center that extends out from the main body of support 22. The protrusion 22A has a straight top portion then a curved intermediate portion then a straight vertical portion; within the protrusion 22A there is a hole 22B that cuts from one side of the protrusion to the other. The right 22C and left 22E portions of the support 22 are both flat surfaces.

FIG. 53A presents an isometric view of a pivot 25A of the foldable shaft structure in a sixth embodiment disclosed herein. This pivot 25A has a unique structure that is utilized to form the octagonal structure described herein. It has a generally flat bottom and top surfaces as well as a left protrusion 25AH and a right protrusion 25AC situated at an angle there between at opposing ends of the pivot 25A. First the rear surface 25AA has triangular (or arrow head) shape with a top of the triangle (or arrow head) disposed outwards and integrating along an edge with 25AB. Proceeding clockwise about the part from an edge of surface 25A there is a small flat surface 25AB that integrates with an edge of a first protrusion 25AC; this first protrusion 25AC has a hole 25AD passing there through for attachment of a member 24AA. Another edge of the first protrusion 25AC integrates with another small flat surface 25AE that in turn integrates with an edge of a small inwardly directed three faceted shape 25AF; these three facets are to follow the general direction (inward arrow head) of the rear surface 25AA. Another edge of the faceted shape 25AF integrates with a small flat surface 25AG that itself integrates with an edge of a second protrusion 25AH; this second protrusion 25AH has a hole 25AI passing there through for attachment of a member 24AA. Finally, another edge of the second protrusion 25AH integrates with another small flat surface 25AD that in turn integrates with an edge of rear surface 25AA thereby completing the structure.

FIG. 53B presents an isometric view of a pivot 25B of the foldable shaft structure in a fifth embodiment disclosed herein. Pivot 25B is generally in a cross or plus shape with two square or rectangular protrusions 25BA, 25BF disposed opposite one another. There are also two other protrusions 25BH on the left and 25BC disposed on the right in the drawings. Within each of these is a hole 25BG in 25BH and 25BD in 25BC for attachment using barrel and screw fastener 21 to arms 24BB in the fifth embodiment. Surface 25BD integrates along an edge with the back surface of 25BA and with the edge of protrusion 25BH. Right surface 25BB integrates along an edge of 25BA and with the edge of protrusion 25BC. Right bottom surface 25BE integrates along an edge of protrusion 25BC and with 25BF along another edge.

FIG. 54 presents an isometric view of a pivot 23 of the foldable shaft structure in a fourth embodiment disclosed herein. The pivot 23 has a plus or cross shape having four wings; two of the wings 23B, 23D are square or rectangular and are disposed opposite one another. The other two wings 23A, 23C are disposed opposite one another and situated so as to form a plus, cross shape or similar shape (+t) along with 23B, 23D. There are two holes one 23E passing through the wing 23A and the other 23D passing through the wing 23C. Finally, the top portion of the wings 23A, 23C have a rounded edge 23G, 23H; this happens as it starts from the top flat surface of 23 moving outwards horizontally flat then curves and then proceeds down straight again.

FIG. 55 presents an isometric view of a barrel and screw 21 fastener of the foldable shaft structure in an embodiment disclosed herein. A barrel 21A has a small threaded cavity therein for attachment of a threaded screw 21B therein.

FIG. 56A presents an isometric view of the arm 24AA in an embodiment disclosed herein. The arm 24AA is a longitudinal device having a top end and a bottom end. The top end and the bottom ends each have two protrusions cooperating together to form an attachment point for a support or an attachment point for a pivot. The top two protrusions have a curved portion facing forward in the drawing and the bottom two protrusions in the drawing also have a curved portion facing backwards in the drawing.

FIG. 56B presents a isometric view of the arm 24BB in a fifth embodiment disclosed herein. Here the member 24BB is arranged in a curved fashion.

FIG. 56C presents a isometric view of the arm 24CC in a fourth embodiment disclosed herein.

FIG. 56D presents a closeup top isometric view of the arm 24AA, CC in an embodiment disclosed herein. The members 24AA, CC has a front 24H and back longitudinal surfaces as well as a right longitudinal surface 24F into the page and a left longitudinal surface 24I out of the page. The left protrusion 24B has a hole 24A and the right protrusion 24G has another hole 24Ds therein. The left protrusion 24B has a flat portion that becomes a curved edge and then flattens as it integrates downwards into the front longitudinal surface 24H of member 24AA, CC. Similarly, the right protrusion 24G has a flat portion that becomes a curved edge 24E and then flattens as it integrates downwards into the front longitudinal surface 24H of member 24AA, CC. Between the two protrusions 24B, 24G there is a cutout 24C sufficiently deep to permit the insertion of a fastener through holes 24A, 24D for individual attachment of the members 24AA, CC in various ways as described herein.

FIG. 56E presents a closeup bottom isometric view of the arm 24AA, CC in an embodiment disclosed herein. The member 24AA, CC has a front and back longitudinal surfaces as well as a right longitudinal surface 24F into the page and a left longitudinal surface 24I out of the page. The left downwards protrusion 24K has a hole 24J and the right downwards protrusion 24N has another hole 24M therein. The left downwards protrusion 24K has a flat portion that becomes a curved edge and then flattens as it integrates upwards into the back longitudinal surface of member 24AA, CC. Similarly, the right downwards protrusion 24N has a flat portion that becomes a curved edge and then flattens as it integrates upwards into the back longitudinal surface of member 24. Between the two protrusions 24K, 24N there is a cutout 24L sufficiently deep to permit the insertion of a fasteners through holes 24J, 24M for attachment of the member 24AA, CC in various ways as described herein. It should be apparent from the drawings that curved portions on the top and bottom portions are disposed in opposing fashion to one another. Thus, on the top front of the part there is a curve towards the user whist the curve on the bottom back of the part is away from the user.

FIG. 56F presents a top portion of the member 24BB shown in FIG. 56B in a fifth embodiment disclosed herein. The top portion shown in the figure has two upward protrusion 24BB1 and 24BB3 having a cutout 24BB2 in the member 24BB. The protrusions are disposed with a curved portion on a side thereof for appropriate turning of the item; this feature was previously described with respect to the members shown in FIG. 56A, FIG. 56C-E.

FIG. 56G presents a bottom portion of the member 24BB shown in FIG. 56B in a fifth embodiment disclosed herein. The bottom portion shown in the figure has two downward protrusion 24BB4 and 24BB6 having a cutout 24BB5 in the member 24BB. The protrusions are disposed with a curved portion on a side thereof for appropriate turning of the item; this feature was previously described with respect to the members shown in FIG. 56A, FIG. 56C-E. It should be apparent from the drawings that curved portions on the top portion and disposed in opposing fashion to the one on the opposite side thereof. Thus, on the top front of the part there is a curve towards the user whist the curve on the back bottom of the part is away from the user.

FIG. 57A presents a top view of a member 26 in a fourth embodiment disclosed herein.

FIG. 57B presents a front isometric view of a member 26 in a fourth embodiment disclosed herein. The member 26 has a top portion at left for welded attachment to a first support 22 and at top portion right for welded attachment to a second support 22. The member 26 has a bottom portion at left for welded attachment to a third support 22 and at bottom portion right for welded attachment to a fourth support 22. Supports 22 are used to attached various arms using barrel and screw fasteners 21.

FIG. 57C presents a closeup front top isometric view of a member 26 in a fourth embodiment disclosed herein. The member 26 has various contours running down its entire length unless otherwise specified. The member 26 has a hollow central region enclosed as follows; a left back portion 26A integrates along a curved edge with a right back portion 26I. A first left angled portion 26B integrates along a first edge thereof with another edge (forming a common edge therewith) of the left back portion 26A and moves to the right but downwards; the first left angled portion 26B also integrates along its second edge common with a second left angled portion 26C that moves down and to the left in the drawing. The second left angled portion 26C has another edge in common with a left front surface 26D; this left front surface 26D moves to the right and curves into a forward protrusion 26E. This forward protrusion 26E has a right front surface 26F that curves into it from the right. The right front surface 26F integrates along a common edge with a second right angled portion 26G that angles upwards and to the left. The second right angled portion 26G has a common edge with a first right angled portion 26H that moves to the right and upwards; the first right angled portion 26H has a common edge with the right back portion 26I completing the structure. The backs 26A, 26B, 26C, 26D, 26F, 26G, 26H, 26I and a small internal support between the left front surface 26D and the right front surface 26F enclose the hollow central region. The first left angled portion 26B and the first right angled portion 26H are utilized to attach two supports 22 one to each portion 26B, 26H near or at their respective tops. Barrel and screw 21 Fasteners use this for attachment to arms therewith.

FIG. 57D presents a closeup front bottom isometric view of a member 26 in a fourth embodiment disclosed herein. Again the first left angled portion 26B and the first right angled portion 26H are utilized to attach two supports 22 one to each portion 26B, 26H near or at their respective bottoms. Barrel and screw Fasteners 21 use this for attachment to arms therewith.

FIG. 58A presents a top view of a member 27 in a sixth embodiment disclosed herein.

FIG. 58B presents a front isometric view of a member 27 in a sixth embodiment disclosed herein. The member 27 has a top portion at left for welded attachment to a first support 22 and at top portion right for welded attachment to a second support 22. The member 27 has a bottom portion at left for welded attachment to a third support 22 and at bottom portion right for welded attachment to a fourth support 22. Supports 22 are used to attached various arms using barrel and screw fasteners 21.

FIG. 58C presents a closeup front top isometric view of a member 27 in a sixth embodiment disclosed herein. The member 27 has various contours running down its entire length unless otherwise specified. The member 27 has a hollow central region enclosed as follows; a left back portion 27A moves to the right and upwards and integrates along a common edge with a right back portion 27B. The right back portion 27B moves to the right and integrates with a first right angled portion 27C; this moves to the left but downwards and integrates along a first common edge thereof with a second right angled portion 27D that moves down and to the right sharply. The second right angled portion 27D integrates at another edge in common with the right front portion 27E. The right front portion 27E moves to the left horizontally and ends in a curve in common with a protrusion 27F. The left side of the protrusion 27F integrates along another common curve with a left front surface 27G that moves to the left horizontally. The left front surface 27G has a common edge with a second left angled portion 27H that moves upwards and to the right sharply ending at a common edge with the first left angled portion 27I. The first left angled portion 27I moves up and to left integrating with the left back surface 27A along a common edge. The backs 27A, 27B, 27C, 27D, 27E, 27G, 27H, 27I and a small internal support between the left front surface 27G and the right front surface 27E enclose the hollow central region. The first left angled portion 27I and the first right angled portion 27C are utilized to attach two supports 22 one to each portion 27I, 27C near or at their respective tops. Barrel and screw 21 fasteners use this for attachment to arms therewith.

FIG. 58D presents a closeup front bottom isometric view of a member 28 in a sixth embodiment disclosed herein. Again the first left angled portion 27I and the first right angled portion 27C are utilized to attach two supports 22 one to each portion 27I, 27C near or at their respective bottoms. Barrel and screw 21 fasteners use this for attachment to arms therewith.

FIG. 59A presents a top view of a member 28 in a fifth embodiment disclosed herein.

FIG. 59B presents a front isometric view of a member 28 in a fifth embodiment disclosed herein. The member 28 has a top portion at left for welded attachment to a first support 22 and at top portion right for welded attachment to a second support 22. The member 28 has a bottom portion at left for welded attachment to a third support 22 and at bottom portion right for welded attachment to a fourth support 22. Supports 22 are used to attached various arms using barrel and screw fasteners 21.

FIG. 59C presents a closeup front top isometric view of a member 28 in a fifth embodiment disclosed herein. The member 28 has various contours running down its entire length unless otherwise specified. The member 28 has a hollow central region enclosed as follows; a back portion 28A moves to the right horizontally and integrates along a common edge with a right portion 28B. The right portion 28B moves down and to the left and integrates with a right flanged portion 28C; this right flanged portion 28C moves to the right horizontally and integrally serves as a rightmost part of a right front portion 28D. The right front portion 28D moves to the left and curves integrally into a protrusion 28E that juts forwards therefrom. The protrusion 28E integrates with a left front portion 28F along a curve therewith. The left front portion 28F moves to the left horizontally and has a left flanged portion 28G integrally formed therewith. The left flanged portion 28G has a back common edge with a left portion 28H. Finally, the left portion 28H integrates along a common edge with the back portion 28A. The backs of 28A, 28B, portion of 28D, 28F, 28H, and a small internal support between the left front surface 26F and the right front surface 28D enclose the hollow central region. The left portion 28H and the right portion 28B are utilized to attach two supports 22 one to each portion 28H, 28B near or at their respective tops. Barrel and screw 21 Fasteners use this for attachment to arms therewith.

FIG. 59D presents a closeup front bottom isometric view of a member 28 in a fifth embodiment disclosed herein. The left portion 28H and the right portion 28B are utilized to attach two supports 22 one to each portion 28H, 28B near or at their respective bottoms. Barrel and screw 21 Fasteners use this for attachment to arms therewith.

It should be apparent from the drawings described herein that the arms 8, 24AA, 24BB, 24CC that act to fold the devices herein have a curved portion at their ends that face in a direction. Typically, when bending the top assemblies of any embodiment down the curved portions are disposed upwards at the arms and pivot attachment so that being curved the motion is facilitated. However, the arm to member connection (whether through support or joint) is oppositely disposed, that is these connections have their curved portion disposed downwards to facilitate the folding operation thereof.

On the bottom folding assemblies of any embodiment, however, the situation is reversed. Typically, when bending the bottom assemblies upwards the arm and pivot attachment is curved downwards in these portions so that being so curved the motion is facilitated. However, in the bottom assemblies, the arm to member connection (whether through support or joint) is oppositely disposed, that is these connections have their curved portion disposed upwards to facilitate the upwards folding operation thereof. In any case, these are the best dispositions for the curved portion of these connections, however, any reshaping of these ends of the arms, supports, joints pivot and so forth that facilitates these are also possible. Finally, holes for rigid applications are typically threaded such as in the various bases 16, 18, 20 and ceiling 15, 17, 19 holes and holes in supports 3. The various member portions and surfaces are typically welded together from several portions or shaped that way using stamping, pressing and shaping machines.

Further, it should be understood that the centralized or radial folding of the first set of three embodiments is a distinct concept from the side to side folding of the second set of three embodiments. This second set of embodiments has a sequential folding wherein a first folding takes place in a first direction and then a second folding takes place in a second distinct direction different than the first direction; this such each motion of the second set is not a radially or centrally disposed step even though at the end the folding steps arrive at a common center of the folded device.

Finally, it should be apparent that FIG. 4A-4C defines a square configuration; that FIG. 4D-4F defines a circular configuration; that FIG. 4G-4I defines an octagonal configuration. Also, it should be apparent that FIG. 39A-39C defines a square configuration; that FIG. 40A-40C defines a circular configuration; that FIG. 41A-41C defines an octagonal configuration.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A foldable elevator cabin structure comprising:

a first vertical cabin elevator member movably attached to a second vertical cabin elevator member and a third vertical cabin elevator member movably attached to the first and second vertical cabin elevator members through the use of a first pivot and a second pivot; such that:

a first movable assembly of arms is movably connected together such that a first end of each arm of the first movable assembly of arms is movably connected together through the first pivot; wherein a second end of a first arm of the first movable assembly of arms is movably attached to a top portion of the first vertical cabin elevator member;

a second end of a second arm of the first movable assembly of arms is movably attached to a top portion of the second vertical cabin elevator member;

a second end of a third arm of the first movable assembly of arms is movably attached to a top portion of the third vertical cabin elevator member;

a second movable assembly of arms is movably connected together such that a first end of each arm of the second movable assembly of arms is movably connected together through the second pivot; wherein a second end of a fourth arm of the second movable assembly of arms is movably attached to a bottom portion of the first vertical cabin elevator member;

a second end of a fifth arm of the second movable assembly of arms is movably attached to a bottom portion of the second vertical cabin elevator member;

a second end of a sixth arm of the second movable assembly of arms is movably attached to a bottom portion of the third vertical cabin elevator member;

wherein the first vertical cabin elevator member is thereby foldable with respect to the second and the third vertical cabin elevator members and the second and third vertical cabin elevator members are foldable with respect to each other;

an elevator ceiling attached to the first, second and third vertical cabin elevator members through: a first support attached to a first top portion of the first vertical cabin elevator member and to the ceiling top, a second support attached to a second top portion of the second vertical cabin elevator member and to the ceiling top, and a third support attached to a third top portion of the third vertical cabin elevator member and to the ceiling top;

wherein the ceiling has a first, second and third cutouts therein matching a general shape of upper parts of longitudinal sides of the first vertical cabin elevator member, the second vertical cabin elevator member and the third vertical cabin elevator member respectively, so as to position the cutouts for close physical attachment to the respective upper parts of longitudinal sides of the vertical cabin elevator member; and wherein the first and second cutouts are identical, and the corresponding upper parts of the longitudinal sides of the first and second vertical cabin elevator members are identical; but the third cutout is different than the first and second cutouts and the third cutout's corresponding upper part of the third vertical elevator cabin member longitudinal side is different than the first and second longitudinal side upper parts;

a base attached to the first, second and third vertical cabin elevator members wherein the base has three base cutouts therein matching a general shape of lower parts of longitudinal sides of the first vertical cabin elevator member, the second vertical cabin elevator member and the third vertical cabin elevator member respectively, so as to position the cutouts for close physical attachment to the respective lower parts of longitudinal sides of the vertical cabin elevator member;

wherein the base is attached to the first, second and third vertical cabin elevator members through: a fourth support attached to a first bottom portion of the first vertical cabin elevator member and also attached to the bottom of the base; a fifth support attached to a second bottom portion of the second vertical cabin elevator member and also attached to the bottom of the base; and a sixth support attached to a third bottom portion of the third vertical cabin elevator member and also attached to the bottom of the base;

wherein the first and second vertical cabin elevator members are identical members having a plurality of surfaces connected with edges, and the third vertical cabin elevator member has a different longitudinal shape being connected together with a different plurality of surfaces connected with edges.

2. The foldable elevator cabin structure of claim 1, wherein the first movable assembly of arms further comprises:

a seventh arm being an addition to the first movable assembly of arms being movably attached at a first end thereof to the first pivot and its second end movably attached to a top portion of a fourth vertical cabin elevator member;

an eighth arm being an addition to the second movably assembly of arms being movably attached at a first end thereof to the second pivot and its second end movably attached to a bottom portion of the fourth vertical cabin elevator member; and thereby permitting the folding of the fourth vertical cabin elevator member with respect to the first, second and third vertical cabin elevator members.

3. The foldable elevator cabin structure of claim 2, further comprising:

wherein the fourth vertical cabin elevator member is identical in its longitudinal profile to that of the first and second vertical cabin elevator members.

4. The foldable elevator cabin structure of claim 2, further comprising:

wherein the first and the second pivots are cross or plus shaped pivots.

5. The foldable elevator cabin structure of claim 4, further comprising wherein each one of the arms of the first movable assembly of arms is attached to solely one joint of four top joints which the four top joints are each attached to solely one vertical cabin elevator member top portion at an inwardly directed surface of the one vertical cabin elevator member matching a flat back surface of the corresponding joint; and wherein each one of the arms of the second movable assembly of arms is attached to solely one joint of four bottom joints which the four bottom joints are each attached to solely one vertical cabin elevator member bottom portion at an inwardly directed surface of the one vertical cabin elevator member matching a flat back surface of the corresponding joint.

6. The foldable elevator cabin structure of claim 1, further comprising:

wherein the third vertical cabin elevator member has an elevator equipment or cabling passageway down its longitudinal length.

7. The foldable elevator cabin structure of claim 1, further comprising:

wherein the third vertical cabin elevator member has an elevator equipment or cabling passageway down its longitudinal length and has an opening along one of its longitudinal surfaces for elevator equipment or cabling.

8. The foldable elevator cabin structure of claim 1, further comprising:

wherein the third vertical cabin elevator member has an opening along one of its longitudinal surfaces for elevator equipment or cabling.

9. The foldable elevator cabin structure of claim 1, wherein the third vertical cabin elevator member having a different longitudinal shape further comprises:

a flat portion proceeding until integration at an edge with a small portion which has another common edge with a portion that itself ends at a weld to a back of another portion almost at the midpoint thereof; the front side of the another portion integrally forms an edge with a parallel portion that parallels the flat portion and ends at an edge with an intervening portion that itself integrates with a starting edge of the flat portion;

from the weld at the back of another portion there is an integral small portion that integrates along another weld with a left angled portion which itself further integrates along an edge with a flat small portion; this flat small portion integrates with another small portion that then integrates along an edge with a further portion that then integrates along another edge of the another portion.

10. A foldable elevator cabin structure, comprising:

a first group of four arms attached together through a first pivot wherein each arm of the first group of four arms is attached using one of four joints to solely one of four vertical elevator cabin members at a top part thereof;

a first set of four top supports attached each to solely one of the vertical elevator cabin members at the top part thereof and also attached to a top portion of an elevator cabin ceiling;

a second group of four arms attached together through a second pivot wherein each arm of the second group of four arms is attached using one of four other joints to solely one of the four vertical elevator cabin members at a bottom part thereof;

a second set of four bottom supports attached each to solely one of the vertical elevator cabin members at the bottom part thereof and also attached to a bottom portion of an elevator cabin base;

wherein the first group of arms and first pivot are disposed above the elevator cabin ceiling and wherein the second group of arms and second pivot are disposed underneath the elevator cabin base;

wherein the four vertical cabin elevator members are constructed using various longitudinal surfaces such that three of the vertical elevator cabin members are constructed with identical longitudinal surfaces; and the fourth vertical elevator cabin member is constructed using a unique set of longitudinal surfaces different than those of the three vertical elevator cabin members constructed with identical longitudinal surfaces;

a set of three cutouts in the elevator cabin ceiling such that the three vertical elevator cabin members having identical longitudinal surfaces are positioned each one in a single separate one of these three cutouts for close engagement with the elevator cabin ceiling; and a fourth cutout in the elevator cabin ceiling such that the fourth vertical elevator cabin member having the unique set of longitudinal surfaces is positioned in the fourth cutout for close engagement therewith.

11. The foldable elevator cabin structure of claim 10, further comprising:

an opening in the fourth vertical elevator cabin member on one if its longitudinal surfaces for passage therethrough of elevator equipment and or cabling.

12. The foldable elevator cabin structure of claim 10, further comprising:

wherein the elevator cabin ceiling comprises a plate attached to a perimeter attachment structure.

13. The foldable elevator cabin structure of claim 10, further comprising:

wherein the first pivot has four wings such that each wing has an attachment hole for attachment to solely one of the arms of the first group of four arms first ends dual raised protrusions, and such that there are small protrusions between each wing for positioning of the respective arms connection to the first pivot.

14. The foldable elevator cabin structure of claim 13, further comprising:

wherein the second pivot has four wings such that each wing has an attachment hole for attachment to solely one of the arms of the second group of four arms first ends dual raised protrusions, and such that there are small protrusions between each wing for positioning of the respective arms connection to the second pivot.

15. The foldable elevator cabin structure of claim 14, further comprising:

an opening in the fourth vertical elevator cabin member on one of its longitudinal surfaces for passage therethrough of elevator equipment and/or cabling.

16. The foldable elevator cabin structure of claim 15, further comprising:

an opening in the elevator cabin base for passage of elevator cabin equipment or cabling.

17. The foldable elevator cabin structure of claim 10, further comprising:

the first and second pivots are cross shaped pivots;

wherein the first cross shaped pivot has four wings such that each wing has an attachment hole for attachment to solely an arm of the first group of four arms first ends dual raised protrusions, and such that there are small protrusions between each wing for positioning of the respective arms connection to the first cross shaped pivot;

wherein the second cross shaped pivot has four wings such that each wing has an attachment hole for attachment to solely an arm of the second group of four arms first ends dual raised protrusions, and such that there are small protrusions between each wing for positioning of the respective arms connection to the second cross shaped pivot.

18. The foldable elevator cabin structure of claim 17, further comprising:

an opening in the fourth vertical elevator cabin member on one of its longitudinal surfaces for passage therethrough of elevator equipment and/or cabling.

19. The foldable elevator cabin structure of claim 10, further comprising:

wherein the elevator cabin base has a cutout for passing elevator equipment or cabling therethrough.

20. The foldable elevator cabin structure of claim 10, wherein the fourth vertical elevator cabin member further comprising:

a passageway for elevator equipment or cabling.

21. The foldable elevator cabin structure of claim 10, further comprising:

wherein the three vertical cabin elevator members having identical longitudinal surfaces each having an attachment surface connected through edges with other respective surfaces, wherein the attachment surface attaches a flat back surface of a single joint of the four joints so that it faces inwards towards the first pivot; and the fourth vertical cabin elevator member has another attachment surface connected through edges with other respective surfaces of the fourth vertical cabin member, wherein the another attachment surface attaches another flat back surface of a single joint of the four joints so that it faces inwards towards the first pivot.

22. The foldable elevator cabin structure of claim 21, further comprising:

wherein a flat back surface of a single joint of the other four joints attaches to the respective attachment surface at another position on the attachment surface than the single joint of the four joints so that it faces inwards towards the second pivot; and another flat back surface of a single joint of the four other joints attaches to the another attachment surface at a location different than the single joint of the four joints so that it faces inwards towards the second pivot.

23. The foldable elevator cabin structure of claim 10, further comprising:

wherein the elevator cabin ceiling has an attachment structure attached to a ceiling plate such that the attachment structure has holes therein for attachment to one of the vertical cabin elevator members.

24. The foldable elevator cabin structure of claim 23, further comprising:

the attachment structure having the holes therein for attachment to all of the vertical cabin elevator members.

25. The foldable elevator cabin structure of claim 23, further comprising:

a first attachment hole in a first longitudinal surface of a selected one of the vertical cabin elevator members for matching a respective hole of the holes in the attachment structure such that the first longitudinal surface is bounded by two edges to two other surfaces and for attachment thereto.

26. The foldable elevator cabin structure of claim 25, further comprising:

a second attachment hole in a second longitudinal surface of the selected one of the vertical cabin elevator members for matching another hole in the attachment structure such that the second longitudinal surface is bounded by two edges to two other surfaces and for attachment thereto.

27. The foldable elevator cabin structure of claim 25, further comprising:

an opening in the first longitudinal surface at another point thereon for passage of elevator equipment or cabling.

28. The foldable elevator cabin structure of claim 10, further comprising:

an attachment structure integrally associated with the elevator cabin ceiling;

wherein the three vertical elevator cabin members having identical longitudinal surfaces each has two holes, a single hole at two distinct longitudinal surfaces of each of the three vertical elevator cabin members having identical longitudinal surfaces, so that these match corresponding holes in the attachment structure for attachment thereto; and the fourth vertical member having the unique set of different longitudinal surfaces has another two holes, a single hole for each of two different longitudinal surfaces thereof for attachment to the attachment structure using corresponding holes in the attachment structure for attachment thereto.

29. The foldable elevator cabin structure of claim 10, further comprising:

the first pivot is a cross shaped pivot so that the first group of four arms is attached together there through so that each one of the arms of the first group of four arms is attached using one of four joints to solely one of four vertical elevator cabin members at a top part thereof.

30. The foldable elevator cabin structure of claim 29, further comprising:

the second pivot is a cross shaped pivot so that the second group of four arms is attached together there through so that each one of the arms of the second group of four arms is attached using one of four other joints to solely one of four vertical elevator cabin members at a bottom part thereof.

31. A foldable elevator cabin structure comprising:

a first group of four arms attached together through a first cross shaped pivot wherein each one of the first group of four arms is attached to a single separate one of four vertical elevator cabin members at a top part thereof;

a first set of four top supports attached each to the single separate one of the vertical elevator cabin members at the top part thereof and also attached to a top portion of an elevator cabin ceiling;

a second group of four arms attached together through a second cross shaped pivot wherein each one of the second group of four arms is attached to the single separate one of the four vertical elevator cabin members at a bottom part thereof;

a second set of four bottom supports attached each to the single separate one of the vertical elevator cabin members at the bottom part thereof and also attached to a bottom portion of an elevator cabin base;

wherein the first group of arms and first cross shaped pivot are disposed above the elevator cabin ceiling and wherein the second group arms and second cross shaped pivot are disposed underneath the elevator cabin base;

wherein the four vertical cabin elevator members are constructed using various longitudinal surfaces such that three of the vertical elevator cabin members are constructed with identical longitudinal surfaces; and the fourth vertical elevator cabin member is constructed using a unique set of longitudinal surfaces different than those of the three vertical elevator cabin members constructed with identical longitudinal surfaces;

a set of three cutouts in the elevator cabin ceiling such that the three vertical elevator cabin members having identical longitudinal surfaces are positioned each one in a single separate one of these three cutouts for close engagement with the elevator cabin ceiling; and a fourth cutout in the elevator cabin ceiling such that the fourth vertical elevator cabin member having a unique set of longitudinal surfaces is positioned in the fourth cutout for close engagement therewith;

an opening in the fourth vertical elevator cabin member on one of its longitudinal surfaces for passage therethrough of elevator equipment and/or cabling;

wherein the elevator cabin ceiling comprises a plate attached to a perimeter attachment structure;

wherein the first cross shaped pivot has four wings such that each wing has an attachment hole for attachment to a separate arm of the first group of four arms first ends dual raised protrusions, and such that there are small square shaped protrusions between each wing for positioning of the respective arms connection to the first cross shaped pivot; and wherein the second cross shaped pivot has four wings such that each wing has an attachment hole for attachment to a separate arm of the second group of four arms first ends dual raised protrusions, and such that there are small square shaped protrusions between each wing for positioning of the respective arms connection to the second cross shaped pivot.

32. The foldable elevator cabin structure of claim 31, wherein the attachment of each arm of the first group of four arms to the single separate one of four vertical elevator cabin members at a top part thereof further comprises: a set of four joints attached at a back surface thereof each to only a separate one of the vertical cabin elevator members through an integral protrusion of each joint being attached to a single separate arm of the first group of four arms at two raised protrusions at a second end thereof; whilst each single separate arm of the first group of four arms has its first end attached to a single separate wing of the first cross shaped pivot.

33. The foldable elevator cabin structure of claim 32, wherein the attachment of each arm of the second group of four arms to the single separate one of four vertical elevator cabin members at a bottom part thereof further comprises: a set of four joints attached at a back surface thereof each to only a separate one of the vertical cabin elevator members through an integral protrusion of each joint being attached to a single separate arm of the second group of four arms at two raised protrusions at a second end thereof; whilst each single separate one of the second group of four arms has its first end attached to a single separate wing of the second cross shaped pivot.

34. The foldable elevator cabin structure of claim 31, wherein the attachment of each arm of the second group of four arms to the single separate one of four vertical elevator cabin members at a bottom part thereof further comprises: a set of four joints attached at a back surface thereof each to only a separate one of the vertical cabin elevator members through an integral protrusion of each joint being attached to a single separate arm of the second group of four arms at two raised protrusions at a second end thereof; whilst each single separate one of the second group of four arms has its first end attached to a single separate wing of the second cross shaped pivot.

35. The foldable elevator cabin structure of claim 34, wherein the attachment of each arm of the first group of four arms to the single separate one of four vertical elevator cabin members at a top part thereof further comprises: a set of four joints attached at a back surface thereof each to only a separate one of the vertical cabin elevator members through an integral protrusion of each joint being attached to a single separate arm of the first group of four arms at two raised protrusions at a second end thereof; whilst each single separate one of the first group of four arms has its first end attached to a single separate wing of the first cross shaped pivot.

* * * * *